US012594600B2

(12) United States Patent
Zhang et al.

(10) Patent No.: US 12,594,600 B2
(45) Date of Patent: Apr. 7, 2026

(54) METHOD OF CONTROLLABLY REDUCING OXYGEN CONTENT, AND PREPARING TITANIUM METAL POWDER AND TI6A14V ALLOY POWDER

(71) Applicant: INSTITUTE OF PROCESS ENGINEERING, CHINESE ACADEMY OF SCIENCES, Beijing (CN)

(72) Inventors: Ying Zhang, Beijing (CN); Shili Zheng, Beijing (CN); Taotao Cai, Beijing (CN); Yi Zhang, Beijing (CN)

(73) Assignee: INSTITUTE OF PROCESS ENGINEERING, CHINESE ACADEMY OF SCIENCES, Beijing (CN)

( * ) Notice: Subject to any disclaimer, the term of this patent is extended or adjusted under 35 U.S.C. 154(b) by 409 days.

(21) Appl. No.: 18/316,261

(22) Filed: May 12, 2023

(65) Prior Publication Data

US 2024/0375178 A1 Nov. 14, 2024

(51) Int. Cl.
*B22F 9/20* (2006.01)
*B22F 1/145* (2022.01)
(Continued)

(52) U.S. Cl.
CPC ..... *B22F 9/20* (2013.01); *B22F 1/145* (2022.01); *C22C 1/0458* (2013.01); *C22C 14/00* (2013.01);
(Continued)

(58) Field of Classification Search
CPC ..... B22F 9/20; B22F 1/145; B22F 2201/11; B22F 2201/12; B22F 2203/11;
(Continued)

(56) References Cited

U.S. PATENT DOCUMENTS 10,907,239 B1 2/2021 Fang et al.
2010/0015003 A1 1/2010 Adam et al.
(Continued)

FOREIGN PATENT DOCUMENTS

AU 4166085 A 11/1985
CN 1888101 A 1/2007
(Continued)

OTHER PUBLICATIONS

CN102921953 (Year: 2013).*
(Continued)

*Primary Examiner* — Danielle M. Carda
(74) *Attorney, Agent, or Firm* — BOND, SCHOENECK & KING, PLLC; George R. McGuire

(57) ABSTRACT

Provided are a method of controllably reducing an oxygen content, a method of preparing titanium metal powder, and a method of preparing Ti6Al4V alloy powder. The method of controllably reducing an oxygen content can accurately control the removal amount of oxygen in titanium oxide or vanadium aluminum alloy by introducing a calcium-containing substance into titanium source and/or vanadium source and using aluminum powder in combination as a reductant, and a simple wet treatment is performed on a reduced material obtained after reduction treatment to achieve separation of a reduction by-product and a first reduction powder to obtain high-purity titanium oxide or high-purity vanadium aluminum alloy, thereby providing theoretical and practical bases for preparing a low-valent titanium oxide having a specific oxygen content, a titanium metal powder having a low oxygen content, a vanadium aluminum alloy having a low oxygen content, and a Ti6Al4V alloy having a low oxygen content.

19 Claims, 8 Drawing Sheets

(51) Int. Cl.
*C22C 1/04* (2023.01)
*C22C 14/00* (2006.01)

(52) U.S. Cl.
CPC ..... *B22F 2201/11* (2013.01); *B22F 2201/12* (2013.01); *B22F 2203/11* (2013.01); *B22F 2301/052* (2013.01); *B22F 2301/205* (2013.01); *B22F 2998/00* (2013.01)

(58) Field of Classification Search
CPC ..... B22F 2301/052; B22F 2301/205; B22F 2998/00; C22C 1/0458; C22C 14/00; C22C 1/1089
USPC ..... 75/351
See application file for complete search history.

(56) References Cited

U.S. PATENT DOCUMENTS

| | | | | |
|---|---|---|---|---|
| 2011/0097501 | A1 | 4/2011 | Hollins et al. | |
| 2016/0222533 | A1 | 8/2016 | Zhu et al. | |
| 2017/0113273 | A1* | 4/2017 | Fang | B22F 1/052 |
| 2019/0241994 | A1 | 8/2019 | Dou et al. | |
| 2019/0283139 | A1 | 9/2019 | Zhang et al. | |
| 2022/0040762 | A1 | 2/2022 | Kang | |
| 2022/0062993 | A1 | 3/2022 | Brodskyy et al. | |

FOREIGN PATENT DOCUMENTS

| | | | | | |
|---|---|---|---|---|---|
| CN | 101522342 | A | | 9/2009 | |
| CN | 101574741 | A | | 11/2009 | |
| CN | 102534271 | A | | 7/2012 | |
| CN | 102921953 | A | * | 2/2013 | |
| CN | 104911376 | A | | 9/2015 | |
| CN | 105050757 | A | | 11/2015 | |
| CN | 106350675 | A | | 1/2017 | |
| CN | 106967895 | A | | 7/2017 | |
| CN | 107151752 | A | | 9/2017 | |
| CN | 107206501 | A | | 9/2017 | |
| CN | 107236869 | A | | 10/2017 | |
| CN | 107639234 | A | | 1/2018 | |
| CN | 107963657 | A | | 4/2018 | |
| CN | 108085505 | A | | 5/2018 | |
| CN | 108203116 | A | * | 6/2018 | C01G 23/053 |
| CN | 108217721 | A | | 6/2018 | |
| CN | 109338116 | A | | 2/2019 | |
| CN | 109439902 | A | | 3/2019 | |
| CN | 109666793 | A | | 4/2019 | |
| CN | 109848406 | A | | 6/2019 | |
| CN | 110802237 | A | | 2/2020 | |
| CN | 111118308 | A | | 5/2020 | |
| CN | 112030008 | A | | 12/2020 | |
| CN | 112267017 | A | | 1/2021 | |
| CN | 112281191 | A | | 1/2021 | |
| CN | 112725640 | A | | 4/2021 | |
| CN | 112756621 | A | | 5/2021 | |
| CN | 112809013 | A | | 5/2021 | |
| FR | 1191511 | A | | 10/1959 | |
| GB | 813999 | A | | 5/1959 | |
| IN | 201831030996 | A | | 9/2018 | |
| JP | 2002129250 | A | | 5/2002 | |
| KR | 100471423 | B1 | | 3/2005 | |
| KR | 20080057452 | A | | 6/2008 | |
| KR | 20130133376 | A | | 12/2013 | |
| KR | 20150002162 | A | | 1/2015 | |
| KR | 20200088142 | A | | 7/2020 | |
| KR | 20200122442 | A | | 10/2020 | |

OTHER PUBLICATIONS

CN108203116 (Year: 2018).*
Translated CN Office Action; Application No. 202210516786.7; Dated May 29, 2025, Entire document.
Translated CN Office Action; Application No. 202210516796.0; Dated May 30, 2025, Entire document.
Translated CN Search Report; Application No. 2022105167867; Dated May 12, 2022, Entire document.
Translated CN Search Report; Application No. 2022105167960; Dated May 12, 2022, Entire document.
Yingming, et al., "Progress in Low Cost Titanium Alloys Technology", Rare Golden House, Express, 07, Entire document.
Translated Chinese First Office Action, App. No. 202210518185.X, dated May 22, 2024, entire document.
Cong, Zhu, "Study on preparation of high quality TiO2 raw materials by HAMR and lattice oxygen control of metal titanium powder", Master Electronic Journal, Issue 9, 2019, Online publication time: Aug. 16, 2019-Sep. 15, 2019, https://kns.cnki.net/kcms2/article/abstract?v=FC2wxXHna7ob4zsD_u6jNAVIWuMDVNpv73Y81yPePbpWbl2fq5hiSnR_K-j4jT211ph_X6rjHFcl9lirA, Aug. 16, 2019, entire document.
Translated CN Notice of Allowance; Application No. 202210516745.8; Dated Aug. 4, 2025, Entire document.
Translated CN Notice of Allowance; Application No. 202210516759.X; Dated Jul. 28, 2025, Entire document.
Translated CN Notice of Allowance; Application No. 202210516770.6; Dated Jul. 28, 2025, Entire document.
Translated CN Notice of Allowance; Application No. 202210516785.2; Dated Aug. 1, 2025, Entire document.
Translated CN Notice of Allowance; Application No. 202210516796.0; Dated Sep. 29, 2025, Entire document.
Translated CN Office Action; Application No. 202210516759.X; Dated Jul. 9, 2025, Entire document.
Translated CN Office Action; Application No. 202210516770.6; Dated Jul. 8, 2025, Entire document.
Dali, et al., "Research Progress of Production of Metallic Titanium", Progress in Titanium Industry, vol. 25, No. 04; Dated Aug. 25, 2008, Entire document.
Xiaosong, et al., "Research Progress in Direct Reduction of TiO2 to Titanium", Steel Vanadium Titanium, vol. 28, No. 2; Published May 31, 2007, Entire document.

* cited by examiner

METHOD OF CONTROLLABLY REDUCING OXYGEN CONTENT, AND PREPARING TITANIUM METAL POWDER AND TI6A14V ALLOY POWDER

CROSS-REFERENCE TO RELATED APPLICATION

The present application claims priority to Chinese Patent Application Numbers. 202210518185.X, 202210516745.8, 202210516770.6, 202210516785.2, 202210516759.X. 202210516786.7 and 202210516796.0 filed May 12, 2023, the entirety of each of which is hereby incorporated by reference.

TECHNICAL FIELD

The present disclosure relates to the technical field of chemical material preparation and in particular, to a method of controllably reducing an oxygen content, a method of preparing a titanium metal powder, and a method of preparing a Ti6Al4V alloy powder.

BACKGROUND

Titanium oxide can not only provide excellent raw materials for the subsequent preparation of a titanium metal powder, but also have special functions such as having photocatalytic properties and serving as light-absorbing materials. The preparation of a titanium oxide having low valence titanium by directly reducing the most common titanium oxide $TiO_2$ is generally difficult, mainly due to the poor controllability of the oxygen-to-titanium ratio (i.e., the oxygen content in the titanium oxide). Similarly, vanadium aluminum alloy is a high-grade alloy material and is an important master alloy for producing a titanium alloy. The vanadium aluminum alloy can improve the heat resistance and cold workability of the titanium alloy, thereby enabling the titanium alloy to have excellent welding performance and mechanical strength.

At present, the conventional preparation method of the low-valent titanium oxide is generally achieved through the compounding and sintering of $TiO_2$ and Ti powder, and such a method requires the consumption of titanium powder and is costly. Some studies have involved the preparation of titanium oxides having low valent titanium by reducing $TiO_2$.

For example, CN107236869B discloses a method for preparing a reduced titanium powder by multistage deep reduction and relates to the preparation of a low-valent titanium oxide by self-propagating. The method specifically includes: uniformly mixing a dried $TiO_2$ powder with a magnesium powder to obtain a mixture, adding the mixture in a self-propagating reaction furnace, triggering a self-propagating reaction to obtain an intermediate product of low-valence titanium oxides which are dispersed in a MgO matrix, leaching the intermediate product with a hydrochloric acid as a leaching solution, and performing filtering, washing and vacuum drying to obtain a low-valence titanium oxide precursor. However, the preceding method uses magnesium as the reductant, and thus the reduction cost is high. CN104120304A discloses a method for preparing a titanium-aluminum alloy based on aluminothermic self-propagating-blowing deep reduction. In the preceding method, a self-propagating reaction is performed with a titanium oxide and an aluminum powder as raw materials to obtain a high-temperature melt. However, the resulting product is a titanium-aluminum alloy rather than a low-valence titanium oxide.

At present, the production process of vanadium-aluminum alloy is mainly self-propagating high-temperature synthesis with $V_2O_5$ as the raw material and an aluminum powder as the reductant. Such a process mainly includes the steps of raw material mixing, reaction initiation, static cooling, slag-metal separation, surface treatment and crushing. However, in such a process, the process flow of the separation steps such as slag-metal separation, surface treatment and crushing is long, and the slag-metal separation requires a high operating temperature. Moreover, the aluminum content of the vanadium-aluminum alloy prepared by the conventional industrial reduction process is at most 40 wt %, because the slag-metal separation difficulty increases as the aluminum content increases, and the preparation of the vanadium-aluminum alloy having a higher aluminum content additionally requires a large amount of external heat.

For example, CN11365256A discloses a vanadium aluminum alloy and a preparation method thereof. In the method, a vanadium pentoxide powder, an aluminum powder and a slag former are dried while mixing, or the vanadium pentoxide powder, the aluminum powder and the slag former are premixed and then dried while mixing, to obtain a mixed material; then an oxidizer is added on the surface of the mixed material, and the oxidizer is ignited to enable the mixed material to be subjected to combustion reaction; after the reaction is completed, a post-treatment is performed to obtain an alloy ingot; and the alloy ingot is crushed to obtain the vanadium-aluminum alloy. The preceding method is similar to the industrial preparation method of the vanadium-aluminum alloy and also faces similar problems. CN103849787A discloses a method for preparing an aerospace-level vanadium-aluminum alloy. The preparation method includes the following steps: uniformly mixing vanadium pentoxide, metallic aluminum and a coolant, putting the mixture into a smelting furnace, and performing igniting and smelting to obtain a vanadium-aluminum alloy with a vanadium content of 75 wt % to 85 wt % and slag; adding the vanadium-aluminum alloy obtained through the smelting into a vacuum induction furnace, adding aluminum, and performing remelting and refining to obtain an aerospace-level vanadium-aluminum alloy with the vanadium content of 45 wt % to 55 wt %. The preceding method is a typical two-step process, requires the remelting of a vanadium-aluminum alloy aluminum, and thus has high cost and high equipment requirements.

Therefore, for both the low-valence titanium oxide and the vanadium-aluminum alloy, it is necessary to develop a preparation process that has low cost, controllable product compositions and safe operation to reduce the production cost for subsequently preparing metal titanium powers and Ti6Al4V alloy powders.

SUMMARY

The present disclosure provides a method of controllably reducing an oxygen content, a method of preparing a titanium metal powder, and a method of preparing a Ti6Al4V alloy powder. Such methods are simple in flow, and the oxygen content or the vanadium-to-aluminum ratio of the final product can be accurately controlled through process operation steps, and thus the resulting product has high purity. In addition, aluminum can be used as a reductant, and compared with the method using a magnesium reductant, the preceding methods enable the cost to be significantly reduced and have broad application prospects.

In a first aspect, the present disclosure provides a method of controllably reducing an oxygen content. The method includes the following steps:

(1) mixing a raw material, a calcium source, a first reductant and a first adjuvant, and performing first reduction to obtain a reduced material; wherein the raw material is a vanadium oxide or a titanium source, and the first reductant includes aluminum; and (2) performing a first wet treatment on the reduced material to obtain a first reduced powder;

when the raw material is the titanium source, the first reduced powder is $TiO_x$, wherein a value range of x in $TiO_x$ is $0.167 \leq x \leq 1$, for example, 0.167, 0.333, 0.5, 1.0, etc.; or when the raw material is the vanadium oxide, the first reduced powder is a $VAl_y$ alloy, wherein a value range of y is $0.20 \leq y \leq 5.80$, for example, 0.33, 1.6, 3.0, 5.75, etc.

The present disclosure has creatively found that in the presence of a calcium source and a first adjuvant, the by-product $Al_2O_3$ obtained during the process of reducing $TiO_2$ with aluminum can be converted into a calcium-aluminum-containing compound which is easy to dissolve in dilute acids. In one aspect, with the change in the phase chemical compositions of the reduction by-product, in particular, the generation of substances whose Gibbs free energy is more negative, the thermodynamic driving force of the reaction "$Al+TiO_2 \rightarrow TiO_x+Al_2O_3$" can be increased without the formation of the titanium-aluminum alloy phase, thereby promoting the reaction of the first reduction. Moreover, the oxygen content in the $TiO_x$ is controllable by accurately controlling the titanium-to-aluminum ratio. In another aspect, with the controllable generation of the preceding calcium-aluminum-containing compound which is easy to dissolve in dilute acids, the physical separation method of slag-metal layer caused by ultra-high-temperature reaction of conventional self-propagating can be replaced with wet separation, the separation becomes more thorough, the $TiO_x$ with higher purity can be obtained, and high yield can be ensured.

Further, in terms of the reductant cost, since the electron number of aluminum is 3 and the electron number of magnesium is only 2, a mass of the aluminum powder required for removing the same oxygen content is 75% of the mass of the magnesium powder, and thus the reductant cost can be reduced by up to 62.5%.

The theoretical calculation formula for controlling the oxygen content in the present disclosure is $Al+TiO_2 \rightarrow TiO_x+Al_2O_3$. Although the preceding theoretical calculation formula is adopted in the present disclosure to determine the amount of the reductant used and the compositions of the low-valent titanium oxide corresponding to the reductant, the reduction by-products actually results in the calcium-aluminum-containing compound which is easy to dissolve in dilute acids.

When the raw material in the present disclosure is a vanadium source, by adding a calcium source and a first adjuvant during the process of reducing the vanadium oxide with aluminum, an aluminum-oxygen-containing phase obtained after the reduction which cannot be wet separated is changed into a phase which can be wet separated. In this manner, the aluminum oxide-rich by-product phase and the vanadium-aluminum alloy can be separated by the first wet treatment in step (2) to obtain the vanadium-aluminum alloy. Moreover, the method in the present disclosure requires only one-step reduction and has a short flow, and the vanadium-to-aluminum molar ratio of the vanadium-aluminum alloy in the product can be controlled through the accurate amount of the raw materials added, thereby providing a basis for the preparation of the vanadium-aluminum alloy required in different situations and greatly extending the application range of the preparation method.

Preferably, a temperature of the first reduction is 700° C. to 1400° C., for example, 750° C., 800° C., 900° C., 1000° C., 1100° C., 1200° C. or 1350° C., etc. In the present disclosure, the temperature of the reduction is further preferably controlled to be within the preceding range to ensure the reduction effect and ensure that the aluminum oxide-rich by-product phase which is insoluble in dilute acids is not generated.

Preferably, a time of the first reduction is 0.25 h to 24 h, for example, 0.25 h, 4.0 h, 8.0 h, 16.0 h, 20 h or 24 h, etc.

Preferably, an atmosphere of the first reduction includes vacuum or a protective atmosphere.

Preferably, the protective atmosphere includes any one or a combination of at least two of argon, hydrogen or helium, and the typical but non-limiting combinations include a combination of argon and hydrogen.

Preferably, the first adjuvant includes any one or a combination of at least two of anhydrous $CaCl_2$, a $CaCl_2$—KCl eutectic salt, a $CaCl_2$—NaCl eutectic salt or a $CaCl_2$—$AlCl_3$ eutectic salt, and the typical but non-limiting combinations include a combination of anhydrous $CaCl_2$ and a $CaCl_2$—KCl eutectic salt and a combination of a $CaCl_2$—NaCl eutectic salt and a $CaCl_2$—KCl eutectic salt.

Preferably, the first wet treatment includes: performing first slurrying on the reduced material with water to obtain a first slurry; performing first pH adjustment on the pH of the first slurry with a hydrochloric acid, and performing solid-liquid separation to obtain a first liquid phase solution and a first solid phase; performing second slurrying on the first solid phase with water and/or an acid liquid to obtain a second slurry; performing second pH adjustment on the pH of the second slurry with a hydrochloric acid, and performing solid-liquid separation to obtain a second liquid phase and a second solid phase; and washing and drying the second solid phase to obtain the first reduced powder;

or, the first wet treatment includes: performing third slurrying on the reduced material with water and/or an acid liquid to obtain a third slurry, performing third pH adjustment on the pH of the third slurry, performing solid-liquid separation to obtain a third solid phase, and washing and drying the third solid phase to obtain the first reduced powder.

Preferably, $(NH_4)_2CO_3$ and the first liquid phase solution are mixed and react or $NH_4HCO_3$, ammonia and the first liquid phase solution are mixed and react, and solid-liquid separation is performed after reacting to obtain a $CaCO_3$ solid and a $NH_4Cl$ solution.

Preferably, $CaCO_3$ is returned and used in step (1) as a calcium source for the first reduction.

In the present disclosure, when the calcium source is required to be mixed and calcined with the raw material (a titanium source) before the first reduction, the calcium source may be directly returned; and when the calcium source does not need to be mixed and calcined with the raw material, $CaCO_3$ is calcined into CaO and then returned.

Preferably, a liquid-to-solid ratio of the first slurrying is 2:1 mL/g to 20:1 mL/g, for example, 3:1 mL/g, 5:1 mL/g, 10:1 mL/g, 15:1 mL/g or 18:1 mL/g, etc.

Preferably, the first pH adjustment is performed with the hydrochloric acid to adjust the pH to 5.0 to 6.0, for example, 5.1, 5.5 or 5.8, etc.

Preferably, the second pH adjustment is performed with the hydrochloric acid to adjust the pH to 1.0 to 3.0, for example, 1.2, 1.5, 2.0, 2.5 or 2.8, etc.

Preferably, the second liquid phase is a mixed solution of $AlCl_3$—$CaCl_2$.

Preferably, the mixed solution of $AlCl_3$—$CaCl_2$ is used for preparing a polyaluminium chloride product.

Preferably, a pH of the third slurry is controlled to be greater than or equal to 0.8 during the third pH adjustment, for example, 0.81, 0.85, 1.0, 1.2, 2.0, 2.2 or 2.5, etc.

In the present disclosure, to prevent the reduced material from having a dissolution reaction with the acid during the pH adjustment process, the pH of the slurry during the pH adjustment process is preferably controlled to be 0.8 and above, and when the pH is stable between 1.5 and 3.0 and no long changes, the pH adjustment is considered to be finished.

Preferably, a pH of the third slurry after the third pH adjustment is 1.5 to 3.0, for example, 1.6, 1.7, 1.9, 2.2, 2.3, 2.5 or 2.8, etc.

The following is the detailed feature description with the titanium source as the raw material.

Preferably, the mixing in step (1) includes: performing first mixing on the titanium source and the calcium source to obtain a calcium-containing titanium source, and performing second mixing on the calcium-containing titanium source, the first reductant and the first adjuvant.

Preferably, the calcium-containing titanium source includes any one or a combination of at least two of a first titanium source, a second titanium source, a third titanium source or a fourth titanium source; wherein, the first titanium source is a mixture of titanium dioxide and a calcium oxide, the second titanium source is a mixture of a calcium oxide and calcined titanium dioxide, the third titanium source is a mixture of a calcium oxide and a calcined product obtained after the calcination of a calcium oxide and titanium dioxide mixed based on the stoichiometric ratio of $CaTiO_3$, and the fourth titanium source is a mixture of a calcium oxide and titanium dioxide which are weighted in a ratio exceeding the ratio based on the stoichiometric ratio of $CaTiO_3$, mixed and calcined.

In the present disclosure, a mixture of a calcium oxide and a calcined product obtained by calcining a mixture of a calcium oxide and titanium dioxide weighted based on the stoichiometric ratio of $CaTiO_3$ may be used as the calcium-containing titanium source, and a calcined product obtained by calcining a mixture of a calcium oxide and titanium dioxide whose masses exceeds the masses of the calcium oxide and titanium dioxide weighted based on the stoichiometric ratio of $CaTiO_3$ may also be used as the calcium-containing titanium source.

In the present disclosure, a calcined material is preferably used to further avoid the agglomeration of fine $TiO_2$ in the subsequent mixing process.

Preferably, a temperature of the calcining for obtaining the second titanium source, the third titanium source and the fourth titanium source is each independently 1000° C. to 1400° C., for example, 1100° C., 1150° C., 1200° C., 1250° C. or 1350° C., etc.

Preferably, a molar ratio of calcium in the calcium-containing titanium source to the first reductant is 0.6:1 to 2:1, for example, 0.8:1, 1.0:1, 1.5:1 or 1.8:1, etc.

Preferably, a molar ratio of the first reductant to titanium in the calcium-containing titanium source is 0.67:1 to 1.33:1, for example, 0.8:1, 1.0:1, 1.2:1 or 1.22:1, etc.

In the present disclosure, the ratio among the reductant, calcium and titanium in the titanium source is preferably controlled to be within the preceding range. In one aspect, the reduction by-product can be ensured to be a calcium-aluminum-containing compound which is easy to dissolve in dilute acids, ensuring that $TiO_x$ and the reduction by-product are separated in an acid solution. In another aspect, the value of x in the final titanium oxide can be effectively controlled to be within the range of 0.167 to 1.

Preferably, a mass ratio of the first adjuvant to titanium in the titanium source based on $TiO_2$ is 0.05:1 to 3:1, for example, 0.1:1, 0.5:1, 1.0:1, 1.5:1, 2.0:1 or 2.5:1, etc.

As a preferred technical solution of the first aspect of the present disclosure, when the raw material is the titanium source, the method of controllably reducing an oxygen content is actually a method of preparing a low-valence titanium oxide having a controllable oxygen content. The preparation method includes the following steps:

(1) mixing a calcium-containing titanium source, a first reductant and a first adjuvant, wherein a molar ratio of calcium in the calcium-containing titanium source to the first reductant is 0.6:1 to 2:1, a molar ratio of the first reductant to titanium in the calcium-containing titanium source is 0.67:1 to 1.33:1, and a mass ratio of the first adjuvant to titanium in the calcium-containing titanium source based on $TiO_2$ is 0.05:1 to 3:1; and performing the first reduction on the resulting mixture at 700° C. to 1400° C. under vacuum or a protective atmosphere for 0.25 h to 24 h to obtain a reduced material, wherein the reductant includes an aluminum powder; and (2) performing first slurrying on the reduced material with water to obtain a first slurry, wherein a liquid-to-solid ratio of the first slurrying is 2:1 mL/g to 20:1 mL/g; performing first pH adjustment with a hydrochloric acid to adjust a pH of the first slurry to 5.0 to 6.0, and performing solid-liquid separation to obtain a first liquid phase solution and a first solid phase; mixing $(NH_4)_2CO_3$ and the first liquid phase solution or mixing $NH_4HCO_3$, ammonia and the first liquid phase solution, performing a reaction, and performing solid-liquid separation after the reaction to obtain a $CaCO_3$ solid and a $NH_4Cl$ solution, wherein $CaCO_3$ is returned as a calcium source; performing second slurrying on the first solid phase with water and/or an acid liquid to obtain a second slurry; performing second pH adjustment with a hydrochloric acid to adjust a pH of the second slurry to 1.0 to 3.0, and performing solid-liquid separation to obtain a second liquid phase and a second solid phase, wherein the second liquid phase is a mixed solution of $AlCl_3$—$CaCl_2$, and the mixed solution of $AlCl_3$—$CaCl_2$ is used for preparing a polyaluminium chloride product; and washing the second solid phase at 0° C. to 60° C., and drying the second solid phase at a temperature less than or equal to 60° C. to obtain the first reduced powder; or performing third slurrying on the reduced material with water and/or an acid liquid whose pH is greater than or equal to 0.5 to obtain a third slurry, wherein a liquid-to-solid ratio of the third slurrying is 1:1 mL/g to 100:1 mL/g; performing third pH adjustment on the pH of the third slurry, wherein a pH of the third slurry is controlled to be greater than or equal to 0.8 during the third pH adjustment and the pH of the third slurry after the third pH adjustment is 1.5 to 3.0; performing solid-liquid separation to obtain a third solid phase; and washing the third solid phase, and drying the third solid phase at a temperature less than or equal to 60° C. to obtain the first reduced powder;

wherein the first reduced powder is $TiO_x$, and a value of x in $TiO_x$ is $0.167 \leq x \leq 1$.

The following is the detailed feature description with the vanadium oxide as the raw material.

Preferably, the vanadium oxide in step (1) includes $V_2O_3$ and/or $V_2O_5$.

Preferably, when the raw material is the vanadium oxide, a molar ratio of the first reductant to the vanadium oxide is (2ay+2by+10b/3+2a):(a+b), wherein y is the value of y in the $VAl_y$ alloy, a/(a+b) is the molar ratio of $V_2O_3$ in the vanadium oxide, and b/(a+b) is the molar ratio of $V_2O_5$ in the vanadium oxide.

In the present disclosure, the preparation of the vanadium-aluminum alloy requires only one reduction step represented by the following chemical equation: $aV_2O_3+bV_2O_5+(2ay+2by+10b/3+2a)Al=(2a+2b)VAl_y+(5b/3+a)Al_2O_3$. When the value of y in the vanadium-aluminum alloy $VAl_y$ product needs to be particularly limited, the corresponding product can be obtained directly by controlling the amount of the reductant added. Although the value of y is calculated using the preceding equation in the present disclosure, the reduction by-product is not aluminum oxide but a phase which contains aluminum and calcium and is soluble in dilute acids.

Preferably, the calcium source is a calcium oxide.

Preferably, a molar ratio of the calcium oxide to the first reductant is 0.6:1 to 2:1, for example, 0.8:1, 1:1, 1.2:1, 1.5:1 or 1.8:1, etc. In the present disclosure, the molar ratio of the calcium oxide to the first reductant is further preferably controlled to be within the preceding range to ensure the generation of the reduction by-product which can be processed by the wet treatment and avoid the vanadium-aluminum alloy from having a high oxygen content or carrying impurities.

Preferably, a mass ratio of the first adjuvant to the vanadium oxide is 0.05:1 to 3:1, for example, 0.1:1, 0.5:1, 1.0:1, 1.5:1, 2.0:1 or 2.5:1, etc.

Preferably, when the raw material is the vanadium oxide, the method further includes: (3) performing first deoxidization on the $VAl_y$ alloy with a first deoxidizer to obtain a first deoxidized material, wherein the first deoxidizer includes calcium; and (4) performing a wet treatment on the first deoxidized material to obtain a $VAl_y$ alloy with a low oxygen content.

Preferably, an oxygen content of the $VAl_y$ alloy with a low oxygen content is less than or equal to 0.20 wt %, for example, 0.15 wt %, 0.12 wt %, 0.10 wt %, 0.09 wt % or 0.08 wt %, etc.

Preferably, a mass ratio of the $VAl_y$ alloy to the first deoxidizer is 1:0.05 to 1:0.5, for example, 1:0.06, 1:0.2, 1:0.25, 1:0.4 or 1:045, etc.

Preferably, a first deoxidization adjuvant is added in the deep deoxidization.

Preferably, the first deoxidization adjuvant includes any one or a combination of at least two of anhydrous $CaCl_2$, a $CaCl_2$—$MgCl_2$ eutectic salt, a $CaCl_2$—NaCl eutectic salt or a $CaCl_2$—KCl eutectic salt, and the typical but non-limiting combinations include a combination of anhydrous $CaCl_2$ and a $CaCl_2$—$MgCl_2$ eutectic salt, a combination of a $CaCl_2$—NaCl eutectic salt and a $CaCl_2$—$MgCl_2$ eutectic salt, and a combination of anhydrous $CaCl_2$ and a $CaCl_2$—KCl eutectic salt.

Preferably, a mass ratio of the first deoxidization adjuvant to the $VAl_y$ alloy is 0.05:1 to 3:1, for example, 0.38:1, 0.71:1, 2.02:1 or 2.35:1, etc.

Preferably, a temperature of the first deoxidization is 700° C. to 1100° C., for example, 710° C., 789° C., 834° C., 967° C., 1056° C. or 1090° C., etc.

Preferably, a time of the first deoxidization is 0.25 h to 48 h, for example, 0.5 h, 10 h, 16 h, 26 h, 42 h, 45 h, etc.

Preferably, an atmosphere of the first deoxidization is vacuum or a protective atmosphere.

As a preferred technical solution of the present disclosure, when the raw material is the vanadium oxide, a method of preparing a vanadium-aluminum alloy having a controllable vanadium-to-aluminum molar ratio is actually provided. The preparation method includes the following steps:

(1') mixing a vanadium oxide, a calcium source, a first reductant and a first adjuvant, wherein a molar ratio of the first reductant to the vanadium oxide is (2ay+2by+10b/3+2a):(a+b), y is the value of y in the $VAl_y$ alloy, a/(a+b) is the molar ratio of $V_2O_3$ in the vanadium oxide, b/(a+b) is the molar ratio of $V_2O_5$ in the vanadium oxide, the calcium source is CaO, a molar ratio of CaO to the first reductant is 0.6:1 to 2:1, and a mass ratio of the first adjuvant to the vanadium oxide is 0.05:1 to 3:1; and performing reduction on the resulting mixture at 700° C. to 1400° C. under vacuum or a protective atmosphere for 0.25 h to 24 h to obtain a reduced material, wherein the reductant includes aluminum;

(2') performing first slurrying on the reduced material with water to obtain a first slurry, wherein a liquid-to-solid ratio of the first slurrying is 2:1 mL/g to 20:1 mL/g; performing first pH adjustment with a hydrochloric acid to adjust a pH of the first slurry to 5.0 to 6.0, and performing solid-liquid separation to obtain a first liquid phase solution and a first solid phase; mixing $(NH_4)_2CO_3$ and the first liquid phase solution or mixing $NH_4HCO_3$, ammonia and the first liquid phase solution, performing a reaction, and performing solid-liquid separation after the reaction to obtain a $CaCO_3$ solid and a $NH_4Cl$ solution, wherein $CaCO_3$ is returned as a calcium source; performing second slurrying on the first solid phase with water and/or an acid liquid to obtain a second slurry; performing second pH adjustment with a hydrochloric acid to adjust a pH of the second slurry to 1.0 to 3.0, and performing solid-liquid separation to obtain a second liquid phase and a second solid phase, wherein the second liquid phase is a mixed solution of $AlCl_3$—$CaCl_2$, and the mixed solution of $AlCl_3$—$CaCl_2$ is used for preparing a polyaluminium chloride product; and washing the second solid phase at 0° C. to 60° C., and drying the second solid phase at a temperature less than or equal to 60° C. to obtain a first reduced powder; or performing slurrying on the reduced material with water and/or a hydrochloric acid liquid whose pH is greater than or equal to 0.5 to obtain a slurry; performing pH adjustment on the pH of the slurry, wherein the pH of the slurry is controlled to be greater than or equal to 0.8 during the pH adjustment, and the pH of the slurry after the pH adjustment is stabilized to 1.5 to 3.0; performing solid-liquid separation to obtain a solid phase; and washing the solid phase at 0° C. to 60° C., and drying the solid phase at a temperature less than or equal to 60° C. to obtain a first reduced powder;

wherein the first reduced powder is a $VAl_y$ alloy, and a value of y is $0.20 \leq y \leq 5.80$.

Optionally, the preparation method further includes the following steps:

(3') performing first deoxidization on the $VAl_y$ alloy with a first deoxidizer and a first deoxidization adjuvant at 700° C. to 1100° C. under vacuum or a protective atmosphere for 0.25 h to 48 h to obtain a deoxidized material, wherein the first deoxidizer includes calcium, a mass ratio of the $VAl_y$ alloy to the first deoxidizer is 1:0.05 to 1:0.5, and a mass ratio of the first deoxidization adjuvant to the $VAl_y$ alloy is 0.05:1 to 3:1;

(4') performing slurrying on the deoxidized material with water and/or a hydrochloric acid liquid whose pH is greater than or equal to 0.5 to obtain a slurry; performing pH adjustment on the pH of the slurry, wherein the pH of the slurry is controlled to be greater than or equal to 0.8 during the pH adjustment, and the pH of the slurry after the pH adjustment is stabilized to 1.5 to 3.0; performing solid-liquid separation to obtain a solid phase; and washing the solid phase at 0° C. to 60° C., and drying the solid phase at a temperature less than or equal to 60° C. to obtain a $VAl_y$ alloy having an oxygen content less than or equal to 0.20 wt %.

In a second aspect, the present disclosure provides a method of preparing a titanium metal powder by reduction. The method includes the method of controllably reducing an oxygen content described in the first aspect.

In the present disclosure, when a $TiO_x$ powder is prepared in the step of first reduction of the method of preparing the titanium metal powder, the oxygen content in the $TiO_x$ powder can be accurately controlled, and then the low-oxygen titanium metal powder can be prepared by different process routes, thereby reducing the preparation cost of the titanium powder.

Preferably, the method includes four independent schemes. The method in a first scheme includes: performing deep deoxidization and a deep deoxidization wet treatment on a first reduced powder with a deep deoxidizer to obtain a titanium metal powder, wherein the deep deoxidizer includes magnesium and/or calcium, the first reduced powder is $TiO_x$, wherein $0.167 \leq x \leq 0.5$.

The method in a second scheme includes: performing second reduction on a first reduced powder with a second reductant, and performing a second wet treatment to obtain a second reduced powder having an oxygen content less than or equal to 2 wt %, wherein the second reductant includes magnesium; and performing deep deoxidization and a deep deoxidization wet treatment on the second reduced powder with a deep deoxidizer to obtain a titanium metal powder, wherein the deep deoxidizer includes magnesium and/or calcium, the first reduced powder is $TiO_x$, wherein x is $0.167 < x \leq 1$.

The method in a third scheme includes: mixing a first reduced powder and a titanium metal powder partially returned to obtain a mixed material, performing first sintering on the mixed material to obtain a titanium-oxygen solid solution having an oxygen content less than or equal to 8 wt %, and performing deep deoxidization and a deep deoxidization wet treatment on the titanium-oxygen solid solution with a deep deoxidizer to obtain a titanium metal powder, wherein the deep deoxidizer includes magnesium and/or calcium, the first reduced powder is $TiO_x$, wherein x is $0.333 \leq x \leq 0.5$.

The method in a fourth scheme includes: performing second reduction on titanium dioxide with a second reductant, and performing a second wet treatment to obtain a second reduced powder having an oxygen content less than or equal to 3 wt %; mixing the second reduced powder and a first reduced powder, and performing second sintering to obtain a titanium-oxygen solid solution having an oxygen content less than or equal to 8 wt %; and performing deep deoxidization and a deep deoxidization wet treatment on the titanium-oxygen solid solution with a deep deoxidizer to obtain a titanium metal powder, wherein the deep deoxidizer includes magnesium and/or calcium, the first reduced powder is $TiO_x$, wherein x is $0.333 \leq x \leq 0.5$.

When a raw material is a titanium source, a temperature of the first reduction is 700° C. to 1400° C. in the first scheme, 700° C. to 1100° C. in the second scheme, and each independently 700° C. to 1200° C. in the third scheme and the fourth scheme.

When the raw material is a titanium source, a time of the first reduction is 0.25 h to 24 h in the first scheme, 0.5 h to 24 h in the second scheme, and each independently 0.3 h to 24 h in the third scheme and the fourth scheme.

A molar ratio of the first reductant to titanium in the calcium-containing titanium source is 1:1 to 1.33:1 in the first scheme, 0.67:1 to 1.30:1 in the second scheme, 1:1 to 1.22:1 in the third scheme, and 1:1 to 1.22:1 in the fourth scheme.

Preferably, a mass ratio of the second reductant to the first reduced powder in the second scheme is 0.09:1 to 0.56:1, for example, 0.1:1, 0.2:1, 0.3:1 or 0.5:1, etc.; or a molar ratio of the second reductant to titanium dioxide in the fourth scheme is 2:1 to 4:1, for example, 2.5:1, 3.0:1, 3.5:1 or 3.8:1, etc.

Preferably, a second adjuvant is added in the second reduction.

Preferably, the second adjuvant includes any one or a combination of at least two of anhydrous $MgCl_2$, a $MgCl_2$—$CaCl_2$ eutectic salt, a $MgCl_2$—NaCl eutectic salt or a $MgCl_2$—KCl eutectic salt, and the typical but non-limiting combinations include a combination of anhydrous $MgCl_2$ and a $MgCl_2$—$CaCl_2$ eutectic salt.

Preferably, a mass ratio of the second adjuvant to the first reduced powder or titanium dioxide is 0.05:1 to 3:1, for example, 0.08:1, 0.38:1, 0.71:1, 2.02:1 or 2.35:1, etc.

Preferably, a temperature of the second reduction in the second scheme is 650° C. to 900° C., for example, 680° C., 700° C., 800° C. or 850° C., etc.; or the temperature of the second reduction in the fourth scheme is 600° C. to 900° C., for example, 650° C., 700° C., 800° C. or 850° C., etc.

Preferably, a time of the second reduction and the deep deoxidization is each independently 0.25 h to 48 h, for example, 0.5 h, 1.0 h, 6 h, 15 h, 35 h, 40 h or 45 h, etc.

Preferably, the protective atmosphere of the second reduction includes any one or a combination of at least two of argon, hydrogen or helium, and the typical but non-limiting combinations include a combination of argon and hydrogen.

Preferably, a deep deoxidization adjuvant is added in the deep deoxidization.

Preferably, a mass ratio of the deep deoxidization adjuvant to the titanium-oxygen solid solution, the first reduced powder or the second reduced powder is 0.05:1 to 3:1, for example, 0.06:1, 0.1:1, 1:1, 2:1 or 2.5:1, etc.

Preferably, when the deep deoxidizer contains magnesium, a mass ratio of magnesium to the first reduced powder in the first scheme is 0.08:1 to 0.64:1, for example, 0.09:1, 0.1:1, 0.2:1, 0.5:1 or 0.6:1, etc.; mass ratio of magnesium to the second reduced powder in the second scheme is 0.03:1 to 0.2:1, for example, 0.05:1, 0.1:1, 0.12:1, 0.15:1, etc.; the mass ratio of magnesium to the titanium-oxygen solid solution in the third scheme is 0.05:1 to 3:1, for example, 0.06:1, 0.1:1, 1:1, 2:1, 2.5:1, etc.; or the mass ratio of magnesium to the titanium-oxygen solid solution in the fourth scheme is 0.033:1 to 0.6:1, for example, 0.04:1, 0.1:1, 0.2:1, 0.5:1, 0.55:1, etc.

Preferably, when the deep deoxidizer contains magnesium, the deep deoxidization adjuvant includes any one or a combination of at least two of anhydrous $MgCl_2$, a $MgCl_2$—$CaCl_2$ eutectic salt, a $MgCl_2$—NaCl eutectic salt or a $MgCl_2$—KCl eutectic salt, and the typical but non-limiting combinations include a combination of anhydrous $MgCl_2$ and a $MgCl_2$—$CaCl_2$ eutectic salt.

Preferably, when the deep deoxidizer contains magnesium, the temperature of the deep deoxidization is 650° C. to 900° C., for example, 677° C., 705° C., 787° C., 815° C., 842° C., or 890° C., etc.

Preferably, when the deep deoxidizer contains magnesium, an atmosphere of the deep deoxidization includes a hydrogen-argon mixed atmosphere or a pure hydrogen atmosphere.

Preferably, a volume fraction of hydrogen in the hydrogen-argon mixed atmosphere is 5% to 100%, for example, 10%, 30%, 40%, 60%, 80% or 90%, etc.

Preferably, when the deep deoxidizer contains magnesium, a dehydrogenation treatment is performed on the titanium metal powder obtained by the deep deoxidization wet treatment.

Since the atmosphere of the deep deoxidization contains hydrogen when magnesium is used as the deep deoxidizer, the titanium metal powder obtained by the deep deoxidization wet treatment contains hydrogen. When the hydrogen content of titanium powder products is limited by the application scenario, the dehydrogenation treatment needs to be performed.

Preferably, a temperature of the dehydrogenation treatment is 500° C. to 1000° C., for example, 510° C., 600° C., 700° C., 800° C. or 900° C., etc.

Preferably, an atmosphere of the dehydrogenation treatment includes vacuum or a protective atmosphere.

Preferably, the protective atmosphere of the dehydrogenation treatment includes argon and/or helium.

Preferably, when the deep deoxidizer contains calcium, a mass ratio of calcium to the first reduced powder in the first scheme is 0.13:1 to 1:1, for example, 0.14:1, 0.3:1, 0.5:1, 0.8:1 or 0.9:1, etc.; a mass ratio of calcium to the second reduced powder in the second scheme is 0.05:1 to 0.4:1, for example, 0.06:1, 0.1:1, 0.2:1, 0.3:1 or 0.35:1, etc.; a mass ratio of calcium to the titanium-oxygen solid solution in the third scheme is 0.05:1 to 3:1, for example, 0.06:1, 0.1:1, 1:1, 2:1 or 2.8:1, etc.; or a mass ratio of calcium to the titanium-oxygen solid solution in the fourth scheme is 0.033:1 to 0.8:1, for example, 0.04:1, 0.1:1, 0.3:1, 0.6:1 or 0.7:1, etc.

Preferably, when the deep deoxidizer contains calcium, the deep deoxidization adjuvant includes any one or a combination of at least two of anhydrous $CaCl_2$, a $CaCl_2$—$MgCl_2$ eutectic salt, a $CaCl_2$—NaCl eutectic salt or a $CaCl_2$—KCl eutectic salt, and the typical but non-limiting combinations include a combination of anhydrous $CaCl_2$ and a $CaCl_2$—$MgCl_2$ eutectic salt.

Preferably, when the deep deoxidizer contains calcium, a temperature of the deep deoxidization is 700° C. to 1100° C., for example, 800° C., 850° C., 950° C. or 950° C., etc.

Preferably, when the deep deoxidizer contains calcium, an atmosphere of the deep deoxidization includes vacuum or a protective atmosphere.

Preferably, the method further includes: performing third sintering or a melting solidification treatment on the first reduced powder between the first wet treatment and the deep deoxidization in the first scheme.

The surface oxygen content of the titanium metal particles decreases as the specific surface area decreases. After the first reduction and the first wet treatment, the $TiO_x$ ($0.167 \leq x \leq 0.5$) intermediate powder obtained according to the present disclosure has a porous morphology, and a dense intermediate can be obtained by performing a sintering treatment or a melting solidification treatment on the intermediate powder, facilitating the control of the subsequent surface oxygen content and facilitating the reduction of the oxygen content in the final titanium powder.

In the present disclosure, if the deep deoxidization treatment is performed on the first reduced powder and the second reduced powder with calcium, although the first reduced powder and the second reduced powder are not necessarily compact, since the deoxidization by-product CaO has a large solubility in the $CaCl_2$-containing deep deoxidization adjuvant, the CaO can be dissolved and migrated during the deep deoxidization treatment process, which facilitates diffusion sintering of the titanium matrix in the deoxidization process to reduce the specific surface area. In this manner, calcium deoxidization can be directly performed so that a low oxygen content level is reached without the need of performing the sintering treatment or the melting solidification treatment.

Preferably, a temperature of the third sintering is 1000° C. to 1500° C., for example, 1045° C., 1090° C., 1135° C., 1315° C. or 1400° C., etc.

Preferably, a time of the third sintering is 0.25 h to 24 h, for example, 0.5 h, 1 h, 5.5 h, 16 h, 18 h or 23 h, etc.

Preferably, a manner of the melting solidification treatment includes electromagnetic induction smelting.

Preferably, the method in the second scheme further includes: performing a heat treatment on the second reduced powder between the second wet treatment and the deep deoxidization. The surface oxygen content of the titanium metal particles decreases as the specific surface area decreases. After the first reduction and the second reduction, the second reduced powder obtained according to the present disclosure still has a certain porous structure, and a dense intermediate can be obtained by performing a heat treatment on the second reduced powder, facilitating the control of the subsequent surface oxygen content and facilitating the reduction of the oxygen content in the final titanium powder.

Preferably, a temperature of the heat treatment is 750° C. to 1100° C., for example, 780° C., 820° C., 940° C., 980° C., 1020° C. or 1060° C., etc. In the present disclosure, the temperature of the heat treatment is further preferably controlled within the preceding range. The temperature which is not too high, in one aspect, facilitates equipment selection and, in another aspect, can ensure the densification of the second reduced powder.

Preferably, a time of the heat treatment is 0.167 h to 24 h, for example, 2 h, 5 h, 10 h, 13 h, 16 h, 18 h or 21 h, etc.

Preferably, a mass ratio of the first reduced powder to the titanium metal powder mixed in the third scheme is 1:0.25 to 1:10, for example, 1:0.7, 1:0.8, 1:1, 1:2, 1:5, 1:7 or 1:8, etc.

Preferably, a mass ratio of the first reduced powder to the second reduced powder mixed in the fourth scheme is 1:0.267 to 1:10, for example, 1:0.3, 1:1, 1:2, 1:4, 1:7, 1:8 or 1:9, etc.

Preferably, the mixing in the third scheme includes dry powder mixing; the mixing includes: grinding a $TiO_x$ intermediate powder into a slurry until the particle size of the $TiO_x$ intermediate powder in the slurry is 10 μm or less, then mixing the slurry and the titanium metal powder, and stirring and drying the resulting mixture; the mixing includes:

grinding a $TiO_x$ intermediate powder into a slurry until the particle size of the $TiO_x$ intermediate powder in the slurry is 6 μm or less, atomizing the slurry to the surface of the titanium metal powder with an airflow, and drying the surface; or the mixing includes: mixing a $TiO_x$ intermediate powder and the titanium metal powder, and crushing and pelletizing the resulting mixture.

Preferably, the mixing in the fourth scheme includes dry powder mixing, or the mixing includes: mixing the first reduced powder and the second reduced powder, and crushing and pelletizing the resulting mixture.

Preferably, a manner of the crushing in the third scheme and the fourth scheme each independently includes any one or a combination of at least two of ball milling, tumble milling, stirred milling or airflow milling, and the typical but non-limiting combinations include a combination of ball milling and stirred milling, a combination of airflow milling and stirred milling, and a combination of ball milling and airflow milling.

Preferably, a manner of the pelletizing in the third scheme and the fourth scheme each independently includes any one of spray pelletizing, tumble pelletizing or compact pelletizing.

Preferably, temperatures of the first sintering and the second sintering are each independently 800° C. to 1200° C., for example, 850° C., 900° C., 1000° C., 1050° C., 1100° C. or 1150° C., etc.

Preferably, times of the first sintering and the second sintering are each independently 0.25 h to 24 h, for example, 0.5 h, 2 h, 10 h, 12 h, 18 h, 20 h or 22 h, etc.

Preferably, atmospheres of the first sintering, the second sintering, the third sintering and the heat treatment are each independently vacuum or a protective atmosphere.

Preferably, the second wet treatment and the deep deoxidization wet treatment each independently include: performing fourth slurrying on a product obtained after the second reduction or the deep deoxidization with water and/or an acid liquid to obtain a fourth slurry; performing fourth pH adjustment on the pH of the fourth slurry, and performing solid-liquid separation to obtain a fourth solid phase; and washing and drying the fourth solid phase to obtain a product.

Preferably, a pH of the acid liquid in the second wet treatment and the deep deoxidization wet treatment is each independently greater than or equal to 0.5, for example, 0.7, 0.9, 1.4, 1.5, 1.7 or 1.9, etc.

Preferably, a liquid-to-solid ratio of the fourth slurry in the second wet treatment and the deep deoxidization wet treatment is 1:1 mL/g to 100:1 mL/g, for example, 5:1 mL/g, 12:1 mL/g, 23:1 mL/g, 45:1 mL/g, 67:1 mL/g, 78:1 mL/g or 99:1 mL/g, etc.

Preferably, the acid used in the fourth pH adjustment in the second wet treatment and the deep deoxidization wet treatment is a hydrochloric acid.

Preferably, a pH of the slurry in the fourth pH adjustment in the second wet treatment and the deep deoxidization wet treatment is controlled to be greater than or equal to 0.8, for example, 0.9, 1.1, 1.6, 1.8, 2.3, 2.6 or 2.8, etc.

Preferably, a pH of the fourth slurry after the fourth pH adjustment in the second wet treatment and the deep deoxidization wet treatment is 1.5 to 3.0, for example, 1.7, 2, 2.2, 2.5, 2.7 or 2.9, etc.

As a preferred technical solution of the present disclosure, the method of preparing a titanium metal powder by reduction described in the first scheme includes the following steps:

performing a sintering treatment on the first reduced powder at 1000° C. to 1500° C. under vacuum or a protective atmosphere for 0.25 h to 24 h or performing an electromagnetic induction smelting treatment on the first reduced powder, and performing deep deoxidization with a deep deoxidizer and a deep deoxidization adjuvant to obtain a deep deoxidization product, wherein the first reduced powder is $TiO_x$, and x is $0.167 \leq x \leq 0.5$, and when the deep deoxidizer is magnesium, the deep deoxidization includes: performing the deep deoxidization at 650° C. to 900° C. under a hydrogen-argon mixed atmosphere or a pure hydrogen atmosphere for 0.25 h to 48 h to obtain the deep deoxidization product, wherein a mass ratio of the deep deoxidizer to the first reduced powder is 0.08:1 to 0.64:1, and a mass ratio of the deep deoxidization adjuvant to the first reduced powder is 0.05:1 to 3:1; or when the deep deoxidizer is calcium, the deep deoxidization includes: performing the deep deoxidization at 700° C. to 1100° C. under vacuum or a protective atmosphere for 0.25 h to 48 h to obtain the deep deoxidization product, wherein a mass ratio of the deep deoxidizer to the first reduced powder is 0.13:1 to 1:1, and a mass ratio of the deep deoxidization adjuvant to the first reduced powder is 0.05:1 to 3:1; and performing a deep deoxidization wet treatment on the deep deoxidization product to obtain a titanium metal powder.

As a preferred technical solution of the present disclosure, the method of preparing a titanium metal powder by reduction described in the second scheme includes the following steps:

performing second reduction on a first reduced powder with a second reductant and a second adjuvant at 650° C. to 900° C. under a protective atmosphere for 0.25 h to 48 h to obtain a second reduced material, wherein a mass ratio of the second reductant to the first reduced powder is 0.09:1 to 0.56:1, and a mass ratio of the second adjuvant to the first reduced powder is 0.05:1 to 3:1; and performing a second wet treatment on the second reduced material to obtain a second reduced powder having an oxygen content less than or equal to 2 wt %, wherein the second reductant includes magnesium;

performing a deep deoxidization on the second reduced powder with a deep deoxidizer and a deep deoxidization adjuvant to obtain a deep deoxidization product;

wherein when the deep deoxidizer is magnesium, the deep deoxidization includes: performing the deep deoxidization at 650° C. to 900° C. under a hydrogen-argon mixed atmosphere or a pure hydrogen atmosphere for 0.25 h to 48 h to obtain the deep deoxidization product, wherein a mass ratio of the deep deoxidizer to the second reduced powder is 0.03:1 to 0.2:1, and a mass ratio of the deep deoxidization adjuvant to the second reduced powder is 0.05:1 to 3:1; or when the deep deoxidizer is calcium, the deep deoxidization includes: performing the deep deoxidization at 700° C. to 1100° C. under vacuum or a protective atmosphere for 0.25 h to 48 h to obtain the deep deoxidization product, wherein a mass ratio of the deep deoxidizer to the second reduced powder is 0.05:1 to 0.4:1, and a mass ratio of the deep deoxidization adjuvant to the second reduced powder is 0.05:1 to 3:1; and performing a deep deoxidization wet treatment on the deep deoxidization product to obtain a titanium metal powder.

As a preferred technical solution of the present disclosure, the method of preparing a titanium metal powder by reduction described in the third scheme includes the following steps:

mixing a first reduced powder and a titanium metal powder partially returned to obtain a mixed material, wherein a mass ratio of the first reduced powder to the titanium metal powder mixed is 1:0.25 to 1:10; and performing first sintering on the mixed material at 800° C. to 1200° C. under vacuum or a protective atmosphere for 0.25 h to 24 h to obtain a titanium-oxygen solid solution having an oxygen content less than or equal to 8 wt %, wherein the first reduced powder is $TiO_x$, and x is $0.333 \leq x \leq 0.5$; and performing deep deoxidization and a deep deoxidization wet treatment on the titanium-oxygen solid solution to obtain a titanium metal powder;

wherein when the deep deoxidizer is magnesium, the deep deoxidization includes: performing the deep deoxidization at 650° C. to 900° C. under a hydrogen-argon mixed atmosphere or a pure hydrogen atmosphere for 0.25 h to 48 h to obtain a deep deoxidization product, wherein a mass ratio of the deep deoxidizer to the titanium-oxygen solid solution is 0.05:1 to 3:1, and a mass ratio of the deep deoxidization adjuvant to the titanium-oxygen solid solution is 0.05:1 to 3:1; or when the deep deoxidizer is calcium, the deep deoxidization includes: performing the deep deoxidization at 700° C. to 1100° C. under vacuum or a protective atmosphere for 0.25 h to 48 h to obtain a deep deoxidization product, wherein a mass ratio of the deep deoxidizer to the titanium-oxygen solid solution is 0.05:1 to 3:1, and a mass ratio of the deep deoxidization adjuvant to the titanium-oxygen solid solution is 0.05:1 to 3:1.

As a preferred technical solution of the present disclosure, the method of preparing a titanium metal powder by reduction described in the fourth scheme includes the following steps:

performing second reduction on titanium dioxide with a second reductant and a second adjuvant at 600° C. to 900° C. under a protective atmosphere for 0.25 h to 48 h to obtain a second reduced material, wherein a mass ratio of the second reductant to titanium dioxide is 2:1 to 4:1, and a mass ratio of the second adjuvant to titanium dioxide is 0.05:1 to 3:1; and performing a second wet treatment on the second reduced material to obtain a second reduced powder having an oxygen content less than or equal to 3 wt %, wherein the second reductant includes magnesium;

mixing the second reduced powder and a first reduced powder in a mass ratio of 1:0.267 to 1:10, and performing second sintering at 800° C. to 1200° C. under vacuum or a protective atmosphere for 0.25 h to 24 h to obtain a titanium-oxygen solid solution with oxygen content less than or equal to 8 wt %; and performing deep deoxidization and a deep deoxidization wet treatment on the titanium-oxygen solid solution to obtain a titanium metal powder;

wherein when the deep deoxidizer is magnesium, the deep deoxidization includes: performing the deep deoxidization at 650° C. to 900° C. under a hydrogen-argon mixed atmosphere or a pure hydrogen atmosphere for 0.25 h to 48 h to obtain a deep deoxidization product, wherein a mass ratio of the deep deoxidizer to the titanium-oxygen solid solution is 0.033:1 to 0.6:1, and a mass ratio of the deep deoxidization adjuvant to the titanium-oxygen solid solution is 0.05:1 to 3:1; or when the deep deoxidizer is calcium, the deep deoxidization includes: performing the deep deoxidization at 700° C. to 1100° C. under vacuum or a protective atmosphere for 0.25 h to 48 h to obtain a deep deoxidization product, wherein a mass ratio of the deep deoxidizer to the titanium-oxygen solid solution is 0.033:1 to 0.8:1, and a mass ratio of the deep deoxidization adjuvant to the titanium-oxygen solid solution is 0.05:1 to 3:1.

In a third aspect, the present disclosure provides a method of preparing a Ti6Al4V alloy powder. The preparation method includes the method of controllably reducing an oxygen content described in the first aspect.

Since both the vanadium-to-aluminum molar ratio and the oxygen content in the titanium oxide are controllable in the method of preparing a Ti6Al4V alloy powder provided in the third aspect of the present disclosure, the Ti6Al4V alloy powder can be directly prepared from the titanium dioxide and the vanadium oxide as raw materials without the preparation of sponge titanium and the melting process, shortening the overall process and reducing the preparation cost.

As a preferred technical solution of the third aspect of the present disclosure, the preparation method includes the following steps:

(1) performing first reduction on a mixture of a vanadium oxide and a calcium oxide with a first reductant and a first adjuvant to obtain a first reduced material, and performing a first wet treatment on the first reduced material to obtain a 6Al4V alloy powder, wherein a mass ratio of vanadium to aluminum in the 6Al4V alloy powder is (3.5 to 4.5):(5.5 to 6.75), and the first reductant includes aluminum; and performing third reduction on titanium dioxide with a third reductant to obtain a third reduced material, and performing a third wet treatment on the third reduced material to obtain a third reduced powder, wherein the third reduced powder is $TiO_x$, and x is less than or equal to 0.5; and (2) mixing the 6Al4V alloy powder and the third reduced powder, performing fourth sintering to obtain an oxygen-containing Ti6Al4V alloy powder, and performing second deoxidization and a fourth wet treatment on the oxygen-containing Ti6Al4V alloy powder to obtain a Ti6Al4V alloy powder.

The method of preparing a Ti6Al4V alloy powder provided by the present disclosure can directly prepare a Ti6Al4V alloy powder from titanium dioxide and a vanadium oxide, the process is short, and the raw material cost is low, thereby greatly reducing the production cost of the Ti6Al4V alloy powder.

In the present disclosure, by adding a calcium source and a reduction adjuvant during the process of reducing the vanadium oxide with aluminum, an aluminum oxide-rich phase obtained after the reduction which cannot be wet separated is changed into a phase which can be wet separated. In this manner, a vanadium-aluminum alloy can be prepared without the need of performing operations such as slag-metal separation, and the 6Al4V alloy powder can be obtained by separating substances of aluminum-calcium-oxygen phases and the 6Al4V alloy by a first wet treatment. Further, the 6Al4V alloy powder and a third reduced powder $TiO_x$ can be mixed to prepare the Ti6Al4V alloy powder, and the Ti6Al4V alloy powder having a low oxygen content can be obtained as a whole by only three reduction steps.

Preferably, a third adjuvant is added in the third reduction.

Preferably, a mass ratio of the third adjuvant to titanium dioxide is 0.05:1 to 3:1, for example, 0.06:1, 0.38:1, 1.37:1, 1.69:1, 2.68:1 or 2.8:1, etc.

Preferably, a time of the third reduction is 0.25 h to 24 h, for example, 0.5 h, 0.8 h, 6 h, 10 h, 12 h or 20 h, etc.

Preferably, an atmosphere of the third reduction is vacuum or a protective atmosphere.

Preferably, when the third reductant is aluminum, a molar ratio of the third reductant to titanium dioxide is 1:1 to 1.33:1, for example, 1.04:1, 1.08:1, 1.19:1, 1.22:1, 1.26:1 or 1.3:1, etc.

Preferably, when the third reductant is aluminum, a calcium oxide is added in the third reduction.

Preferably, when the third reductant is aluminum, a molar ratio of the calcium oxide to the third reductant is 0.6:1 to 2:1, for example, 0.8:1, 1:1, 1.3:1, 1.6:1 or 1.9:1, etc.

When aluminum is used as the third reductant in the present disclosure, the cost is lower than the cost when magnesium is used as the reductant, but an additional calcium oxide needs to be added to optimize the phase state of the by-product obtained after the reduction with aluminum so that the aluminum reduction by-product can be separated from the third reduced powder by a wet treatment. In this manner, the third reduced powder can be prepared without the need of performing operations such as slag-metal separation. In the present disclosure, the molar ratio of the calcium oxide to the third reductant is further preferably controlled to be within the preceding range to effectively ensure the reduction effect and avoid the formation of the insoluble aluminum phase.

Preferably, when the third reductant is aluminum, the third adjuvant includes any one or a combination of at least two of anhydrous $CaCl_2$, a $CaCl_2$—KCl eutectic salt, a $CaCl_2$—NaCl eutectic salt or a $CaCl_2$—$AlCl_3$ eutectic salt, and the typical but non-limiting combinations include a combination of anhydrous $CaCl_2$ and a $CaCl_2$—KCl eutectic salt.

Preferably, when the third reductant is aluminum, a temperature of the third reduction is 700° C. to 1400° C., for example, 800° C., 930° C., 1000° C., 1200° C., 1260° C. or 1330° C., etc.

Preferably, when the third reductant is magnesium, a molar ratio of the third reductant to titanium dioxide is 2:1 to 4:1, for example, 2.1:1, 2.9:1, 3.2:1, 3.6:1 or 3.8:1, etc.

Preferably, when the third reductant is magnesium, the third adjuvant includes any one or a combination of at least two of anhydrous $MgCl_2$, a $MgCl_2$—KCl eutectic salt, a $MgCl_2$—NaCl eutectic salt or a $MgCl_2$—$CaCl_2$ eutectic salt, and the typical but non-limiting combinations include a combination of anhydrous $MgCl_2$ and a $MgCl_2$—KCl eutectic salt.

Preferably, when the third reductant is magnesium, a temperature of the third reduction is 600° C. to 900° C., for example, 630° C., 660° C., 700° C., 760° C., 800° C. or 860° C., etc.

Preferably, the molar ratio of the first reductant to the vanadium oxide is [(2y+2)a+(2y+3.333)b]:(a+b), wherein a/(a+b) is the molar ratio of $V_2O_3$ in the vanadium oxide, b/(a+b) is the molar ratio of $V_2O_5$ in the vanadium oxide, and y is the molar ratio of aluminum to vanadium in the 6Al4V alloy powder.

Since the nominal compositions of Ti6Al4V require the mass content of Al to be 5.5% to 6.75% and the mass content of V to be 3.5% to 4.5%, the upper limit of the molar ratio of aluminum to vanadium in the 6Al4V alloy powder is 6.75/27/3.5*51=3.642, and the lower limit of the molar ratio of aluminum to vanadium is 5.5/27/4.5*51=2.309, that is, the value of y ranges from 2.309 to 3.642, for example, 2.04, 2.1, 2.5, 2.8, 3.0, 3.2 or 3.6, etc.

Further preferably, the mass ratio of aluminum to vanadium in the 6Al4V alloy powder is 1.5, that is, the value of y is preferably 2.833. At this point, the molar ratio of the second reductant to the vanadium oxide is preferably (7.666a+8.999b):(a+b).

Preferably, a temperature of the fourth sintering is 900° C. to 1400° C., for example, 950° C., 1010° C., 1060° C., 1120° C., 1280° C. or 1340° C., etc.

Preferably, a time of the fourth sintering is 0.25 h to 24 h, for example, 0.5 h, 1 h, 2 h, 3 h, 5 h, 12 h, 18 h or 20 h, etc.

Preferably, an atmosphere of the fourth reduction is vacuum or a protective atmosphere.

Preferably, a fourth adjuvant is added in the second deoxidization.

Preferably, the temperature, the time, the atmosphere, the second deoxidizer, the fourth adjuvant and the amount of the fourth adjuvant in the second deoxidization are each independently the same as the ranges of the temperature, the time, the atmosphere, the deep deoxidizer and the deep deoxidizer adjuvant in the deep deoxidization. For example, the mass ratio of the fourth adjuvant to the oxygen-containing Ti6Al4V alloy powder is 0.05:1 to 3:1, for example, 0.35:1, 0.75:1, 1.05:1, 1.35:1, 1.65:1, 2.65:1, etc. However, it does not mean that parameters of the second deoxidization and the deep deoxidization in the same scheme need to be kept consistent, the parameters of the second deoxidization and the deep deoxidization may just be selected within the same range, and different process parameters or substances can be selected for the second deoxidization and the deep deoxidization in the same scheme.

Preferably, when the second deoxidizer contains magnesium, a mass ratio of the oxygen-containing Ti6Al4V alloy powder to the second deoxidizer is 1:0.05 to 1:0.6, for example, 1:0.1, 1:0.2, 1:0.3, 1:0.4, 1:0.5 or 1:0.55, etc.

Preferably, when the second deoxidizer contains magnesium, a mass ratio of the oxygen-containing Ti6Al4V alloy powder to the second deoxidizer is 1:0.1 to 1:1, for example, 1:0.2, 1:0.3, 1:0.4, 1:0.5, 1:0.8 or 1:0.9, etc.

Preferably, the third wet treatment and the fourth wet treatment each independently include: performing fourth slurrying on a product obtained after the third reduction or the second deoxidization with water and/or an acid liquid to obtain a fourth slurry; performing fourth pH adjustment on the pH of the fourth slurry, and performing solid-liquid separation to obtain a fourth solid phase; and washing and drying the fourth solid phase to obtain a product.

Preferably, the process parameters of the third wet treatment and the fourth wet treatment are each independently the same as the process parameters of the second wet treatment. However, it does not mean that the parameters of steps of different wet treatments in the same scheme need to be kept consistent, the parameters of steps of different wet treatments may just be selected within the same range, and different process parameters or substances can be selected in the same scheme.

As a preferred technical solution of the present disclosure, the preparation method includes the following steps:

(1") mixing a vanadium oxide, a calcium oxide, aluminum and a first adjuvant, wherein a molar ratio of aluminum to the vanadium oxide is [(2y+2)a+(2y+3.333)b]:(a+b), a/(a+b) is the molar ratio of $V_2O_3$ in the vanadium oxide, b/(a+b) is the molar ratio of $V_2O_5$ in the vanadium oxide, and y is the molar ratio of aluminum to vanadium in the 6Al4V alloy powder, a molar ratio of the calcium oxide to aluminum is 0.6:1 to 2:1, and a mass ratio of the first adjuvant to the vanadium oxide is 0.05:1 to 3:1; performing first reduction on the resulting mixture at 700° C. to 1400° C. under vacuum or a protective atmosphere for 0.25 h to 24 h to obtain a first reduced material; performing a first wet treatment on the first reduced material to obtain a 6Al4V alloy powder, wherein a molar ratio of vanadium and aluminum in 6Al4V alloy powder is (3.5 to 4.5):(5.5 to 6.75); and performing third reduction on titanium dioxide with a third reductant to obtain a third reduced material, and performing a third wet treatment on the third reduced material to obtain a third reduced powder, wherein the third reduced powder is $TiO_x$, x is less than or equal to 0.5, and when the third reductant is magnesium, the third reduction includes: performing the third reduction at 600° C. to 900° C. for 0.25 h to 24 h to obtain a product after the third reduction, wherein a mass ratio of the third reductant to titanium dioxide is 2:1 to 4:1, and a mass ratio of the third adjuvant to titanium dioxide is 0.05:1 to 3:1; or when the third reductant is aluminum, the third reduction includes: performing the third reduction at 700° C. to 1400° C. for 0.25 h to 24 h to obtain a product after the third reduction, where a calcium oxide is added in the third reduction, a mass ratio of the calcium oxide to the third reductant is 0.6:1 to 2:1, a mass ratio of the third reductant to titanium dioxide is 1:1 to 1.33:1, and a mass ratio of the third adjuvant to titanium dioxide is 0.05:1 to 3:1; and (2") mixing the 6Al4V alloy powder and the third reduced powder, crushing and pelletizing the resulting mixture, performing fourth sintering at 900° C. to 1400° C. under vacuum or a protective atmosphere for 0.25 h to 24 h to obtain an oxygen-containing Ti6Al4V alloy powder, performing second deoxidization on the oxygen-containing Ti6Al4V alloy powder to obtain a product after the second deoxidization, and performing a fourth wet treatment on the product after the second deoxidization to obtain a Ti6Al4V alloy powder;

when the second deoxidizer is magnesium, the second deoxidization includes: performing the second deoxidization at 650° C. to 900° C. under a hydrogen-argon mixed atmosphere or a pure hydrogen atmosphere for 0.25 h to 48 h to obtain a product after the second deoxidization, wherein a mass ratio of the oxygen-containing Ti6Al4V alloy powder to the second deoxidizer is 1:0.05 to 1:0.6, and a mass ratio of the fourth adjuvant to the Ti6Al4V alloy powder is 0.05:1 to 3:1; or when the second deoxidizer is calcium, the second deoxidization includes: performing the second deoxidization at 700° C. to 1100° C. under vacuum or a protective atmosphere for 0.25 h to 48 h to obtain a product after the second deoxidization, wherein a mass ratio of the oxygen-containing Ti6Al4V alloy powder to the second deoxidizer is 1:0.1 to 1:1, and a mass ratio of the fourth adjuvant to the Ti6Al4V alloy powder is 0.05:1 to 3:1.

The solid-liquid separation in the preceding process is not particularly limited in the present disclosure. Any equipment and means of solid-liquid separation known to those skilled in the art may be employed, adjustment may be performed according to the actual process, such as filtration, centrifugation or sedimentation separation, or combinations of different means may be employed.

A temperature of the washing in each step in the present disclosure is each independently 0° C. to 60° C., for example, 1° C., 10° C., 20° C., 30° C., 40° C., 50° C. or 55° C., etc.

A temperature of the drying in each step in the present disclosure is each independently less than or equal to 60° C., for example, 58° C., 50° C., 40° C., 30° C. or 20° C., etc. A manner of the drying in the present disclosure is one of ambient drying, vacuum drying or freeze drying at not more than 60° C., and with the control of the temperature of the drying, the surface of the titanium powder or vanadium-aluminum alloy can be effectively prevented from being over oxidized, thereby facilitating the control of the oxygen content level of the powder.

Unless otherwise specified, the reduction, the protective atmosphere of the sintering, heat treatment or deoxidization in each step of the present disclosure, i.e., the protective atmosphere of the first reduction, deep deoxidization, third reduction, first sintering, second sintering, third sintering, heat treatment, fourth sintering, first deoxidization and second deoxidization, each independently includes any one or a combination of at least two of hydrogen, argon or helium, and the typical but non-limiting combinations include a combination of argon and hydrogen, a combination of argon and helium, a combination of hydrogen and helium, and a combination of argon, hydrogen and helium. The shape of the reductant or deoxidizer in each step in the present disclosure includes any one or a combination of at least two of a powdery shape, a fragmental shape or a granular shape, and the typical but non-limiting combinations include a combination of a powdery shape and a fragmental shape, a combination of a granular shape and a fragmental shape, and a combination of a powdery shape and a granular shape.

Examples of point values in the present disclosure are not limited to the values enumerated above, and other values not enumerated within the defined ranges are also applicable.

Compared with the prior art, the present disclosure at least has the following beneficial effects.

(1) The method of preparing a low-valent titanium oxide compound $TiO_x$ having a controllable oxygen content provided in the present disclosure uses aluminum as the reductant and thus significantly reduces the cost of the reductant compared with the method using a magnesium reductant. For example, the cost of the reductant can be reduced by up to 62.5%. The temperature of the reduction reaction system is lower than that in the self-propagating reduction method, the requirements for equipment are lowered, and the controllability of the oxygen content of the final product is significantly improved. For example, the mean square deviation of the value of x of five replicates within the preferable range is in the range of 0.0084, and the range of x is less than or equal to 0.03. The process of the method is simple and controllable, and the method has broad application prospects.

(2) The method of preparing a vanadium-aluminum alloy having a controllable vanadium-aluminum molar ratio provided by the present disclosure can accurately regulate and control the Al/V molar ratio within a large range of 0.2 to 5.8, has broad application prospects, and has high stability. For example, the standard deviation of five replicates is less than or equal to 0.0062. Moreover, by adding a calcium oxide and a reduction adjuvant during the aluminothermic reduction, the reduction by-product can be controlled to be a phase which can be wet separated, and the vanadium-aluminum alloy can be obtained by simple one-step reduction and one-step wet treatment, thereby avoiding the complex high-temperature slag-metal separation process, reducing the cost, and improving the alloy purity. For example, the alloy purity is higher than or equal to 99.5 wt % under preferable conditions.

(3) In the method of preparing a titanium metal powder by reduction provided by the present disclosure, the $TiO_2$ raw material is preliminarily reduced with metal aluminum before subsequent treatments are performed, the cost of the reductant required for removing part of oxygen with aluminum can be reduced by more than 60% compared with the cost in the full-magnesium reduction process of titanium dioxide, and the oxygen content in the prepared titanium powder can be ensured to be low. For example, the oxygen content is lower than 0.3 wt % and is less than 0.1 wt % in preferable conditions.

(4) In the method of preparing a Ti6Al4V alloy powder provided by the present disclosure, with a calcium oxide added during the process of aluminothermic reduction of the vanadium oxide, the reduction by-product can be controlled to be a phase which can be wet separated, and the 6Al4V alloy powder can be obtained by simple one-step reduction and one-step wet treatment. The Ti6Al4V alloy powder can be prepared from the titanium dioxide and the vanadium oxide as raw materials without the preparation of sponge titanium and the melting process, thereby shortening the overall process and reducing the preparation cost. The obtained Ti6Al4V alloy powder is high in purity, low in oxygen content and excellent in performance. For example, the Ti6Al4V alloy powder having a purity of 99.8 wt % and above can be obtained in preferable conditions, whose oxygen content is less than or equal to 0.1 wt % and whose particle size range can be effectively controlled.

DETAILED DESCRIPTION

Figure 1:
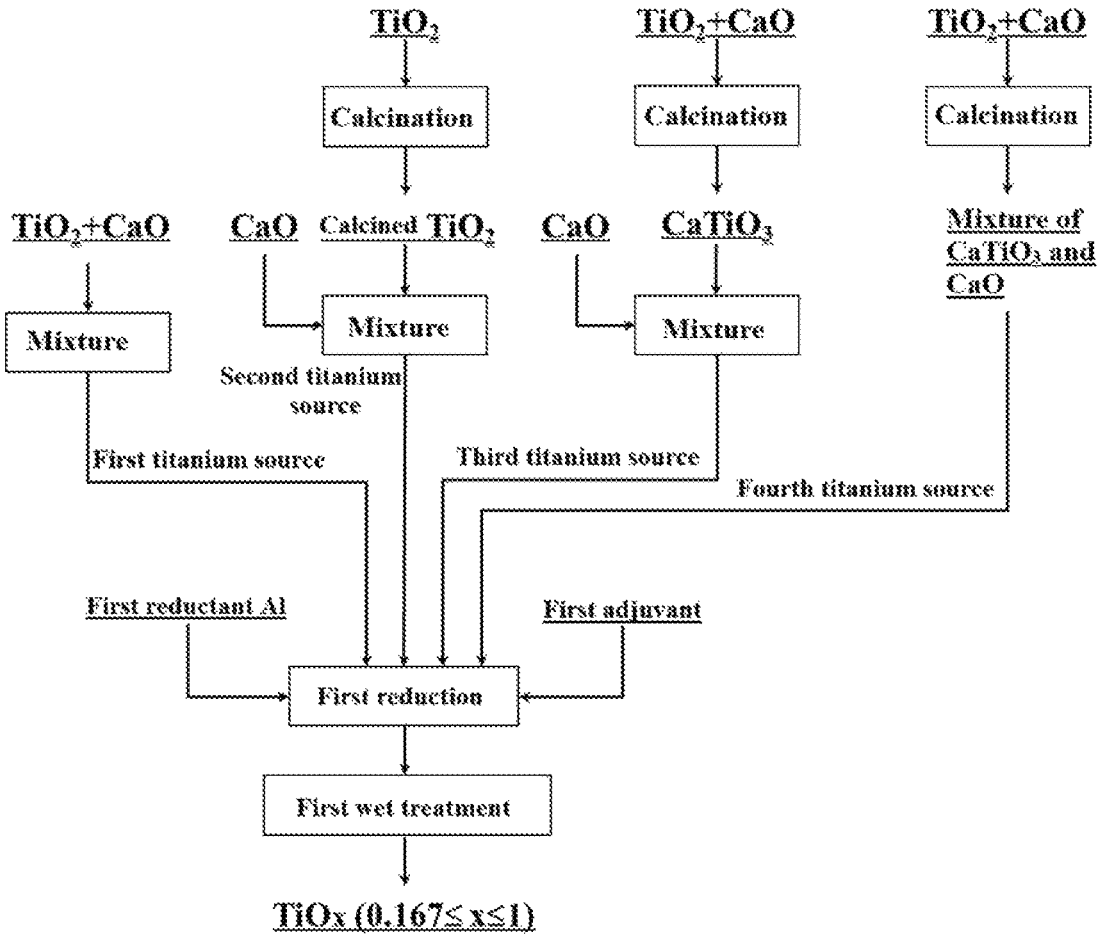
FIG. 1 is a flowchart of a method of preparing a low-valent titanium oxide compound $TiO_x$ having a controllable oxygen content according to embodiment one of the present disclosure.

Technical solutions of the present disclosure are further described hereinafter in conjunction with the drawings and the embodiments.

The present disclosure is further described in detail below. Embodiments set forth below are merely simple examples of the present disclosure and are not intended to represent or limit the protection scope of the present disclosure. The protection scope of the present disclosure is defined by the claims.

The first wet treatment performed after the first reduction treatment in the following Examples and Comparative Examples may be replaced as follows: performing first slurrying on the reduced material with water to obtain a first slurry, wherein a liquid-to-solid ratio of the first slurrying is 2:1 mL/g to 20:1 mL/g; performing first pH adjustment with a hydrochloric acid to adjust a pH of the first slurry to 5.0 to 6.0, and performing solid-liquid separation to obtain a first liquid phase solution and a first solid phase; mixing $(NH_4)_2CO_3$ and the first liquid phase solution or mixing $NH_4HCO_3$, ammonia and the first liquid phase solution, performing a reaction, and performing solid-liquid separation after the reaction to obtain a $CaCO_3$ solid and a $NH_4Cl$ solution, wherein the $CaCO_3$ solid is returned and used in first reduction as a calcium source; performing second slurrying on the first solid phase with water and/or an acid liquid to obtain a second slurry; performing second pH adjustment with a hydrochloric acid to adjust a pH of the second slurry to 1.0 to 3.0, and performing solid-liquid separation to obtain a second liquid phase and a second solid phase, wherein the second liquid phase is a mixed solution of $AlCl_3$—$CaCl_2$, and the mixed solution of $AlCl_3$—$CaCl_2$ is used for preparing a polyaluminium chloride product; and washing the second solid phase at 0° C. to 60° C., and drying the second solid phase at a temperature less than or equal to 60° C. to obtain a first reduced powder. Any regulation and control of each of the preceding process parameters can achieve the preparation of the first reduced powder. To save space, the details are not repeated here. With the replacement by the preceding process flow, the calcium resources can be recycled.

The test methods are as follows: in the following Examples and Comparative Examples, the value of x in the $TiO_x$ intermediate powder is measured by a difference method and X-ray diffraction analysis after the contents of other elements are measured by inductively coupled plasma atomic emission spectroscopy, the oxygen content of the final titanium metal powder is measured by an ONH analyzer, and the cost of the reductant consumed per ton of titanium metal powder is calculated based on the market average price of magnesium at 40000 CNY per ton, aluminum at 20000 CNY per ton, and calcium at 45000 CNY per ton. The oxygen content of the Ti6Al4V alloy powder is measured by an ONH analyzer, the purity of the Ti6Al4V alloy powder is measured by an ICP-OES analyzer, the particle size of the Ti6Al4V alloy powder is measured by a particle size distribution analyzer, and the contents of elements in the first reduced powder $TiO_x$ and the 6Al4V alloy powder are measured by ICP-OES and EDS methods.

Embodiment one: A method of preparing a low-valent titanium oxide compound $TiO_x$ having a controllable oxygen content is provided. As shown in FIG. 1, the preparation method includes the following steps.

(1) A raw material, a calcium source, a first reductant and a first adjuvant are mixed, and first reduction is performed on the resulting mixture to obtain a reduced material; wherein the raw material is a vanadium oxide or a titanium source; the first reductant includes aluminum; the mixing includes: performing first mixing on the titanium source and the calcium source to obtain a calcium-containing titanium source, and performing second mixing on the calcium-containing titanium source, the first reductant and the first adjuvant; the calcium-containing titanium source includes any one or a combination of at least two of a first titanium source, a second titanium source, a third titanium source or a fourth titanium source; the first titanium source is a mixture of titanium dioxide and a calcium oxide; the second titanium source is a mixture of a calcium oxide and calcined titanium dioxide; the third titanium source is a mixture of a calcium oxide and a calcined product obtained after the calcination of a calcium oxide and titanium dioxide mixed based on $CaTiO_3$; the fourth titanium source is a mixture of a calcium oxide and titanium dioxide which are weighted in a ratio exceeding the ratio based on $CaTiO_3$, mixed and calcined.

(2) A first wet treatment is performed on the reduced material to obtain a first reduced powder, wherein the first reduced powder is $TiO_x$, and the value of x in $TiO_x$ is $0.167 \leq x \leq 1$.

Example A1

This example provides a method of preparing a low-valent titanium oxide compound $TiO_x$ having a controllable oxygen content. The preparation method includes the following steps.

(1) A calcium-containing titanium source (a mixture of titanium dioxide and a calcium oxide), an aluminum powder and a $CaCl_2$—NaCl eutectic salt were mixed, and reduction was performed on the resulting mixture at 1200° C. under an argon atmosphere for 2 h to obtain a first reduced material.

(2) Third slurrying was performed on the reduced material with water to obtain a third slurry, wherein the liquid-to-solid ratio of the third slurrying was 50:1 mL/g; third pH adjustment was performed on the pH of the third slurry with a hydrochloric acid until the pH of the third slurry was adjusted to 2.0, wherein the pH of the third slurry was controlled to be greater than or equal to 0.8 during the third pH adjustment; the third slurry was filtered to obtain a solid phase; and the solid phase was washed at 25° C. with water and dried at 55° C. to obtain $TiO_x$.

The value of x in $TiO_x$ may be controlled to be $0.167 \leq x \leq 1$ according to the amounts of the calcium oxide, aluminum powder and $CaCl_2$—NaCl eutectic salt added.

The specific amounts of the calcium oxide, aluminum powder and $CaCl_2$—NaCl eutectic salt added in this example, the corresponding final value of x, and experimental results are shown in Table 1.

TABLE 1

| | Molar ratio of calcium in the titanium source to the first reductant | Molar ratio of aluminum powder to titanium in the titanium source | Mass ratio of the first adjuvant to titanium in the titanium source based on $TiO_2$ | Value of x | Note |
|---|---|---|---|---|---|
| Example A1-1 | 0.6:1 | 0.67:1 | 1.5:1 | 0.99 | |
| Example A1-2 | 1.0:1 | 1.11:1 | 1.5:1 | 0.51 | |
| Example A1-3 | 2.0:1 | 1.11:1 | 1.5:1 | 0.50 | |
| Example A1-4 | 1.0:1 | 1.22:1 | 1.5:1 | 0.33 | |
| Example A1-5 | 1.5:1 | 1.33:1 | 1.5:1 | 0.167 | |
| Example A1-6 | 0.4:1 | 0.67:1 | 1.5:1 | / | Weak acid-insoluble by-products are generated. |
| Example A1-7 | 3.0:1 | 1.11:1 | 1.5:1 | 0.51 | Excess CaO is ineffectively consumed. |
| Example A1-8 | 1.0:1 | 0.3:1 | 1.5:1 | 1.86 | |
| Example A1-9 | 1.0:1 | 1.8:1 | 1.5:1 | / | $Ti_3Al$ as the main phase, with a small amount of $Ti_6O$. |

Example A2

This example provides a method of preparing a low-valent titanium oxide compound $TiO_x$ having a controllable oxygen content. The preparation method includes the following steps.

(1) A calcium-containing titanium source (a mixture of a calcium oxide and titanium dioxide which was calcined at 1300° C. for 3 h), an aluminum powder and a $CaCl_2$—NaCl eutectic salt were mixed, and reduction was performed on the resulting mixture at 700° C. under vacuum (with an absolute vacuum degree of 80 kPa) for 24 h to obtain a first reduced material.

(2) Third slurrying was performed on the first reduced material with a hydrochloric acid whose pH was 1.2 to obtain a third slurry, wherein the liquid-to-solid ratio of the third slurrying was 10:1 mL/g; third pH adjustment was performed on the pH of the third slurry with a hydrochloric acid until the pH of the third slurry was adjusted to 2.0, wherein the pH of the third slurry was controlled to be greater than or equal to 0.8 during the third pH adjustment; the third slurry was filtered to obtain a solid phase; and the solid phase was washed at 25° C. with water and dried at 60° C. to obtain $TiO_x$.

The value of x in $TiO_x$ may be controlled to be $0.167 \leq x \leq 1$ according to the amounts of the calcium oxide, aluminum powder and $CaCl_2$—NaCl eutectic salt as the first adjuvant added.

The specific amounts of the calcium oxide, aluminum powder and $CaCl_2$—NaCl eutectic salt added in this example and the corresponding final value of x are shown in Table 2.

TABLE 2

| | Molar ratio of calcium in the titanium source to the first reductant | Molar ratio of aluminum powder to titanium in the titanium source | Mass ratio of the first adjuvant to titanium in the titanium source based on $TiO_2$ | Value of x |
|---|---|---|---|---|
| Example A2-1 | 1.5:1 | 0.67:1 | 2.0:1 | 1.0 |
| Example A2-2 | 1.5:1 | 0.9:1 | 2.0:1 | 0.67 |
| Example A2-3 | 1.5:1 | 1.11:1 | 2.0:1 | 0.49 |

Example A3

This example provides a method of preparing a low-valent titanium oxide compound $TiO_x$ having a controllable oxygen content. The preparation method includes the following steps.

(1) A calcium-containing titanium source (a product obtained after a calcium oxide and titanium dioxide which were weighted in a ratio exceeding the stoichiometric ratio based on $CaTiO_3$, mixed and calcined at 1200° C. for 8 h), an aluminum powder and a $CaCl_2$—KCl eutectic salt were mixed, and reduction was performed on the resulting mixture at 1000° C. under a hydrogen-argon mixed atmosphere (where the volume ratio of hydrogen to argon was 1:1) for 8 h to obtain a first reduced material.

(2) Third slurrying was performed on the first reduced material with a hydrochloric acid whose pH was 1.0 to obtain a third slurry, wherein the liquid-to-solid ratio of the third slurrying was 5:1 mL/g; third pH adjustment was performed on the pH of the third slurry with a hydrochloric acid until the pH of the third slurry was adjusted to 2.5, wherein the pH of the third slurry was controlled to be greater than or equal to 0.8 during the third pH adjustment; the third slurry was filtered to obtain a solid phase; and the solid phase was washed at 0° C. with water and dried at 45° C. to obtain $TiO_x$.

The value of x in $TiO_x$ may be controlled to be $0.167 \leq x \leq 1$ according to the amounts of the calcium oxide, aluminum powder and $CaCl_2$—KCl eutectic salt as the first adjuvant added.

The specific amounts of the calcium oxide, aluminum powder and $CaCl_2$—KCl eutectic salt added in this example and the corresponding final value of x are shown in Table 3.

TABLE 3

| | Molar ratio of calcium in the titanium source to the first reductant | Molar ratio of aluminum powder to titanium in the titanium source | Mass ratio of the first adjuvant to titanium in the titanium source based on $TiO_2$ | Value of x | Note |
|---|---|---|---|---|---|
| Example A3-1 | 1.0:1 | 0.9:1 | 3.0:1 | 0.67 | |
| Example A3-2 | 1.0:1 | 1.17:1 | 3.0:1 | 0.40 | |
| Example A3-3 | 1.0:1 | 1.28:1 | 3.0:1 | 0.22 | |
| Example A3-4 | 1.0:1 | 2.33:1 | 2.5:1 | / | $Ti_3Al$ and TiAl phases are generated. |

Example A4

The preparation method of this example is the same as the preparation method of Example A1 except that the first adjuvant was replaced with NaCl, and the results are shown in Table 4.

TABLE 4

| | Molar ratio of calcium in the titanium source to the first reductant | Molar ratio of aluminum powder to titanium in the titanium source | Mass ratio of the first adjuvant to titanium in thetitanium source based on $TiO_2$ | Value of x |
|---|---|---|---|---|
| Example A4-1 | 0.6:1 | 0.67:1 | 1.5:1 | 1.19 |
| Example A4-2 | 1.0:1 | 1.11:1 | 1.5:1 | 0.64 |
| Example A4-3 | 2.0:1 | 1.11:1 | 1.5:1 | 0.68 |
| Example A4-4 | 1.0:1 | 1.22:1 | 1.5:1 | 0.42 |
| Example A4-5 | 1.5:1 | 1.33:1 | 1.5:1 | 0.19 |

Comparative Example A1

The preparation method of this comparative example is the same as the preparation method of Example A1 except that the aluminum powder was replaced with an equal molar ratio of a magnesium powder, and the results are shown in Table 5.

TABLE 5

| | Molar ratio of calcium in the titanium source to the first reductant | Molar ratio of magnesium powder to titanium in the titanium source | Mass ratio of the first adjuvant to titanium in the titanium source based on $TiO_2$ | Note |
|---|---|---|---|---|
| Comparative Example A1-1 | 0.6:1 | 0.67:1 | 1.5:1 | When Mg is used as the reductant, the CaO additive has no effect in the system and is an ineffective additive, and a |
| Comparative Example A1-2 | 1.0:1 | 1.11:1 | 1.5:1 | |
| Comparative Example A1-3 | 2.0:1 | 1.11:1 | 1.5:1 | |
| Comparative Example A1-4 | 1.5:1 | 1.33:1 | 1.5:1 | |

TABLE 5-continued

| | Molar ratio of calcium in the titanium source to the first reductant | Molar ratio of magnesium powder to titanium in the titanium source | Mass ratio of the first adjuvant to titanium in the titanium source based on $TiO_2$ | Note |
|---|---|---|---|---|
| Comparative Example A1-5 | 1.0 | 1.22:1 | 1.5:1 | composite material of MgO and low-valent titanium oxide is generated. |

Comparative Example A2

The preparation method of this comparative example is the same as the preparation method of Example A2 except that the titanium source did not contain calcium, and the results are shown in Table 6.

TABLE 6

| | Molar ratio of aluminum powder to titanium in the titanium source | Mass ratio of the first adjuvant to titanium in the titanium source based on $TiO_2$ | Note |
|---|---|---|---|
| Comparative Example A2-1 | 0.67:1 | 2.0:1 | The reduction by-products cannot be effectively separated from TiOx by wet separation. |
| Comparative Example A2-2 | 0.9:1 | 2.0:1 | |
| Comparative Example A2-3 | 1.11:1 | 2.0:1 | |

Comparative Example A3

This comparative example provides a method of preparing a low-valent titanium oxide compound $TiO_x$ having a controllable oxygen content. The preparation method is performed by a self-propagating method. The specific method includes: $TiO_2$, a reductant Al powder, a combustion improver $KClO_4$ and an adjuvant CaO were thoroughly mixed in a certain ratio for half an hour and then placed in a stainless steel cup (where $Al/TiO_2=1.33$); the steel cup was placed in a high-pressure vessel filled with argon, and a self-propagating reaction was triggered by a nickel-chromium filament on the upper surface of the cup; a large amount of heat was rapidly released from the reaction to cause a sharp increase in the system temperature, the reaction product was melted, and slag and metal titanium were automatically separated to finally obtain a $TiO_x$ titanium oxide compound ingot with x equal to 0.35.

Taking the methods of Example A1-1, Example A1-4, Example A1-5, Example A1-7, Example A1-8, Example A4-2, Example A5-1 and Comparative Example A3 as examples, the stability of the components of the products obtained in different methods was detected, that is, each method was repeated five times, and the value of x in the final product was calculated according to the oxygen content in the low-valent titanium oxide compound $TiO_x$ product. The results are shown in Table 7.

TABLE 7

| | First time x | Second time x | Third time x | Fourth time x | Fifth time x | Average | Mean square deviation | Range |
|---|---|---|---|---|---|---|---|---|
| Example A1-1 | 0.99 | 0.99 | 1.01 | 1.0 | 1.0 | 0.998 | 0.0084 | 0.02 |
| Example A1-4 | 0.33 | 0.34 | 0.33 | 0.33 | 0.32 | 0.33 | 0.0071 | 0.02 |
| Example A1-5 | 0.167 | 0.17 | 0.16 | 0.167 | 0.17 | 0.167 | 0.0041 | 0.01 |
| Example A1-7 | 0.51 | 0.50 | 0.51 | 0.49 | 0.51 | 0.504 | 0.0089 | 0.02 |
| Example A1-8 | 1.86 | 1.84 | 1.87 | 1.86 | 1.85 | 1.856 | 0.0114 | 0.03 |
| Example A4-2 | 0.40 | 0.39 | 0.40 | 0.41 | 0.41 | 0.402 | 0.0084 | 0.02 |
| Example A5-1 | 1.19 | 1.17 | 1.21 | 1.23 | 1.19 | 1.198 | 0.0228 | 0.06 |
| Comparative Example A3 | 0.35 | 0.38 | 0.40 | 0.32 | 0.35 | 0.36 | 0.0308 | 0.08 |

In Tables 1 to 7, "/" indicates that there is no related data.

The following conclusions can be drawn from Tables 1 to 7.

(1) As can be seen from Examples A1 to A3, the method of preparing a low-valent titanium oxide compound $TiO_x$ having a controllable oxygen content provided by the present disclosure can better control the oxygen content of the first reduced powder, that is, the oxygen content of the low-valent titanium oxide compound $TiO_x$. Within the preferable range, the mean square deviation of multiple replicates is in the range of 0.0084, and the range of x is less than or equal to 0.03. Furthermore, the x can be effectively controlled between 0.167 and 1 according to $Al+TiO_2 \rightarrow TiO_x+Al_2O_3$, thereby achieving the accurate control of the oxygen content in the low-valent titanium oxide.

(2) As can be seen from Example A1-1 and Example A5-1, in a case where the $CaCl_2$—NaCl eutectic salt is used as the first adjuvant in Example A1-1 and NaCl is used as the first adjuvant in Example A5-1, with the same ratio, the value of x in Example A1-1 is only 0.99; in Example A5-1, the value of x is as high as 1.19, the mean square deviation is as high as 0.0228, and the range is as high as 0.06, indicating that the control effect on the oxygen content is reduced. Therefore, in the present disclosure, by preferably selecting the first adjuvant containing calcium, the reduction can be better promoted, thereby improving the reduction effect and the control effect on the oxygen content.

(3) As can be seen from Example A1 and Comparative Example A1, Example A1 uses aluminum to perform reduction, and with the same amount of the first reduced agent added, the value x in Example A1-5 can be as low as 0.167; Comparative Example A1 uses magnesium to perform reduction, a composite material of MgO and low-valent titanium oxide was generated, and the titanium oxide compound $TiO_x$ cannot be obtained. Therefore, in the present disclosure, by preferably selecting aluminum to perform reduction, the value of x in $TiO_x$ can be better controlled, and the wet separation can be more easily performed.

(4) As can be seen from Example A1, Comparative Example A2 and Comparative Example A3, the reduction with aluminum is performed under the condition of adding a calcium oxide in Example A1, no calcium oxide is added in Comparative Example A2, and reduction is performed by self-propagating in Comparative Example A3; by comparison, the reduced product in Example A1 can be separated by wet method, thereby achieving the accurate control of the oxygen content, with the mean square deviation of only 0.0084 and the ranged of only 0.02; although a reduction method similar to the reduction method of Example A1 is adopted, the wet separation cannot be performed in Comparative Example A2; the slag-metal separation is performed in Comparative Example A3 after self-propagating, the oxygen content is difficult to control, the mean square deviation of five replicates is as high as 0.0308, and the range is as high as 0.08. Therefore, in the present disclosure, under the action of the calcium-containing substance and the first adjuvant, the by-product $Al_2O_3$ obtained during the process of reducing $TiO_2$ with aluminum can be converted into a calcium-aluminum-containing compound which is easy to dissolve by a wet method, and the low-valent titanium oxide can be obtained by wet separation, thereby enabling the oxygen content to be more controllable and significantly reducing the cost of the first reductant.

Figure 2:
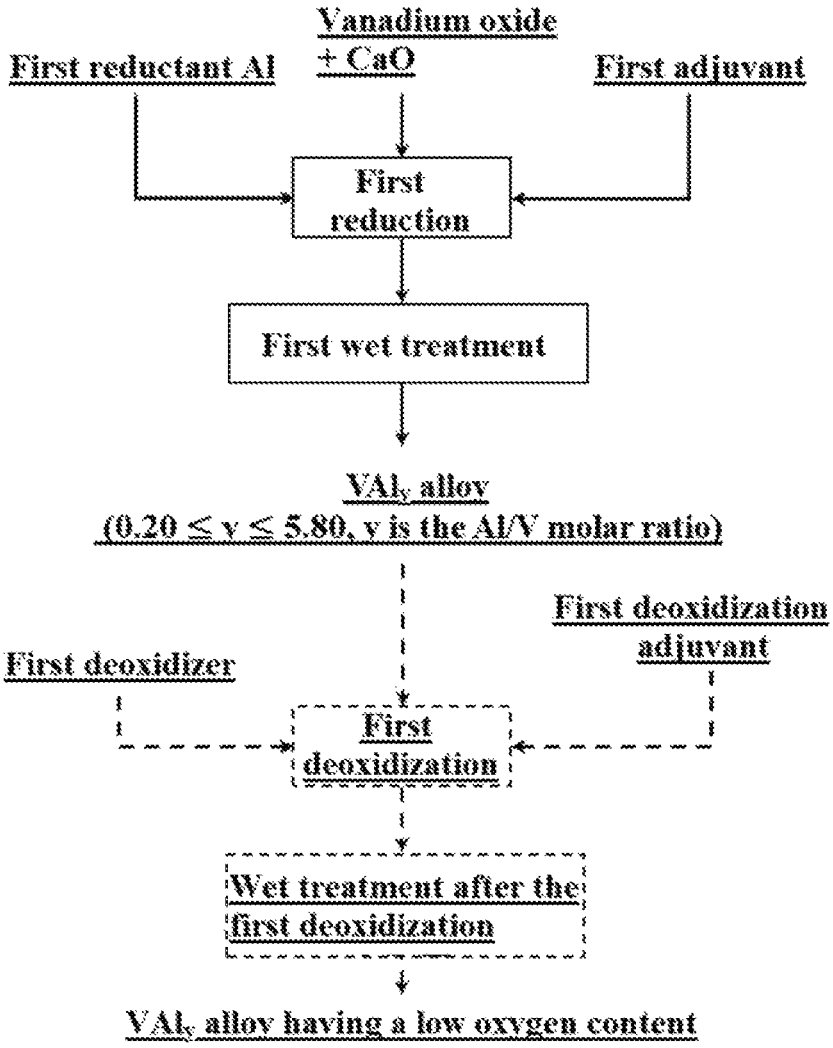
FIG. 2 is a flowchart of a method of preparing a vanadium-aluminum alloy having a controllable vanadium-aluminum molar ratio according to embodiment two of the present disclosure.

Embodiment two: The present disclosure provides a method of preparing a vanadium-aluminum alloy having a controllable vanadium-aluminum molar ratio. As shown in FIG. 2, the preparation method includes the following steps.

(1) A vanadium oxide, a calcium source, a first reductant and a first adjuvant are mixed, and first reduction is performed on the resulting mixture to obtain a reduced material, wherein the first reductant includes aluminum.

(2) A first wet treatment is performed on the reduced material to obtain a first reduced powder, wherein the first reduced powder is a $VAl_y$ alloy, and the value of y is $0.20 \leq y \leq 5.80$.

Optionally, the preparation method further includes the following steps: (3) first deoxidization is performed on the $VAl_y$ alloy with a first deoxidizer and a first deoxidization adjuvant to obtain a first deoxidized material, wherein the first deoxidizer includes calcium; and (4) a wet treatment is performed on the first deoxidized material after the first deoxidization to obtain a $VAl_y$ alloy having a low oxygen content.

Example B1

This example provides a method of preparing a vanadium-aluminum alloy having a controllable vanadium-aluminum molar ratio. The preparation method includes the following steps.

(1) A vanadium oxide, a CaO powder, an Al powder and a $CaCl_2$—NaCl eutectic salt were mixed, wherein the molar ratio of the Al powder to the vanadium oxide was (2ay+2by+10b/3+2a):(a+b), y was the value of y in the $VAl_y$ alloy, a/(a+b) was the molar ratio of $V_2O_3$ in the vanadium oxide, b/(a+b) was the molar ratio of $V_2O_5$ in the vanadium oxide; and first reduction was performed on the resulting mixture at 1300° C. under vacuum or a protective atmosphere (whether the atmosphere was vacuum or a protective atmosphere did not affect the result) for 10 h to obtain a first reduced material.

(2) Third slurrying was performed on the first reduced material with a hydrochloric acid liquid whose pH was 1.5 to obtain a third slurry; third pH adjustment was performed on the pH of the third slurry, wherein the pH of the third slurry was controlled to be greater than or equal to 0.8 during the third pH adjustment, and the pH of the third slurry after the third pH adjustment was stabilized to 2.2; the third slurry was filtered to obtain a solid phase; and the solid phase was washed at 45° C. with water and dried at 55° C. under vacuum to obtain a $VAl_y$ alloy, wherein the value of y was greater than or equal to 0.20 and less than or equal to 5.80.

The specific molar ratio b:a of $V_2O_5$ to $V_2O_3$ in the vanadium oxide, the specific amounts of the calcium oxide, aluminum powder and $CaCl_2$—NaCl eutectic salt added in this example and the corresponding final value of y are shown in Table 8.

TABLE 8

| | a | b | Molar ratio of Al to vanadium oxide | Molar ratio of CaO to Al | Mass ratio of $CaCl_2$—NaCl eutectic salt to vanadium oxide | Value of y | $VAl_y$ alloy oxygen content wt % | $VAl_y$ alloy purity (wt %) |
|---|---|---|---|---|---|---|---|---|
| Example B1-1 | 0 | 1 | 3.74:1 | 1.0:1 | 1.5:1 | 0.2 | 0.23 | 99.9 |
| Example B1-2 | 0.5 | 1 | 8.83:1.5 | 1.0:1 | 0.6:1 | 1.5 | 0.18 | 99.5 |
| Example B1-3 | 1 | 1 | 13.3:2 | 1.0:1 | 1.5:1 | 2 | 0.15 | 99.9 |
| Example B1-4 | 2 | 1 | 31.3:3 | 0.6:1 | 2.0:1 | 4 | 0.12 | 99.8 |

TABLE 8-continued

| | a | b | Molar ratio of Al to vanadium oxide | Molar ratio of CaO to Al | Mass ratio of $CaCl_2$—NaCl eutectic salt to vanadium oxide | Value of y | $VAl_y$ alloy oxygen content wt % | $VAl_y$ alloy purity (wt %) |
|---|---|---|---|---|---|---|---|---|
| Example B1-5 | 1 | 0 | 13.6:1 | 1.5:1 | 1.5:1 | 5.8 | 0.08 | 99.9 |
| Example B1-6 | 1 | 1 | 13.3:2 | 0.4:1 | 1.5:1 | The aluminum oxide-rich by-product phase cannot be completely dissolved in dilute acids. | | |
| Example B1-7 | 1 | 1 | 13.3:2 | 2.0:1 | 1.5:1 | 2 | 0.15 | 99.9% |
| Example B1-8 | 1 | 1 | 13.3:2 | 1.0:1 | 3.0:1 | 2 | 0.15 | 99.9% |
| Example B1-9 | 1 | 1 | 13.3:2 | 1.0:1 | 0.02:1 | The aluminum oxide-rich by-product phase cannot be completely dissolved in dilute acids. | | |

The following conclusions can be drawn from Table 8.

(1) As can be seen from Examples B1-3, B1-6 and B1-7, in Example B1-6, when the amount of the calcium oxide added is too low, the aluminum oxide-rich by-product is difficult to be dissolved in dilute acids, and the phase of the acid washing product includes the $VAl_y$ alloy and acid-insoluble calcium aluminate; in Example B1-7, when too much calcium oxide is added, the calcium oxide is excessively consumed. Therefore, in the present disclosure, by controlling the molar ratio of the calcium oxide to aluminum to be within a specific range, the product purity can be improved, and the consumption of the calcium oxide can be reduced.

(2) As can be seen from Examples B1-3, B1-8 and B1-9, in Example B1-9, when the amount of the first adjuvant added is too low, the acid-soluble aluminum-calcium by-product phase is difficult to be fully generated, and the phase of the acid washing product includes the $VAl_y$ alloy and acid-insoluble calcium aluminate; in Example B1-8, the salt consumption is high. Therefore, in the present disclosure, by controlling the mass ratio of the first adjuvant to the vanadium oxide to be within a specific range, the product purity can be improved, and the consumption of the first adjuvant can be reduced.

Example B2

This example provides a method of preparing a vanadium-aluminum alloy having a controllable vanadium-aluminum molar ratio. The preparation method includes the following steps.

(1) Avanadium oxide, a CaO powder, an Al powder and anhydrous $CaCl_2$ were mixed, wherein the molar ratio of the Al powder to the vanadium oxide was (2ay+2by+10b/3+2a):(a+b), y was the value of y in the $VAl_y$ alloy, a/(a+b) was the molar ratio of $V_2O_3$ in the vanadium oxide, b/(a+b) was the molar ratio of $V_2O_5$ in the vanadium oxide; and first reduction was performed on the resulting mixture at 1400° C. under vacuum or a protective atmosphere for 0.25 h to obtain a first reduced material.

(2) Third slurrying was performed on the first reduced material with a hydrochloric acid liquid whose pH was 0.5 to obtain a third slurry; third pH adjustment was performed on the pH of the third slurry, wherein the pH of the third slurry was controlled to be greater than or equal to 1.0 during the third pH adjustment, and the pH of the third slurry after the third pH adjustment was stabilized to 3.0; the third slurry was filtered to obtain a solid phase; and the solid phase was washed at 0° C. with water and dried at 60° C. under vacuum to obtain a $VAl_y$ alloy, wherein the value of y was $0.20 \leq y \leq 5.80$.

(3) First deoxidization was performed on the $VAl_y$ alloy with calcium as a first deoxidizer and anhydrous $CaCl_2$ at 1100° C. under vacuum for 0.25 h to obtain a deoxidized material, wherein the mass ratio of the $VAl_y$ alloy to the first deoxidizer was 1:0.05, and the mass ratio of anhydrous $CaCl_2$ to the $VAl_y$ alloy was 0.2:1.

(4) Third slurrying was performed on the deoxidized material with water to obtain a third slurry; third pH adjustment was performed on the pH of the third slurry, wherein the pH of the third slurry was controlled to be greater than or equal to 0.8 during the third pH adjustment, and the pH of the third slurry after the third pH adjustment was stabilized to 2.0; the third slurry was filtered to obtain a solid phase; and the solid phase was washed at 20° C. and dried at 45° C. to obtain a $VAl_y$ alloy having a low oxygen content.

The specific molar ratio b:a of $V_2O_5$ to $V_2O_3$ in the vanadium oxide, the specific amounts of the calcium oxide, aluminum powder and anhydrous $CaCl_2$ added in this example and the corresponding final value of y are shown in Table 9.

TABLE 9

| | a | b | Molar ratio of Al to the vanadium oxide | Molar ratio of CaO to Al | Mass ratio of anhydrous $CaCl_2$ to vanadium oxide | Value of y | $VAl_y$ alloy oxygen content wt % | $VAl_y$ alloy purity (wt %) |
|---|---|---|---|---|---|---|---|---|
| Example B2-1 | 0 | 1 | 3.93:1 | 1.2:1 | 1.0:1 | 0.3 | 0.19 | 99.9 |

TABLE 9-continued

| | a | b | Molar ratio of Al to the vanadium oxide | Molar ratio of CaO to Al | Mass ratio of anhydrous $CaCl_2$ to vanadium oxide | Value of y | $VAl_y$ alloy oxygen content wt % | $VAl_y$ alloy purity (wt %) |
|---|---|---|---|---|---|---|---|---|
| Example B2-2 | 0.5 | 1 | 9.73:1.5 | 0.8:1 | 0.8:1 | 1.8 | 0.17 | 99.8 |
| Example B2-3 | 1 | 3 | 40:4 | 1.0:1 | 1.5:1 | 3.5 | 0.13 | 99.9 |
| Example B2-4 | 1 | 0 | 13.6:1 | 1.2:1 | 1.2:1 | 5.8 | 0.09 | 99.9 |

Example B3

This example provides a method of preparing a vanadium-aluminum alloy having a controllable vanadium-aluminum molar ratio. The preparation method includes the following steps.

(1) A vanadium oxide, a CaO powder, an Al powder and a $CaCl_2$—KCl eutectic salt were mixed, wherein the molar ratio of the Al powder to the vanadium oxide was (2ay+2by+10b/3+2a):(a+b), y was the value of y in the $VAl_y$ alloy, a/(a+b) was the molar ratio of $V_2O_3$ in the vanadium oxide, b/(a+b) was the molar ratio of $V_2O_5$ in the vanadium oxide; and first reduction was performed on the resulting mixture at 700° C. under vacuum or a protective atmosphere for 24 h to obtain a first reduced material.

(2) Third slurrying was performed on the first reduced material with a hydrochloric acid liquid whose pH was 1.0 to obtain a third slurry; third pH adjustment was performed on the pH of the third slurry, wherein the pH of the third slurry was controlled to be greater than or equal to 0.8 during the third pH adjustment, and the pH of the third slurry after the third pH adjustment was stabilized to 1.5; the third slurry was filtered to obtain a solid phase; and the solid phase was washed at 60° C. with water and dried at 45° C. under vacuum to obtain a $VAl_y$ alloy, wherein the value of y was $0.20 \leq y \leq 5.80$.

(3) First deoxidization was performed on the $VAl_y$ alloy with calcium as a first deoxidizer and a $CaCl_2$—KCl eutectic salt at 700° C. under a helium atmosphere for 48 h to obtain a deoxidized material, wherein the mass ratio of the $VAl_y$ alloy to the first deoxidizer was 1:0.5, and the mass ratio of the $CaCl_2$—KCl eutectic salt to the $VAl_y$ alloy was 3:1.

(4) Third slurrying was performed on the deoxidized material with water to obtain a third slurry; third pH adjustment was performed on the pH of the third slurry, wherein the pH of the third slurry was controlled to be greater than or equal to 0.8 during the third pH adjustment, and the pH of the third slurry after the third pH adjustment was stabilized to 3.0; the third slurry was filtered to obtain a solid phase; and the solid phase was washed at 10° C. and dried at 40° C. to obtain a $VAl_y$ alloy having a low oxygen content.

The specific molar ratio b:a of $V_2O_5$ to $V_2O_3$ in the vanadium oxide, the specific amounts of the calcium oxide, aluminum powder and anhydrous $CaCl_2$ added in this example and the corresponding final value of y are shown in Table 10.

TABLE 10

| | a | b | Molar ratio of Al to the vanadium oxide | Molar ratio of CaO to Al | Mass ratio of anhydrous $CaCl_2$ eutectic salt to vanadium oxide | Value of y | $VAl_y$ alloy oxygen content wt % | $VAl_y$ alloy purity (wt %) |
|---|---|---|---|---|---|---|---|---|
| Example B3-1 | 1 | 1 | 6.53:2 | 1.1:1 | 1.0:1 | 0.3 | 0.20 | 99.9 |
| Example B3-2 | 0.2 | 1 | 7.33:1.2 | 0.9:1 | 0.8:1 | 1.5 | 0.18 | 99.8 |
| Example B3-3 | 1 | 2 | 20.67:3 | 1.2:1 | 1.2:1 | 2.0 | 0.14 | 99.9 |
| Example B3-4 | 1 | 3 | 52:4 | 1.2:1 | 1.2:1 | 5.0 | 0.10 | 99.9 |

Example B4

The preparation method of this example is the same as the preparation method of Example B1-1 except that first deoxidization and a post-deoxidization wet treatment were performed after step (2).

Specifically, the preparation method further includes the following steps.

(3) First deoxidization was performed on the $VAl_y$ alloy with calcium as a first deoxidizer and a $CaCl_2$—KCl eutectic salt at 1000° C. under a helium atmosphere for 20 h to obtain a deoxidized material, wherein the mass ratio of the $VAl_y$ alloy to the first deoxidizer was 1:0.3, and the mass ratio of the $CaCl_2$—KCl eutectic salt to the $VAl_y$ alloy was 0.4:1.

(4) Third slurrying was performed on the deoxidized material with a hydrochloric acid liquid whose pH was 0.8 to obtain a third slurry; third pH adjustment was performed on the pH of the third slurry, wherein the pH of the third slurry was controlled to be greater than or equal to 0.8 during the third pH adjustment, and the pH of the third slurry after the third pH adjustment was stabilized to 2.5; the third slurry was filtered to obtain a solid phase; and the solid phase was washed at 15° C. and dried at 45° C. under vacuum to obtain a $VAl_y$ alloy having an oxygen content as low as 0.07%.

Example B5

The preparation method of this example is the same as the preparation method of Example B1 except that the first adjuvant $CaCl_2$—KCl eutectic salt was replaced with $MgCl_2$, and the results are shown in Table 11.

TABLE 11

| | a | b | Molar ratio of Al to the vanadium oxide | Molar ratio of CaO to Al | Mass ratio of $MgCl_2$ slat to vanadium oxide | Product obtained after first reduction and acid washing |
|---|---|---|---|---|---|---|
| Example B1-1 | 0 | 1 | 3.74:1 | 1.0:1 | 1.5:1 | Due to the replacement reaction between $MgCl_2$ and CaO, the generated MgO reacts with part of the first reduction product $Al_2O_3$ to form dilute acid-insoluble magnesia-alumina spinel, and the mixture of magnesia-alumina spinel and a vandium-aluminum alloy is obtained, where the mass proportion of the vanadium-aluminum alloy cannot exceed 80%. |
| Example B1-2 | 0.5 | 1 | 8.83:1.5 | 1.0:1 | 0.6:1 | |
| Example B1-3 | 1 | 1 | 13.3:2 | 1.0:1 | 1.5:1 | |
| Example B1-4 | 2 | 1 | 31.3:3 | 0.6:1 | 2.0:1 | |
| Example B1-5 | 1 | 0 | 13.6:1 | 1.5:1 | 1.5:1 | |

Comparative Example B1

The preparation method of this comparative example is the same as the preparation method of Example B1-1 except that the aluminum powder was replaced with an equal molar ratio of a magnesium powder. Since no aluminum source was used in this comparative example, no vanadium-aluminum alloy was obtained after the first reduction.

Comparative Example B2

The preparation method of this comparative example is the same as the preparation method of Example B1-1 except that no calcium oxide was added. Since the aluminum oxide-rich by-product phase in the obtained first reduction product cannot be completely dissolved in dilute acids, the vanadium aluminum alloy with high purity cannot be obtained.

As can be seen from Example B1-1, Comparative Example B1 and Comparative Example B2, a calcium oxide and a first adjuvant are added in the first reduction with aluminum in the present disclosure, magnesium is used as the first reductant in Comparative Example B1, and no calcium oxide is added in Comparative Example B2; in this manner, the $VAl_y$ alloy wherein the value of y is 0.2 can be accurately prepared in Example B1-1, the vanadium-aluminum alloy cannot be formed in Comparative Example B1, and although the vanadium-aluminum alloy can be obtained in Comparative Example B2, since the aluminum oxide-rich by-product phase in the first reduction product is mainly a corundum phase which cannot be dissolved in dilute acids, the mixed phase of the vanadium-aluminum alloy and aluminum oxide is obtained after acid washing.

Taking Example B1-1, Example B1-4, Example B2-1 and Example B3-3 as examples, the stability of the components of the products obtained in the methods of the present disclosure was detected, that is, each Example B was repeated five times, and the value of y in the final product was calculated by an ICP-OES chemical component analytical method. The results are shown in Table 12.

TABLE 12

| | First time y | Second time y | Third time y | Fourth time y | Fifth time y | Average | Standard deviation |
|---|---|---|---|---|---|---|---|
| Example B1-1 | 0.200 | 0.202 | 0.199 | 0.199 | 0.201 | 0.200 | 0.0013 |
| Example B1-4 | 4.000 | 4.005 | 4.007 | 3.992 | 3.996 | 4.000 | 0.0062 |
| Example B2-1 | 0.301 | 0.308 | 0.293 | 0.299 | 0.302 | 0.301 | 0.0054 |
| Example B3-3 | 2.000 | 2.004 | 1.995 | 2.001 | 1.998 | 2.000 | 0.0034 |

As can be seen from Table 12, the method of preparing a vanadium-aluminum alloy provided by the present disclosure can reliably and stably prepare $VAl_y$ alloys having desired values of y, and the standard deviation of the value of y of five replicates is less than or equal to 0.0062, indicating that the stability is high.

Figure 3:
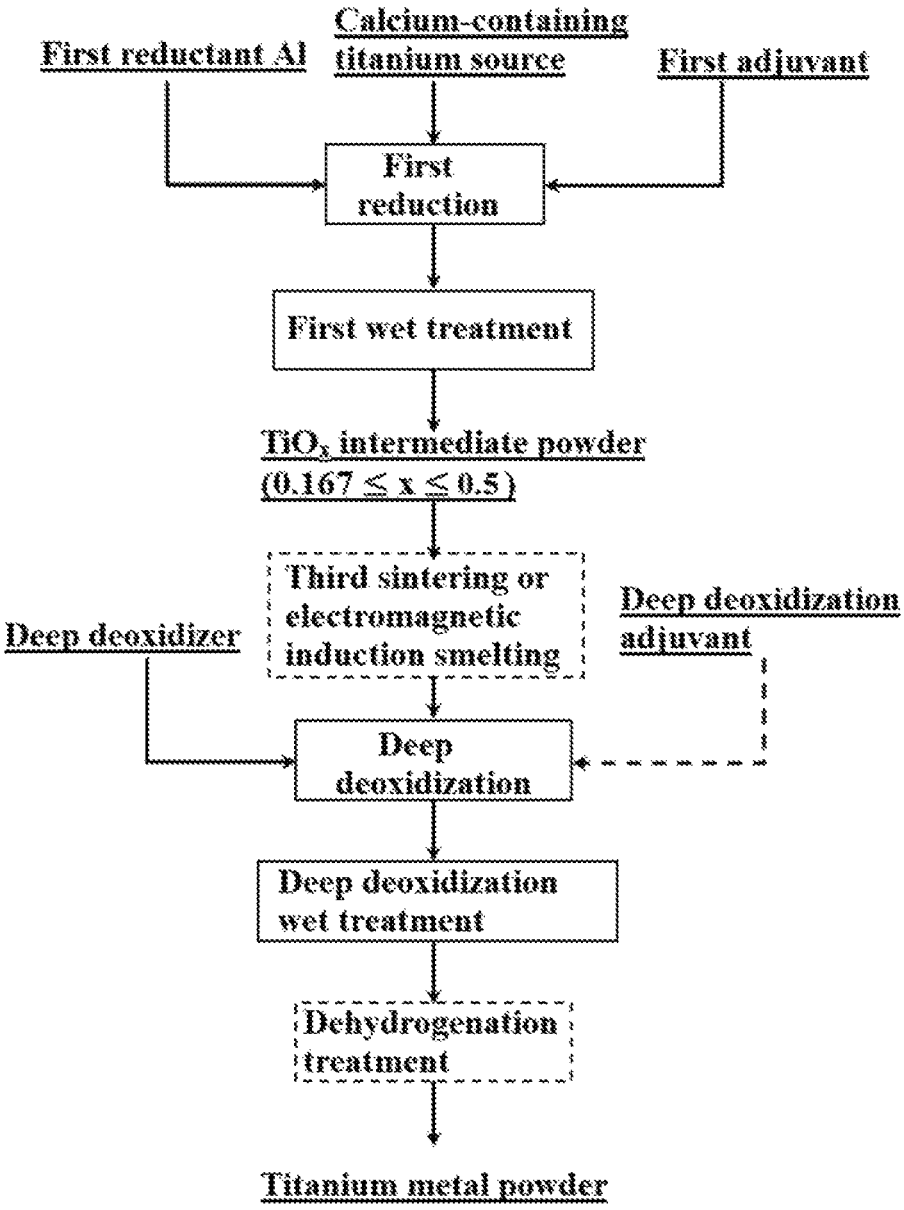
FIG. 3 is a flowchart of a method of preparing a titanium metal powder by reduction according to embodiment three of the present disclosure.

Embodiment three: The present disclosure provides a first scheme of preparing a titanium metal powder, that is, the present disclosure provides a method of preparing a titanium metal powder by reduction of titanium dioxide. As shown in FIG. 3, the preparation method includes the following steps.

(1) A calcium-containing titanium source, a first reductant and a first adjuvant are mixed, and first reduction is performed on resulting mixture to obtain a reduced material, wherein the first reductant includes aluminum; and a first wet treatment is performed on the reduced material to obtain a first reduced powder, wherein the first reduced powder is $TiO_x$, and x is $0.167 \leq x \leq 0.5$.

(2) Deep deoxidization and a deep deoxidization wet treatment are performed on the first reduced powder with a deep deoxidizer to obtain a titanium metal powder, wherein the deep deoxidizer includes magnesium and/or calcium.

Optionally, third sintering or electromagnetic induction smelting may be performed on the first reduced powder between the first wet treatment and the deep deoxidization.

Optionally, when the deep deoxidizer contains magnesium, a dehydrogenation treatment is performed on the product obtained after the deep deoxidization wet treatment to obtain a titanium metal powder.

Example C1

This example provides a method of preparing a titanium metal powder by reduction of titanium dioxide. The preparation method includes the following steps.

(1) A calcium-containing titanium source (a mixture of a calcium oxide and calcined titanium dioxide), an aluminum powder and a $CaCl_2$—KCl eutectic salt were mixed, wherein the molar ratio of calcium in the calcium-containing titanium source to the aluminum powder was 1.0:1, the molar ratio of the aluminum powder to titanium in the calcium-containing titanium source was 1.11:1, and the mass ratio of the $CaCl_2$—KCl eutectic salt to titanium in the calcium-containing titanium source based on $TiO_2$ was 1.5:1; and first reduction was performed on the resulting mixture at 1200° C. under a helium atmosphere for 2 h to obtain a first reduction product.

Slurrying was performed on the first reduction product with a hydrochloric acid whose pH was 1.0 to obtain a slurry, wherein the liquid-to-solid ratio was 50:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.2; the slurry was filtered to obtain a solid phase; and the solid phase was washed at 50° C. with water and dried at 45° C. to obtain a $TiO_x$ intermediate powder.

(2) The $TiO_x$ intermediate powder was sintered at 1400° C. under vacuum for 1 h, and deep deoxidization was performed with a magnesium powder and a $MgCl_2$ molten salt on the sintered $TiO_x$ intermediate powder at 850° C. under a pure hydrogen atmosphere for 2 h to obtain a deep deoxidization product, wherein the mass ratio of the magnesium powder to the $TiO_x$ intermediate powder was 0.3:1, and the mass ratio of the $MgCl_2$ molten salt to the $TiO_x$ intermediate powder was 2.0:1.

Slurrying was performed on the deep deoxidization product with a hydrochloric acid liquid whose pH was 1.5 to obtain a slurry, wherein the liquid-to-solid ratio was 3:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; the solid phase was washed at 40° C. with water and dried at 40° C. to obtain a dried product; and a dehydrogenation treatment was performed on the dried product at 800° C. under an argon atmosphere to obtain a titanium metal powder.

Example C2

This example provides a method of preparing a titanium metal powder by reduction of titanium dioxide. The preparation method includes the following steps.

(1) A calcium-containing titanium source (a mixture of a calcium oxide and a calcined product obtained after the calcination of a calcium oxide and titanium dioxide mixed based on $CaTiO_3$), an aluminum powder and a $CaCl_2$—NaCl eutectic salt were mixed, wherein the molar ratio of calcium in the calcium-containing titanium source to the aluminum powder was 0.6:1, the molar ratio of the aluminum powder to titanium in the calcium-containing titanium source was 1.33:1, and the mass ratio of the $CaCl_2$—NaCl eutectic salt to titanium in the calcium-containing titanium source based on $TiO_2$ was 3.0:1; and first reduction was performed on the resulting mixture at 1100° C. under a helium atmosphere for 4 h to obtain a first reduction product.

Slurrying was performed on the first reduction product with a hydrochloric acid whose pH was 1.0 to obtain a slurry, wherein the liquid-to-solid ratio was 20:1 mL/g; pH adjustment was performed on the pH of the slurry, wherein the pH of the slurry was controlled to be greater than or equal to 1.2 during the pH adjustment, and the pH of the slurry after the pH adjustment was stabilized to 2.5; the slurry was filtered to obtain a solid phase; and the solid phase was washed at 20° C. with water and dried at 60° C. to obtain a $TiO_x$ intermediate powder.

(2) The $TiO_x$ intermediate powder was sintered at 1200° C. under a hydrogen atmosphere for 12 h, and deep deoxidization was performed with calcium particles and anhydrous $CaCl_2$ on the sintered $TiO_x$ intermediate powder at 800° C. under a hydrogen-argon mixed atmosphere (where the volume fraction of hydrogen was 50%) for 12 h to obtain a deep deoxidization product, wherein the mass ratio of the calcium particles to the $TiO_x$ intermediate powder was 0.14:1, and the mass ratio of anhydrous $CaCl_2$ to the $TiO_x$ intermediate powder was 3.0:1.

Slurrying was performed on the deep deoxidization product with a hydrochloric acid liquid whose pH was 1.0 to obtain a slurry, wherein the liquid-to-solid ratio was 80:1 mL/g; pH adjustment was performed on the pH of the slurry, wherein the pH of the slurry was controlled to be greater than or equal to 1.0 during the pH adjustment, and the pH of the slurry after the pH adjustment was stabilized to 2.5; the slurry was filtered to obtain a solid phase; the solid phase was washed at 45° C. with water and dried at 40° C. to obtain a dried product; and a dehydrogenation treatment was performed on the dried product at 500° C. under vacuum to obtain a titanium metal powder.

Example C3

The preparation method of this example is the same as the preparation method of Example C1 except that the $MgCl_2$ molten salt in step (2) was replaced with a $CaCl_2$ molten salt.

Example C4

The preparation method of this example is the same as the preparation method of Example C1 except that the pure hydrogen atmosphere in step (2) was replaced with a helium atmosphere.

Example C5

The preparation method of this example is the same as the preparation method of Example C1 except that the sintering step in step (2) was not performed, that is, deep deoxidization was directly performed on the $TiO_x$ intermediate powder, wherein the parameters and conditions of the deep deoxidization were the same as those in Example C1.

The calculation results are shown in Tables 13 and 14.

TABLE 13

| | Value of x in $TiO_x$ intermediate powder | Oxygen content of titanium metal powder (wt %) | Aluminum consumed per ton of titanium metal powder | Magnesium or calcium consumed per ton of titanium metal powder | Reductant cost of per ton of titanium metal powder |
|---|---|---|---|---|---|
| Example C1 | 0.5 | 0.28 | 0.6244 | 0.35 | 26,488 CNY |
| Example C2 | 0.167 | 0.15 | 0.7481 | 0.1477 | 21,608 CNY |

TABLE 14

| | Product obtained after washing, filtration and drying are performed on the first reduction product | Oxygen content of titanium metal powder (wt %) |
|---|---|---|
| Example C3 | $Ti_2O$, i.e., x = 0.5 | 0.88 |
| Example C4 | $Ti_2O$, i.e., x = 0.5 | 2.45 |
| Example C5 | $Ti_2O$, i.e., x = 0.5 | 1.75 |

"/" in the preceding tables indicates that there is no related data.

The following conclusions can be drawn from Tables 13 and 14.

(1) As can be seen from Examples C1 to C2, the method of preparing a titanium metal powder provided by the present disclosure can prepare a titanium metal powder having an oxygen content less than or equal to 0.28%, and the total cost of the reductant can be reduced to 21,608 CNY per ton of titanium metal powder and is significantly reduced compared with the total cost of the reductant in the magnesium reduction process.

(2) As can be seen from Example C1, Example C3 and Example C4, the magnesium reduction in Example C1 is performed using a magnesium-containing second adjuvant under a hydrogen-containing atmosphere, a $CaCl_2$ molten salt is adopted as the second adjuvant in Example C3, and a hydrogen-free atmosphere is adopted in Example C4. In this manner, the oxygen content of the final titanium metal powder in Example C1 is only 0.28 wt %, and the oxygen contents in Examples C3 and C4 are as high as 0.88 wt % and 2.45 wt %, respectively. Therefore, in the present disclosure, by performing the magnesium reduction steps under a hydrogen-containing atmosphere with a magnesium-containing second adjuvant, the reduction effect is improved, and the oxygen content of the titanium metal powder is reduced.

(3) As can be seen from Example C1 and Example C5, in Example C5, no sintering is performed, a dense structure thus cannot be formed, and the oxygen content of the final titanium metal powder is as high as 1.75 wt %. Therefore, in the present disclosure, by preferably performing sintering or electromagnetic induction smelting, the oxygen content of the titanium metal powder can be further reduced.

Figure 4:
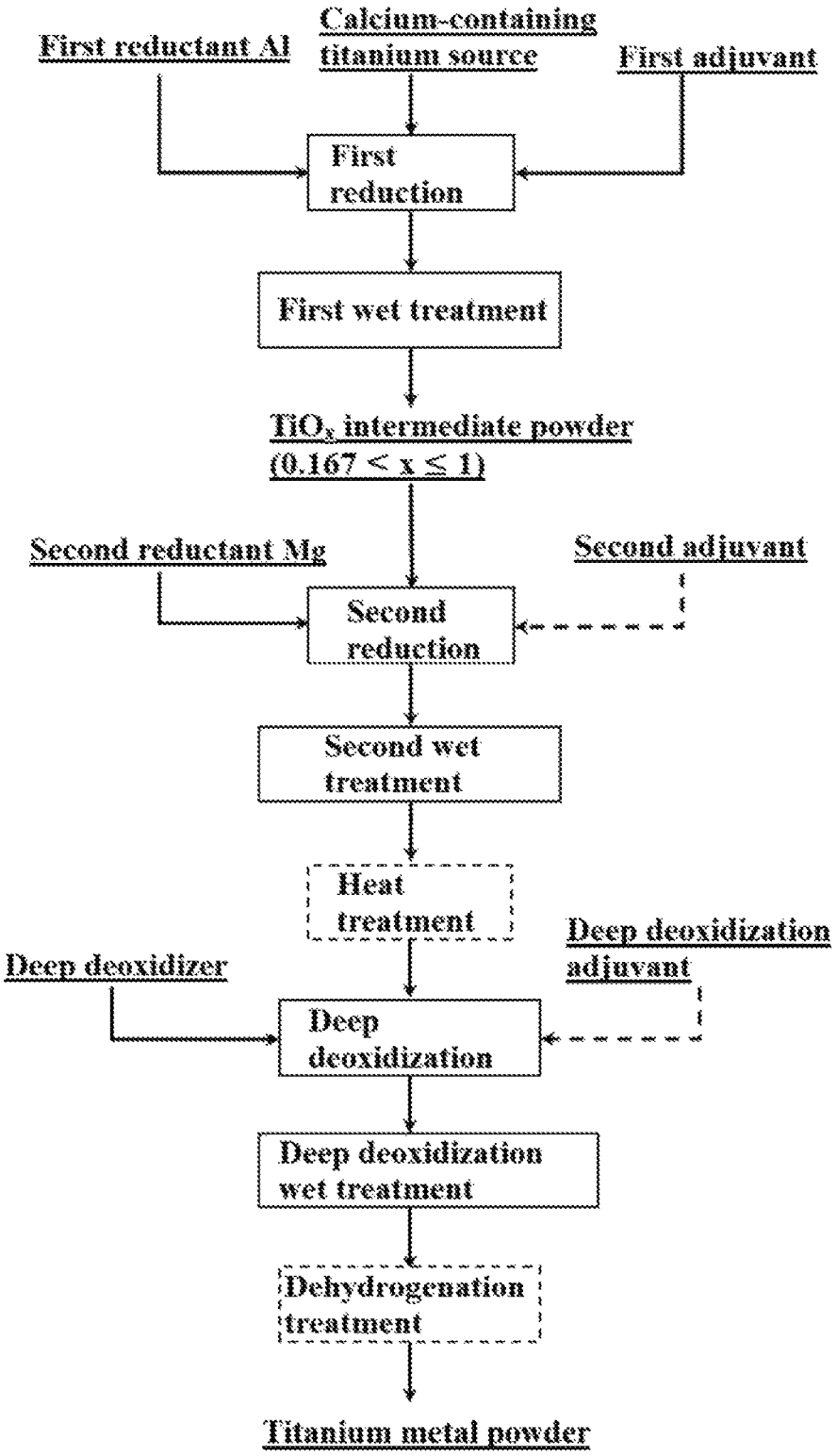
FIG. 4 is a flowchart of a method of preparing a titanium metal powder by three-stage reduction of titanium dioxide according to embodiment four of the present disclosure.

Embodiment four: The present disclosure provides a second scheme of preparing a titanium metal powder, that is, the present disclosure provides a method of preparing a titanium metal powder by three-stage reduction of titanium dioxide. As shown in FIG. 4, the preparation method includes the following steps.

(1) A calcium-containing titanium source, a first reductant and a first adjuvant are mixed, and first reduction is performed to obtain a reduced material, wherein the first reductant includes aluminum; and a first wet treatment is performed on the reduced material to obtain a first reduced powder, wherein the first reduced powder is $TiO_x$, and x is $0.167 \leq x \leq 1$.

(2) Second reduction is performed on the first reduced powder with a second reductant, and a second wet treatment is performed to obtain a second reduced powder having an oxygen content less than or equal to 2 wt %, wherein the second reductant includes magnesium.

Deep deoxidization and a deep deoxidization wet treatment are performed on the second reduced powder with a deep deoxidizer to obtain a titanium metal powder, wherein the deep deoxidizer includes magnesium and/or calcium.

Optionally, a heat treatment may be performed on the second reduced powder between the second wet treatment and the deep deoxidization.

Optionally, when the deep deoxidizer contains magnesium, a dehydrogenation treatment is performed on the product obtained after the deep deoxidization wet treatment to obtain a titanium metal powder.

Example D1

This example provides a method of preparing a titanium metal powder by three-stage reduction of titanium dioxide. The preparation method includes the following steps.

(1) A calcium-containing titanium source (a mixture of a calcium oxide and calcined titanium dioxide), an aluminum powder and a $CaCl_2$—KCl eutectic salt were mixed, wherein the molar ratio of calcium in the calcium-containing titanium source to the aluminum powder was 1.5:1, the molar ratio of the aluminum powder to titanium in the calcium-containing titanium source was 1.11:1, and the mass ratio of the $CaCl_2$—KCl eutectic salt to titanium in the calcium-containing titanium source based on $TiO_2$ was 2.0:1; and first reduction was performed on the resulting mixture at 1000° C. under a helium atmosphere for 6 h to obtain a first reduction product.

Slurrying was performed on the first reduction product with a hydrochloric acid liquid whose pH was 1.5 to obtain a slurry, wherein the liquid-to-solid ratio was 50:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at 42° C. with water and dried at 50° C. to obtain a $TiO_x$ intermediate powder.

(2) Second reduction was performed on the $TiO_x$ intermediate powder with a magnesium powder and a $MgCl_2$—KCl eutectic salt at 800° C. under a helium atmosphere for 4 h to obtain a second reduction product, wherein the mass ratio of the magnesium powder to the $TiO_x$ intermediate powder was 0.15:1, and the mass ratio of the $MgCl_2$—KCl eutectic salt to the $TiO_x$ intermediate powder was 2.0:1.

Slurrying was performed on the second reduction product with water to obtain a slurry, wherein the liquid-to-solid ratio was 80:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.5; the slurry was filtered to obtain a solid phase; and the solid phase was washed at 55° C. with water and dried at 55° C. to obtain a second reduced powder.

(3) A heat treatment was performed on the second reduced powder at 1000° C. under vacuum for 4 h, and deep deoxidization was performed with a magnesium powder and a $MgCl_2$—KCl eutectic salt at 800° C. under a pure hydrogen atmosphere for 4 h to obtain a deep deoxidization product, wherein the mass ratio of the magnesium powder to the second reduced powder was 0.08:1, and the mass ratio of the $MgCl_2$—KCl eutectic salt to the second reduced powder was 2.0:1.

Slurrying was performed on the deep deoxidization product with a hydrochloric acid liquid whose pH was 0.5 to obtain a slurry, wherein the liquid-to-solid ratio was 20:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.8; the slurry was filtered to obtain a solid phase; and the solid phase was washed at 50° C. with water and dried at 50° C. to obtain a titanium metal powder.

A dehydrogenation treatment was performed on the titanium metal powder at 800° C. under an argon atmosphere to obtain a final titanium metal powder.

Example D2

This example provides a method of preparing a titanium metal powder by three-stage reduction of titanium dioxide. The preparation method includes the following steps.

(1) A calcium-containing titanium source (a mixture of a calcium oxide and calcined titanium dioxide), an aluminum powder and a $CaCl_2$—NaCl eutectic salt were mixed, wherein the molar ratio of calcium in the calcium-containing titanium source to the aluminum powder was 1.5:1, the molar ratio of the aluminum powder to titanium in the calcium-containing titanium source was 1.22:1, and the mass ratio of the $CaCl_2$—NaCl eutectic salt to titanium in the calcium-containing titanium source based on $TiO_2$ was 2.5:1; and first reduction was performed on the resulting mixture at 900° C. under a helium atmosphere for 12 h to obtain a first reduction product.

Slurrying was performed on the first reduction product with a hydrochloric acid whose pH was 0.5 to obtain a slurry, wherein the liquid-to-solid ratio was 10:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at 50° C. with water and dried at 50° C. to obtain a $TiO_x$ intermediate powder.

(2) Second reduction was performed on the $TiO_x$ intermediate powder with a magnesium powder and a $MgCl_2$—NaCl eutectic salt at 700° C. under a helium atmosphere for 10 h to obtain a second reduction product, wherein the mass ratio of the magnesium powder to the $TiO_x$ intermediate powder was 0.15:1, and the mass ratio of the $MgCl_2$—NaCl eutectic salt to the $TiO_x$ intermediate powder was 2.0:1.

Slurrying was performed on the second reduction product with a hydrochloric acid whose pH was 1.0 to obtain a slurry, wherein the liquid-to-solid ratio was 30:1 mL/g; pH adjustment was performed on the pH of the slurry, wherein the pH of the slurry was controlled to be greater than or equal to 0.9 during the pH adjustment, and the pH of the slurry after the pH adjustment was stabilized to 2.5; the slurry was filtered to obtain a solid phase; and the solid phase was washed at 30° C. with water and dried at 55° C. to obtain a second reduced powder.

(3) A heat treatment was performed on the second reduced powder at 900° C. under an argon atmosphere for 18 h, and deep deoxidization was performed with a magnesium powder and anhydrous $MgCl_2$ at 650° C. under a hydrogen-argon mixed atmosphere (where the volume fraction of hydrogen was 85%) for 48 h to obtain a deep deoxidization product, wherein the mass ratio of the magnesium powder to the second reduced powder was 0.05:1, and the mass ratio of anhydrous $MgCl_2$ to the second reduced powder was 0.5:1.

Slurrying was performed on the deep deoxidization product with a hydrochloric acid liquid whose pH was 1.5 to obtain a slurry, wherein the liquid-to-solid ratio was 30:1 mL/g; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 55° C. with water and dried at 55° C. to obtain a titanium metal powder.

A dehydrogenation treatment was performed on the titanium metal powder at 1000° C. under an argon atmosphere to obtain a final titanium metal powder.

Example D3

This example provides a method of preparing a titanium metal powder by three-stage reduction of titanium dioxide. The preparation method includes the following steps.

(1) A calcium-containing titanium source (a mixture of a calcium oxide and a calcined product obtained after the calcination of calcium oxide and titanium dioxide mixed based on the stoichiometric ratio of calcium titanate), an aluminum powder and anhydrous $CaCl_2$ were mixed, wherein the molar ratio of calcium in the calcium-containing titanium source to the aluminum powder was 0.6:1, the molar ratio of the aluminum powder to titanium in the calcium-containing titanium source was 0.67:1, and the mass ratio of anhydrous $CaCl_2$ to titanium in the calcium-containing titanium source based on $TiO_2$ was 1.0:1; and first reduction was performed on the resulting mixture at 1100° C. under vacuum for 4 h to obtain a first reduction product.

Slurrying was performed on the first reduction product with a hydrochloric acid liquid whose pH was 0.5 to obtain a slurry, wherein the liquid-to-solid ratio was 10:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 0° C. with water and dried at 45° C. to obtain a $TiO_x$ intermediate powder.

(2) Second reduction was performed on the $TiO_x$ intermediate powder with a magnesium powder and a $MgCl_2$—$CaCl_2$ eutectic salt at 900° C. under an argon atmosphere for 0.25 h to obtain a second reduction product, wherein the mass ratio of the magnesium powder to the $TiO_x$ intermediate powder was 0.35:1, and the mass ratio of the $MgCl_2$—$CaCl_2$ eutectic salt to the $TiO_x$ intermediate powder was 1.0:1.

Slurrying was performed on the second reduction product with a hydrochloric acid whose pH was 1.0 to obtain a slurry, wherein the liquid-to-solid ratio was 15:1 mL/g; pH adjustment was performed on the pH of the slurry, wherein the pH of the slurry was controlled to be greater than or equal to 1.0 during the pH adjustment, and the pH of the slurry after the pH adjustment was stabilized to 1.5; the slurry was filtered to obtain a solid phase; and the solid phase was washed at 25° C. with water and dried at 40° C. to obtain a second reduced powder.

(3) A heat treatment was performed on the second reduced powder at 1100° C. under vacuum for 2 h, and deep deoxidization was performed with a magnesium powder and anhydrous $CaCl_2$ at 1100° C. under an argon atmosphere for 2 h to obtain a deep deoxidization product, wherein the mass ratio of the magnesium powder to the second reduced powder was 0.15:1, and the mass ratio of anhydrous $CaCl_2$ to the second reduced powder was 2.0:1.

Slurrying was performed on the deep deoxidization product with a hydrochloric acid liquid whose pH was 1.0 to obtain a slurry, wherein the liquid-to-solid ratio was 10:1 mL/g; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 30° C. with water and dried at 60° C. to obtain a titanium metal powder.

Example D4

This example provides a method of preparing a titanium metal powder by three-stage reduction of titanium dioxide. The preparation method includes the following steps.

(1) A calcium-containing titanium source (a mixture of a calcium oxide and calcined titanium dioxide), an aluminum powder and a $CaCl_2$—KCl eutectic salt were mixed, wherein the molar ratio of calcium in the calcium-containing titanium source to the aluminum powder was 2.0:1, the molar ratio of the aluminum powder to titanium in the calcium-containing titanium source was 1.22:1, and the mass ratio of the $CaCl_2$—KCl eutectic salt to titanium in the calcium-containing titanium source based on $TiO_2$ was 1.5:1; and first reduction was performed on the resulting mixture at 700° C. under a helium atmosphere for 24 h to obtain a first reduction product.

Slurrying was performed on the first reduction product with water to obtain a slurry, wherein the liquid-to-solid ratio was 100:1 mL/g; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 60° C. with water and dried at 60° C. to obtain a $TiO_x$ intermediate powder.

(2) Second reduction was performed on the $TiO_x$ intermediate powder with a magnesium powder and a $MgCl_2$—KCl eutectic salt at 650° C. under a hydrogen atmosphere for 48 h to obtain a second reduction product, wherein the mass ratio of the magnesium powder to the $TiO_x$ intermediate powder was 0.2:1, and the mass ratio of the $MgCl_2$—KCl eutectic salt to the $TiO_x$ intermediate powder was 3.0:1.

Slurrying was performed on the second reduction product with a hydrochloric acid whose pH was 2.0 to obtain a slurry, wherein the liquid-to-solid ratio was 100:1 mL/g; pH adjustment was performed on the pH of the slurry, wherein the pH of the slurry was controlled to be greater than or equal to 1.0 during the pH adjustment, and the pH of the slurry after the pH adjustment was stabilized to 3.0; the slurry was filtered to obtain a solid phase; and the solid phase was washed at 15° C. with water and dried at 60° C. to obtain a second reduced powder.

(3) A heat treatment was performed on the second reduced powder at 800° C. under an argon atmosphere for 24 h, and deep deoxidization was performed with a magnesium powder and a $CaCl_2$—LiCl eutectic salt at 900° C. under a helium atmosphere for 16 h to obtain a deep deoxidization product, wherein the mass ratio of the magnesium powder to the second reduced powder was 0.03:1, and the mass ratio of the $CaCl_2$—LiCl eutectic salt to the second reduced powder was 1.0:1.

Slurrying was performed on the deep deoxidization product with a hydrochloric acid liquid whose pH was 1.5 to obtain a slurry, wherein the liquid-to-solid ratio was 40:1 mL/g; pH adjustment was performed on the pH of the slurry, wherein the pH of the slurry was controlled to be greater than or equal to 1.0 during the pH adjustment, and the pH of the slurry after the pH adjustment was stabilized to 1.5; the slurry was filtered to obtain a solid phase; and the solid phase was washed at 40° C. with water and dried at 45° C. to obtain a titanium metal powder.

Example D5

The preparation method of this example is the same as the preparation method of Example D1 except that the $MgCl_2$—KCl eutectic salt in step (2) was replaced with a $CaCl_2$—KCl eutectic salt.

Example D6

The preparation method of this example is the same as the preparation method of Example D1 except that the pure hydrogen atmosphere in the deep deoxidization in step (3) was replaced with a helium atmosphere.

Example D7

The preparation method of this example is the same as the preparation method of Example D1 except that no heat treatment was performed on the second reduced powder in step (3).

The measurement and calculation results of the preceding examples are shown in Table 15.

TABLE 15

| | Value of x in $TiO_x$ intermediate powder | Oxygen content of second reduced powder/ wt % | Oxygen content of titanium metal powder/ wt % | Aluminum consumed per ton of titanium metal powder | Calcium consumed per ton of titanium metal powder | Magnesium consumed per ton of titanium metal powder | Reductant cost of per ton of titanium metal powder |
|---|---|---|---|---|---|---|---|
| Example D1 | 0.5 | 4.99 | 0.18 | 0.6244 | / | 0.2592 | 22,856 CNY |
| Example D2 | 0.33 | 2.0 | 0.15 | 0.6863 | / | 0.2177 | 22,434 CNY |
| Example D3 | 1.0 | 4.01 | 0.12 | 0.3769 | 0.1563 | 0.4667 | 33,240 CNY |

TABLE 15-continued

| | Value of x in $TiO_x$ intermediate powder | Oxygen content of second reduced powder/ wt % | Oxygen content of titanium metal powder/ wt % | Aluminum consumed per ton of titanium metal powder | Calcium consumed per ton of titanium metal powder | Magnesium consumed per ton of titanium metal powder | Reductant cost of per ton of titanium metal powder |
|---|---|---|---|---|---|---|---|
| Example D4 | 0.33 | 0.49 | 0.08 | 0.6863 | 0.0302 | 0.2222 | 23,973 CNY |

TABLE 16

| | Product obtained after the first wet treatment is performed on the first reduction product | Oxygen content of second reduced powder (wt %) | Oxygen content of titanium metal powder (wt %) |
|---|---|---|---|
| Example D5 | $Ti_2O$, i.e., x = 0.5 | 5.51 | 0.29 |
| Example D6 | $Ti_2O$, i.e., x = 0.5 | 4.99 | 2.42 |
| Example D7 | $Ti_2O$, i.e., x = 0.5 | 4.99 | 1.78 |

"/" in the preceding tables indicates that there is no related data.

The following conclusions can be drawn from Tables 15 and 16.

(1) As can be seen from Examples D1 to D4, the method of preparing a titanium metal powder provided by the present disclosure can prepare a titanium metal powder having an oxygen content less than or equal to 0.2%, and the cost of the reductant can be reduced to 22,434 CNY per ton of titanium metal powder and is only 56% of the cost of the reductant in the magnesium reduction.

(2) As can be seen from Example D1 and Example D5, the magnesium reduction in Example D1 adopts a magnesium-containing second adjuvant, and a $CaCl_2$—KCl eutectic salt is adopted as the second adjuvant in Example D5. In this manner, the oxygen content of the second reduced powder in Example D1 is 4.99 wt %, and the oxygen content in Example D5 is as high as 5.51 wt %. Therefore, in the present disclosure, by performing the magnesium reduction steps with a magnesium-containing second adjuvant, the reduction effect is improved.

(3) As can be seen from Example D1 and Example D6, in Example D6, magnesium is used as the deoxidizer, a hydrogen-free atmosphere is adopted, and thus the oxygen content of the final titanium metal powder is as high as 2.42 wt %. Therefore, in the present disclosure, by preferably adopting magnesium and a hydrogen-containing atmosphere to perform deep deoxidization, the deep deoxidization can be significantly improved, and the oxygen content of the titanium metal powder can be further reduced.

(4) As can be seen from Example D1 and Example D7, in Example D7, no heat treatment is performed, a dense structure thus cannot be formed, and the oxygen content of the final titanium metal powder is as high as 1.78 wt %. Therefore, in the present disclosure, by preferably performing heat treatment, the oxygen content of the titanium metal powder can be further reduced.

Figure 5:
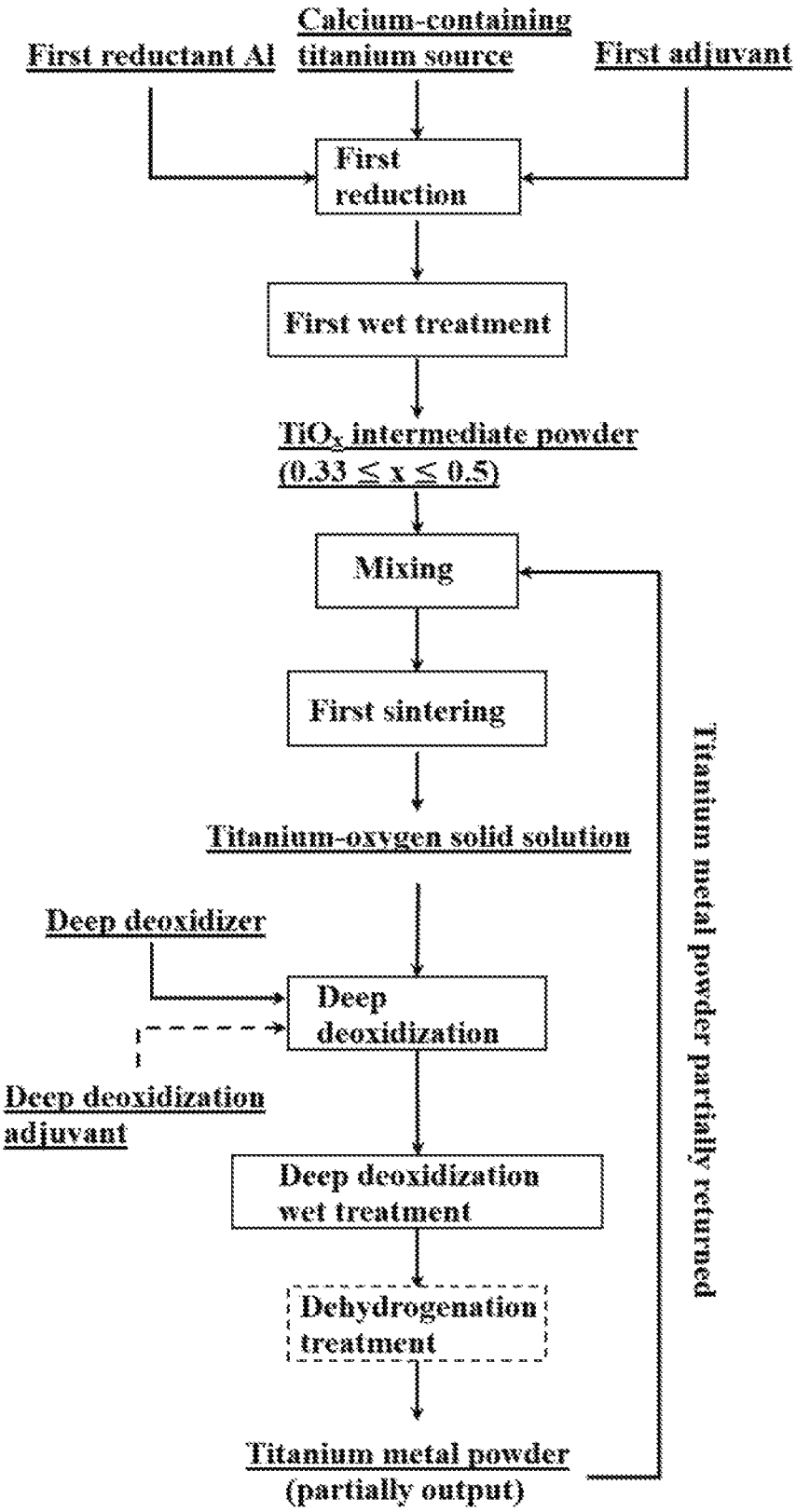
FIG. 5 is a flowchart of a method of preparing a titanium metal powder by reduction of titanium dioxide according to embodiment five of the present disclosure.

Embodiment five: The present disclosure provides a third scheme of preparing a titanium metal powder, that is, the present disclosure provides a method of preparing a titanium metal powder by reduction of titanium dioxide. As shown in FIG. 5, the preparation method includes the following steps.

(1) A calcium-containing titanium source, a first reductant and a first adjuvant are mixed, and first reduction is performed to obtain a reduced material, wherein the first reductant includes aluminum; and a first wet treatment is performed on the reduced material to obtain a first reduced powder, wherein the first reduced powder is $TiO_x$, and x is $0.333 \leq x \leq 0.5$.

(2) A first reduced powder and a titanium metal powder partially returned are mixed to obtain a mixed material, first sintering is performed on the mixed material to obtain a titanium-oxygen solid solution having an oxygen content less than or equal to 8 wt %, and deep deoxidization and a deep deoxidization wet treatment are performed on the titanium-oxygen solid solution with a deep deoxidizer to obtain a titanium metal powder, wherein the deep deoxidizer includes magnesium and/or calcium.

Optionally, when the deep deoxidizer is magnesium, a dehydrogenation treatment is performed on the product obtained after the deep deoxidization wet treatment to obtain a titanium metal powder. Part of the titanium metal powder is outputted, and part is returned to be mixed with the first reduced powder.

Example E1

This example provides a method of preparing a titanium metal powder by reduction of titanium dioxide. The preparation method includes the following steps.

(1) A calcium-containing titanium source (a mixture of a calcium oxide and calcined titanium dioxide), an aluminum powder and a $CaCl_2$—NaCl eutectic salt were mixed, wherein the molar ratio of calcium in the calcium-containing titanium source to the aluminum powder was 1.3:1, the molar ratio of the aluminum powder to titanium in the calcium-containing titanium source was 1.0:1, and the mass ratio of the $CaCl_2$—NaCl eutectic salt to titanium in the calcium-containing titanium source based on $TiO_2$ was 1.5:1; and first reduction was performed on the resulting mixture at 790° C. under a helium atmosphere for 10 h to obtain a first reduction product.

Slurrying was performed on the first reduction product with a hydrochloric acid liquid whose pH was 0.5 to obtain a slurry, wherein the liquid-to-solid ratio was 40:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.8; the slurry was filtered to obtain a solid phase; and the solid phase was washed at 45° C. with water and dried at 55° C. to obtain a $TiO_x$ intermediate powder.

(2) The $TiO_x$ intermediate powder and the titanium metal powder returned in step (3) were directly dry mixed by tumble at a mass ratio of 1:0.8 to obtain a mixed material, and the mixed material was sintered at 1200° C. under an argon atmosphere for 6 h to obtain a titanium-oxygen solid solution.

(3) Deep deoxidization was performed on the titanium-oxygen solid solution with a magnesium powder and a $MgCl_2$—KCl eutectic salt at 850° C. under a hydrogen-argon mixed atmosphere (where the volume fraction of hydrogen was 70%) for 2 h to obtain a deep deoxidization product, wherein the mass ratio of the magnesium powder to the titanium-oxygen solid solution was 0.3:1, and the mass ratio of the $MgCl_2$—KCl eutectic salt to the titanium-oxygen solid solution was 2:1.

Slurrying was performed on the deep deoxidization product with water to obtain a slurry, wherein the liquid-to-solid ratio was 5:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.6; the slurry was filtered to obtain a solid phase; and the solid phase was washed at 50° C. with water and dried at 40° C. to obtain a titanium metal powder.

Example E2

This example provides a method of preparing a titanium metal powder by reduction of titanium dioxide. The preparation method includes the following steps.

(1) A calcium-containing titanium source (a mixture of a calcium oxide and a calcined product obtained after the calcination of a calcium oxide and titanium dioxide mixed based on the stoichiometric ratio of $CaTiO_3$), an aluminum powder and anhydrous $CaCl_2$ were mixed, wherein the molar ratio of calcium in the calcium-containing titanium source to the aluminum powder was 0.6:1, the molar ratio of the aluminum powder to titanium in the calcium-containing titanium source was 1.22:1, and the mass ratio of anhydrous $CaCl_2$ to titanium in the calcium-containing titanium source based on $TiO_2$ was 3:1; and first reduction was performed on the resulting mixture at 1200° C. under an argon atmosphere for 0.25 h to obtain a first reduction product.

Slurrying was performed on the first reduction product with a hydrochloric acid liquid whose pH was 1.5 to obtain a slurry, wherein the liquid-to-solid ratio was 100:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 40° C. with water and dried at 0° C. to obtain a $TiO_x$ intermediate powder.

(2) The $TiO_x$ intermediate powder was ground into a slurry until the particle size of the $TiO_x$ intermediate powder in the slurry was 10 μm or less, the slurry and the titanium metal powder returned in step (3) were mixed, and the resulting mixture was stirred and dried to obtain a mixed material, wherein the mass ratio of the $TiO_x$ intermediate powder to the titanium metal powder was 1:4; and the mixed material was sintered at 800° C. under vacuum for 24 h to obtain a titanium-oxygen solid solution.

(3) Deep deoxidization was performed on the titanium-oxygen solid solution with calcium particles and anhydrous $CaCl_2$ at 900° C. under a hydrogen-argon mixed atmosphere (where the volume fraction of hydrogen was 30%) for 1 h to obtain a deep deoxidization product, wherein the mass ratio of the calcium particles to the titanium-oxygen solid solution was 0.08:1, and the mass ratio of anhydrous $CaCl_2$ to the titanium-oxygen solid solution was 0.05:1.

Slurrying was performed on the deep deoxidization product with a hydrochloric acid liquid whose pH was 1.0 to obtain a slurry, wherein the liquid-to-solid ratio was 20:1 mL/g; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 20° C. with water and dried at 45° C. to obtain a titanium metal powder.

Example E3

The preparation method of this example is the same as the preparation method of Example E1 except that the direct drying power mixing step in step (2) was replaced with the following steps: the $TiO_x$ intermediate powder and the titanium metal powder were mixed, crushed by ball milling, spray pelletized and sintered to obtain a nearly spherical titanium-oxygen solid solution.

The measurement and calculation results as well as the effects of the preceding examples and comparative examples are shown in Table 17 and Table 18.

TABLE 17

| | Value of x in $TiO_x$ intermediate powder | Oxygen content of the titanium-oxygen solid solution (wt %) | Oxygen content of titanium metal powder (wt %) | Aluminum consumed per ton of titanium metal powder | Magnesium or calcium consumed per ton of titanium metal powder | Reductant cost of per ton of titanium metal powder |
|---|---|---|---|---|---|---|
| Example E1 | 0.5 | 7.94 | 0.18 | 0.5625 | 0.6300 | 36,450 CNY |
| Example E2 | 0.17 | 1.193 | 0.15 | 0.6863 | 0.4167 | 32,480 CNY |

TABLE 18

| | Product obtained after the first wet treatment is performed on the first reduction product | Oxygen content of the titanium-oxygen solid solution (wt %) | Oxygen content of titanium metal powder (wt %) |
|---|---|---|---|
| Example E3 | $Ti_2O$, i.e., x = 0.5 | 7.94 | 0.12 |

"/" in the preceding tables indicates that there is no related data.

The following conclusions can be drawn from Tables 17 and 18.

(1) As can be seen from Examples E1 and E2, the method of preparing a titanium metal powder by reduction of titanium dioxide provided by the present disclosure can prepare a titanium metal powder having an oxygen content less than 0.3%, and the cost of the reductant can be reduced to 32,480 CNY per ton of titanium metal powder and is only 55% of the cost of the reductant in the magnesium reduction process.

(2) As can be seen from Examples E1 and E3, the manner of spray pelletizing and sintering is adopted in Example E3, and the oxygen content of the titanium metal powder can be further reduced compared with the oxygen content in Example E1.

Figure 6:
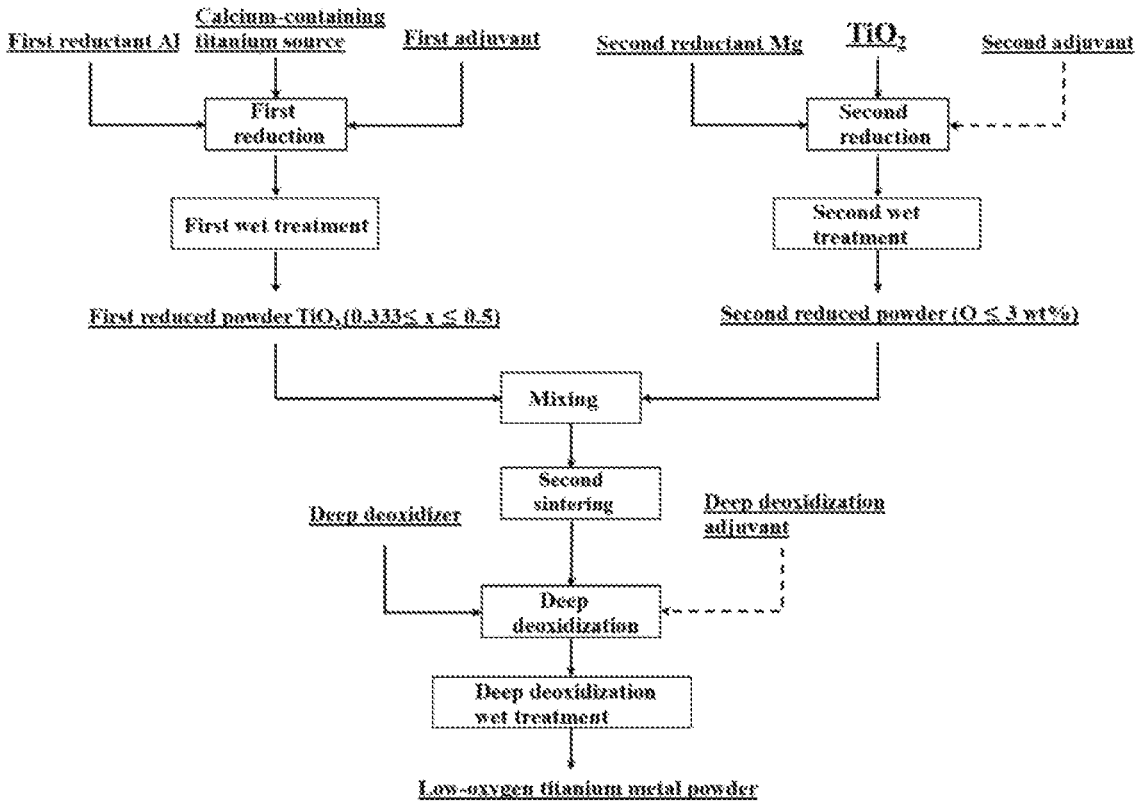
FIG. 6 is a flowchart of a method of preparing a low-oxygen titanium metal powder according to embodiment six of the present disclosure.

Embodiment six: The present disclosure provides a fourth scheme of preparing a titanium metal powder, that is, the present disclosure provides a method of preparing a low-oxygen titanium metal powder. As shown in FIG. 6, the preparation method includes the following steps.

(1) A calcium-containing titanium source, a first reductant and a first adjuvant are mixed, and first reduction is performed to obtain a reduced material, wherein the first reductant includes aluminum; and a first wet treatment is performed on the reduced material to obtain a first reduced powder, wherein the first reduced powder is $TiO_x$, and x is $0.333 \leq x \leq 0.5$.

(2) Second reduction is performed on titanium dioxide with a second reductant, and a second wet treatment is performed to obtain a second reduced powder having an oxygen content less than or equal to 3 wt %.

(3) The second reduced powder and a first reduced powder are mixed, and second sintering is performed to obtain a titanium-oxygen solid solution having an oxygen content less than or equal to 8 wt %; and deep deoxidization and a deep deoxidization wet treatment are performed on the titanium-oxygen solid solution with a deep deoxidizer to obtain a titanium metal powder, wherein the deep deoxidizer includes magnesium and/or calcium.

Example F1

This example provides a method of preparing a low-oxygen titanium metal powder.

The preparation method includes the following steps.

(1) A calcium-containing titanium source (a mixture of a calcium oxide and calcined titanium dioxide), an aluminum powder and a $CaCl_2$—KCl eutectic salt were mixed, wherein the molar ratio of calcium in the calcium-containing titanium source to the aluminum powder was 1.5:1, the molar ratio of the aluminum powder to titanium in the calcium-containing titanium source was 1.1:1, and the mass ratio of the $CaCl_2$—KCl eutectic salt to titanium in the calcium-containing titanium source based on $TiO_2$ was 0.5:1; and first reduction was performed on the resulting mixture at 1000° C. under a helium atmosphere for 6 h to obtain a first reduction product.

Slurrying was performed on the first reduction product with water to obtain a slurry, wherein the liquid-to-solid ratio was 70:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at room temperature and dried at 40° C. to obtain a first reduced powder.

Second reduction was performed on titanium dioxide with a magnesium powder and a $MgCl_2$—KCl eutectic salt at 700° C. under a helium atmosphere for 24 h to obtain a second reduction product, wherein the mass ratio of the magnesium powder to the titanium dioxide was 2.0:1, and the mass ratio of the $MgCl_2$—KCl eutectic salt to the titanium dioxide was 2.5:1.

Slurrying was performed on the second reduction product with water to obtain a slurry, wherein the liquid-to-solid ratio was 20:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.2; the slurry was filtered to obtain a solid phase; and the solid phase was washed at room temperature and dried at 48° C. to obtain a second reduced powder.

(2) The first reduced powder and the second reduced powder were mixed in a mass ratio of 1:1 and sintered at 1000° C. under vacuum for 12 h to obtain a titanium-oxygen solid solution.

(3) Deep deoxidization was performed on the titanium-oxygen solid solution with a magnesium powder and a $MgCl_2$—KCl eutectic salt at 650° C. under a hydrogen-argon mixed atmosphere (where the volume fraction of hydrogen was 95%) for 18 h to obtain a deep deoxidization product, wherein the mass ratio of the magnesium powder to the titanium-oxygen solid solution was 0.15:1, and the mass ratio of the $MgCl_2$—KCl eutectic salt to the titanium-oxygen solid solution was 2.0:1.

Slurrying was performed on the deep deoxidization product with a hydrochloric acid liquid whose pH was 0.5 to obtain a slurry, wherein the liquid-to-solid ratio was 25:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.5; the slurry was filtered to obtain a solid phase; and the solid phase was washed at 25° C. and dried at 40° C. to obtain a low-oxygen titanium metal powder.

Example F2

This example provides a method of preparing a low-oxygen titanium metal powder. The preparation method includes the following steps.

(1) A calcium-containing titanium source (a mixture of a calcium oxide and a calcined product obtained after the calcination of a calcium oxide and titanium dioxide mixed based on the stoichiometric ratio of $CaTiO_3$), an aluminum powder and anhydrous $CaCl_2$ were mixed, wherein the molar ratio of calcium in the calcium-containing titanium source to the aluminum powder was 0.6:1, the molar ratio of the aluminum powder to titanium in the calcium-containing titanium source was 1.0:1, and the mass ratio of anhydrous $CaCl_2$ to titanium in the calcium-containing titanium source based on $TiO_2$ was 3:1; and first reduction was performed on the resulting mixture at 1200° C. under vacuum for 24 h to obtain a first reduction product.

Slurrying was performed on the first reduction product with a hydrochloric acid liquid whose pH was 2.5 to obtain a slurry, wherein the liquid-to-solid ratio was 100:1 mL/g; pH adjustment was performed on the pH of the slurry, wherein the pH of the slurry was controlled to be greater than or equal to 1.0 during the pH adjustment, and the pH of the slurry after the pH adjustment was stabilized to 1.5; the slurry was filtered to obtain a solid phase; and the solid phase was washed at 45° C. and dried at 60° C. to obtain a first reduced powder.

Second reduction was performed on titanium dioxide with a magnesium powder and a $MgCl_2$—$CaCl_2$ eutectic salt at 600° C. under an argon atmosphere for 48 h to obtain a second reduction product, wherein the mass ratio of the magnesium powder to the titanium dioxide was 2:1, and the mass ratio of the $MgCl_2$—$CaCl_2$ eutectic salt to the titanium dioxide was 3:1.

Slurrying was performed on the second reduction product with a hydrochloric acid liquid whose pH was 0.5 to obtain a slurry, wherein the liquid-to-solid ratio was 100:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 0° C. and dried at 30° C. to obtain a second reduced powder.

(2) The first reduced powder and the second reduced powder were mixed in a mass ratio of 1:10 and sintered at 800° C. under an argon atmosphere for 24 h to obtain a titanium-oxygen solid solution.

(3) Deep deoxidization was performed on the titanium-oxygen solid solution with a calcium powder and anhydrous $CaCl_2$ at 1000° C. under an argon atmosphere for 24 h to obtain a deep deoxidization product, wherein the mass ratio of the calcium powder to the titanium-oxygen solid solution was 0.09:1, and the mass ratio of anhydrous $CaCl_2$ to the titanium-oxygen solid solution was 0.05:1.

Slurrying was performed on the deep deoxidization product with water to obtain a slurry, wherein the liquid-to-solid ratio was 100:1 mL/g; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 0° C. with water and dried at 45° C. to obtain a low-oxygen titanium metal powder.

Example F3

This example provides a method of preparing a low-oxygen titanium metal powder. The preparation method includes the following steps.

(1) A calcium-containing titanium source (a mixture of a calcium oxide and calcined titanium dioxide), an aluminum powder and a $CaCl_2$—LiCl eutectic salt were mixed, wherein the molar ratio of calcium in the calcium-containing titanium source to the aluminum powder was 2.0:1, the molar ratio of the aluminum powder to titanium in the calcium-containing titanium source was 1.22:1, and the mass ratio of the $CaCl_2$—LiCl eutectic salt to titanium in the calcium-containing titanium source based on $TiO_2$ was 0.05:1; and first reduction was performed on the resulting mixture at 800° C. under a helium atmosphere for 12 h to obtain a first reduction product.

Slurrying was performed on the first reduction product with a hydrochloric acid liquid whose pH was 1.0 to obtain a slurry, wherein the liquid-to-solid ratio was 80:1 mL/g; pH adjustment was performed on the pH of the slurry, wherein the pH of the slurry was controlled to be greater than or equal to 1.0 during the pH adjustment, and the pH of the slurry after the pH adjustment was stabilized to 3.0; the slurry was filtered to obtain a solid phase; and the solid phase was washed at 10° C. and dried at 50° C. to obtain a first reduced powder.

Second reduction was performed on titanium dioxide with a magnesium powder and a $MgCl_2$—KCl eutectic salt at 900° C. under a hydrogen atmosphere for 0.25 h to obtain a second reduction product, wherein the mass ratio of the magnesium powder to the titanium dioxide was 2.05:1, and the mass ratio of the $MgCl_2$—KCl eutectic salt to the titanium dioxide was 0.05:1.

Slurrying was performed on the second reduction product with a hydrochloric acid liquid whose pH was 0.8 to obtain a slurry, wherein the liquid-to-solid ratio was 20:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.5; the slurry was filtered to obtain a solid phase; and the solid phase was washed at 15° C. and dried at 20° C. to obtain a second reduced powder.

(2) The first reduced powder and the second reduced powder were mixed in a mass ratio of 1:0.267 and sintered at 1200° C. under a helium atmosphere for 0.25 h to obtain a titanium-oxygen solid solution.

(3) Deep deoxidization was performed on the titanium-oxygen solid solution with a calcium powder and a $CaCl_2$—$MgCl_2$ eutectic salt at 700° C. under a hydrogen atmosphere for 48 h to obtain a deep deoxidization product, wherein the mass ratio of the calcium powder to the titanium-oxygen solid solution was 0.25:1, and the mass ratio of the $CaCl_2$—$MgCl_2$ eutectic salt to the titanium-oxygen solid solution was 3:1.

Slurrying was performed on the deep deoxidization product with a hydrochloric acid liquid of water to obtain a slurry, wherein the liquid-to-solid ratio was 80:1 mL/g; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 0° C. and dried at 30° C. to obtain a low-oxygen titanium metal powder.

Example F4

This example provides a method of preparing a low-oxygen titanium metal powder. The preparation method includes the following steps.

(1) A calcium-containing titanium source (a mixture of a calcium oxide and titanium dioxide which were weighted in a ratio exceeding the stoichiometric ratio based on $CaTiO_3$, mixed and calcined), an aluminum powder and a $CaCl_2$—KCl eutectic salt were mixed, wherein the molar ratio of calcium in the calcium-containing titanium source to the aluminum powder was 1.5:1, the molar ratio of the aluminum powder to titanium in the calcium-containing titanium source was 1.15:1, and the mass ratio of the $CaCl_2$—KCl eutectic salt to titanium in the calcium-containing titanium source based on $TiO_2$ was 2.2:1; and first reduction was performed on the resulting mixture at 1000° C. under vacuum for 20 h to obtain a first reduction product.

Slurrying was performed on the first reduction product with a hydrochloric acid liquid whose pH was 1.0 to obtain a slurry, wherein the liquid-to-solid ratio was 40:1 mL/g; pH adjustment was performed on the pH of the slurry, wherein the pH of the slurry was controlled to be greater than or equal to 1.0 during the pH adjustment, and the pH of the slurry after the pH adjustment was stabilized to 2.5; the slurry was filtered to obtain a solid phase; and the solid phase was washed at 20° C. and dried at 45° C. to obtain a first reduced powder.

Second reduction was performed on titanium dioxide with a magnesium powder and a $MgCl_2$—KCl eutectic salt at 700° C. under a hydrogen atmosphere for 3 h to obtain a second reduction product, wherein the mass ratio of the magnesium powder to the titanium dioxide was 2.1:1, and the mass ratio of the $MgCl_2$—KCl eutectic salt to the titanium dioxide was 1.5:1.

Slurrying was performed on the second reduction product with a hydrochloric acid liquid whose pH was 1.0 to obtain a slurry, wherein the liquid-to-solid ratio was 15:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.8; the slurry was filtered to obtain a solid phase; and the solid phase was washed at 25° C. and dried at 20° C. to obtain a second reduced powder.

(2) The first reduced powder and the second reduced powder were mixed in a mass ratio of 1:3 and sintered at 900° C. under an argon atmosphere for 12 h to obtain a titanium-oxygen solid solution.

(3) Deep deoxidization was performed on the titanium-oxygen solid solution with a magnesium powder and a $MgCl_2$—KCl eutectic salt at 900° C. under a pure hydrogen atmosphere for 3 h to obtain a deep deoxidization product, wherein the mass ratio of the magnesium powder to the titanium-oxygen solid solution was 0.1:1, and the mass ratio of the $MgCl_2$—KCl eutectic salt to the titanium-oxygen solid solution was 3:1.

Slurrying was performed on the deep deoxidization product with a hydrochloric acid liquid of water to obtain a slurry, wherein the liquid-to-solid ratio was 80:1 mL/g; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at 0° C. and dried at 55° C. to obtain a low-oxygen titanium metal powder.

Example F5

The preparation method of this example is the same as the preparation method of Example F1 except that the first reduced powder and the second reduced powder were mixed in a mass ratio of 1:0.1 in step (2).

Example F6

The preparation method of this example is the same as the preparation method of Example F1 except that the first reduced powder and the second reduced powder were mixed in a mass ratio of 1:14 in step (2).

The measurement and calculation results as well as the effects of the preceding examples are shown in Tables 19 and 20.

TABLE 19

| | Value of x in $TiO_x$ intermediate powder | Oxygen content of second reduced powder (wt %) | Oxygen content of the titanium-oxygen solid solution (wt %) | Oxygen content of titanium metal powder (wt %) | Aluminum consumed per ton of titanium metal powder | Calcium consumed per ton of titanium metal powder | Magnesium consumed per ton of titanium metal powder | Reductant cost of per ton of titanium metal powder |
|---|---|---|---|---|---|---|---|---|
| Example F1 | 0.38 | 2.10 | 6.67 | 0.11 | 0.294 | 0 | 0.685 | 33,280 CNY |
| Example F2 | 0.50 | 1.98 | 3.10 | 0.08 | 0.045 | 0.0929 | 0.9196 | 41,865 CNY |
| Example F3 | 0.333 | 0.51 | 8.00 | 0.09 | 0.535 | 0.272 | 0.236 | 32,380 CNY |
| Example F4 | 0.36 | 1.22 | 3.60 | 0.16 | 0.150 | 0 | 0.9106 | 39,420 CNY |

TABLE 20

| | Product obtained after the first wet treatment is performed on the first reduction product | Oxygen content of second reduced powder (wt %) | Oxygen content of the titanium-oxygen solid solution (wt %) | Oxygen content of titanium metal powder (wt %) |
|---|---|---|---|---|
| Example F5 | Mixture of $Ti_2O$ and $Ti_3O$, with an average chemical formula of $TiO_{0.38}$ | 2.10 | 8, which is beyond expectation | / |
| Example F6 | Mixture of $Ti_2O$ and $Ti_3O$, with an average chemical formula of $TiO_{0.38}$ | 2.10 | 2.71 | 0.10 |

"/" in the preceding tables indicates that there is no related data.

The following conclusions can be drawn from Table 19 and Table 20.

(1) As can be seen from Examples F1 to F4, the method of preparing a titanium metal powder provided by the present disclosure can prepare a titanium metal powder having an oxygen content less than 0.200 while such a low oxygen content cannot be achieved through the simple reduction of titanium dioxide with magnesium, and the cost of the reductant is reduced by more than 20% compared with the cost of the reductant in the full-magnesium reduction process.

(2) As can be seen from Example F1, Example F5 and Example F6, in Example F5, the mass ratio of the first reduced powder and the second reduced powder is 1:0.1, the oxygen content of the titanium-oxygen solid solution thus exceeds the expected 8 wt %, the subsequent sintering effect is poor, and the expected low-oxygen titanium metal powder cannot be achieved after the reduction; in Example F6, the amount of the second reduced powder used is high, the amount of the reductant Mg used is thus significantly increased, and the effect of reducing the cost of the reductant cannot be achieved. Therefore, in the present disclosure, by controlling the mass ratio of the first reduced powder and the second reduced powder within a specific range, the oxygen content can be better controlled, and the cost of the reductant can be reduced.

Figure 7:
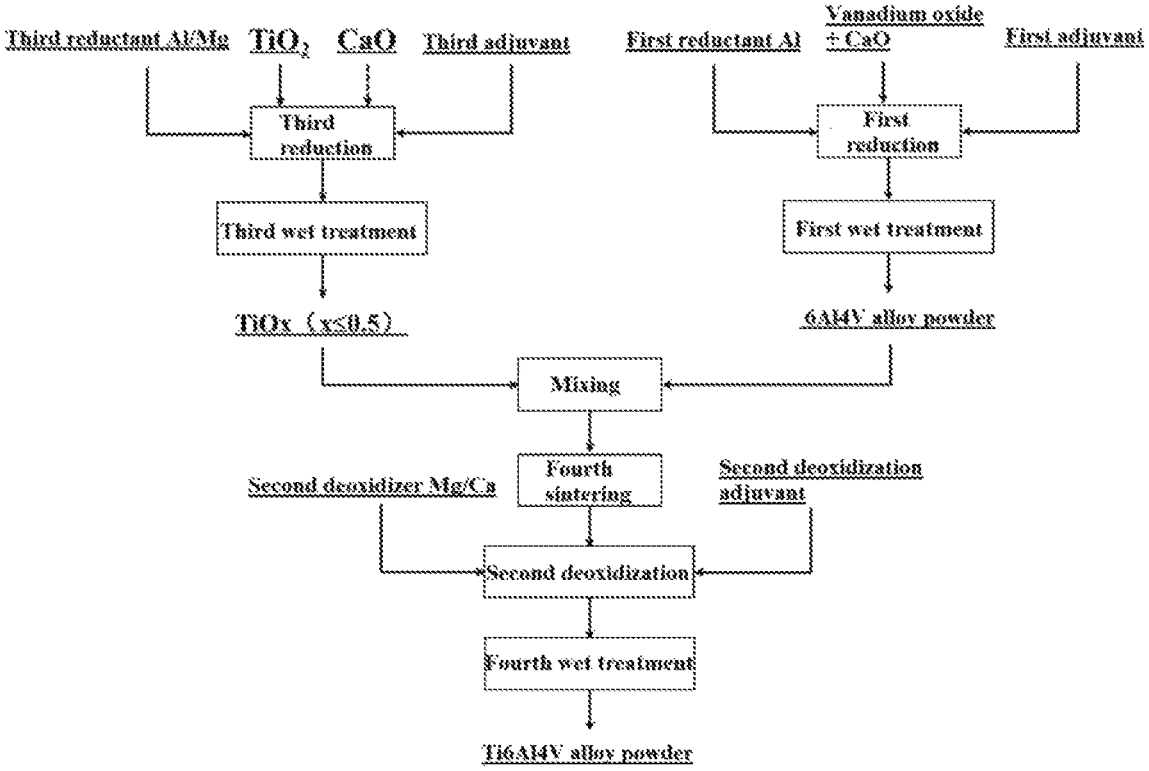
FIG. 7 is a flowchart of a method of preparing a Ti6Al4V alloy powder according to embodiment seven of the present disclosure.

Embodiment seven: The present disclosure provides a method of preparing a Ti6Al4V alloy powder. As shown in FIG. 7, the preparation method includes the following steps.

(1) First reduction is performed on a mixture of a vanadium oxide and a calcium oxide with a first reductant and a first adjuvant to obtain a first reduced material, and a first wet treatment is performed on the first reduced material to obtain a 6Al4V alloy powder, wherein the mass ratio of vanadium to aluminum in the 6Al4V alloy powder is (3.5 to 4.5):(5.5 to 6.75), and the first reductant includes aluminum.

Third reduction is performed on titanium dioxide with a third reductant to obtain a third reduced material, and a third wet treatment is performed on the third reduced material to obtain a third reduced powder, wherein a calcium oxide is added in the third reduction, the third reduced powder is $TiO_x$, and x is less than or equal to 0.5.

(2) The 6Al4V alloy powder and the third reduced powder are mixed, fourth sintering is performed on resulting mixture to obtain an oxygen-containing Ti6Al4V alloy powder, second deoxidization is performed on the oxygen-containing Ti6Al4V alloy powder with a second deoxidizer and a second deoxidization adjuvant, and a fourth wet treatment is performed to obtain a Ti6Al4V alloy powder.

Example G1

This example provides a method of preparing a Ti6Al4V alloy powder. The preparation method includes the following steps.

(1) Third reduction was performed on titanium dioxide with a third reductant aluminum (fragmental), a third adjuvant $CaCl_2$—KCl eutectic salt and a calcium oxide at 1200° C. under an argon atmosphere for 10 h to obtain a third reduced material, wherein the molar ratio of aluminum to titanium dioxide was 1.02:1, the molar ratio of the calcium oxide to aluminum was 0.8:1, and the mass ratio of the $CaCl_2$—KCl eutectic salt to titanium dioxide was 2.5:1.

Slurrying was performed on the third reduced material with a hydrochloric acid liquid whose pH was 0.5 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 2.2; the slurry was filtered to obtain a solid phase; and the solid phase was washed at 45° C. and dried at 55° C. under vacuum to obtain a third reduced powder $TiO_x$.

A vanadium oxide (where the molar ratio of vanadium trioxide to vanadium pentoxide was 2:3), a calcium oxide, an aluminum powder and a $CaCl_2$—KCl eutectic salt were mixed, wherein the molar ratio of the aluminum powder to the vanadium oxide was 42.33:5, the molar ratio of the calcium oxide to the aluminum powder was 1.5:1, and the mass ratio of the $CaCl_2$—KCl eutectic salt to the vanadium oxide was 2.5:1; and first reduction was performed on the resulting mixture at 800° C. under a helium atmosphere for 10 h to obtain a first reduced material.

Slurrying was performed on the first reduced material with water to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 2.5; the slurry was filtered to obtain a solid phase; and the solid phase was washed at 25° C. and dried at 45° C. under vacuum to obtain a 6Al4V alloy powder.

(2) The third reduced powder $TiO_x$ and the 6Al4V alloy powder were mixed, crushed by ball milling, spray-pelletized, and sintered at 1200° C. under vacuum for 12 h to obtain an oxygen-containing Ti6Al4V alloy powder. Second deoxidization was performed on the oxygen-containing Ti6Al4V alloy powder with magnesium (granular) as a second deoxidizer at 740° C. under a hydrogen-argon mixed atmosphere (where the volume fraction of hydrogen was 65%) for 12 h to obtain a second deoxidization product, wherein the mass ratio of the oxygen-containing Ti6Al4V alloy powder to the second deoxidizer was 1:0.4, anhydrous $MgCl_2$ was added in the second deoxidization, and the mass ratio of anhydrous $MgCl_2$ to the oxygen-containing Ti6Al4V alloy powder was 2:1.

Slurrying was performed on the second deoxidization product with a hydrochloric acid liquid whose pH was 0.8 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 40° C. and dried at 50° C. under vacuum to obtain a Ti6Al4V alloy powder.

Figure 8:
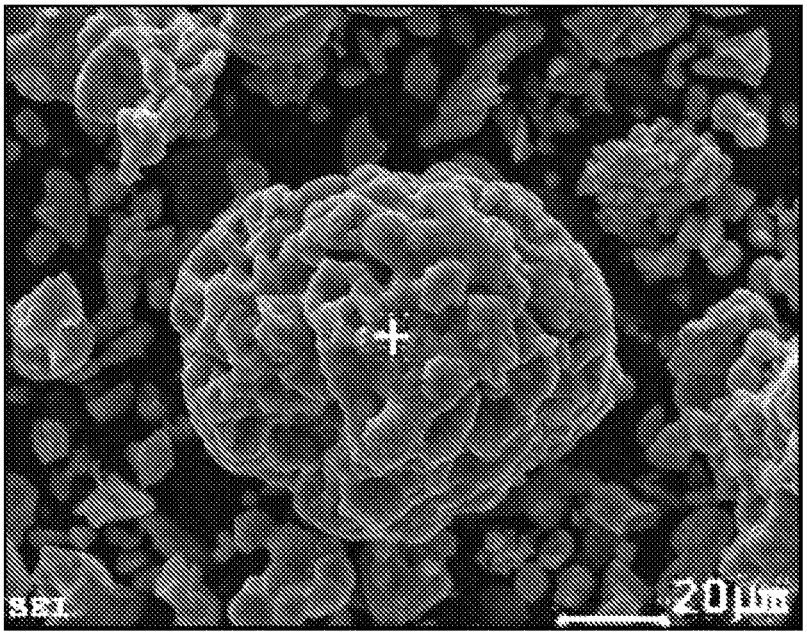
FIG. 8 is a scanning electron microscopy (SEM) diagram of a Ti6Al4V alloy powder prepared by first reduction according to embodiment G1 of the present disclosure.
Figure 9:
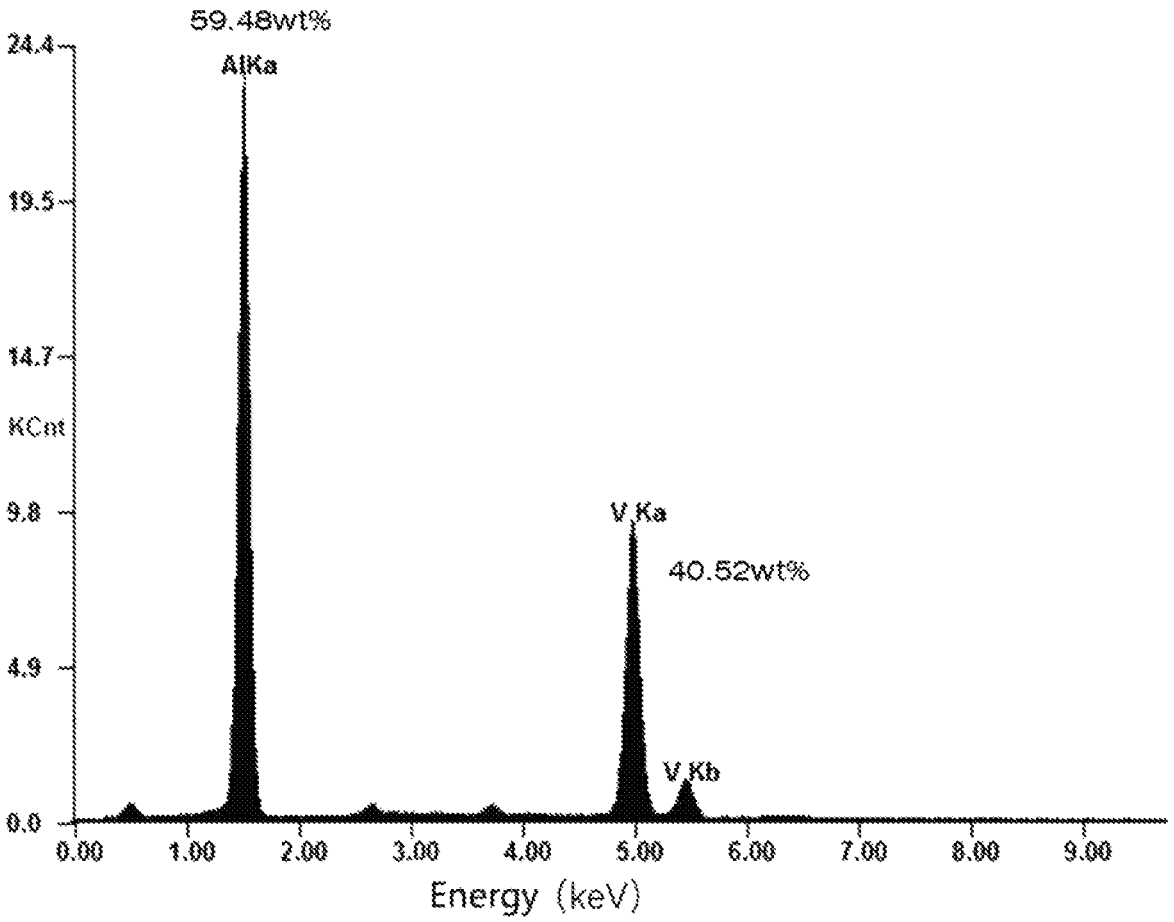
FIG. 9 is an element content analysis diagram of FIG. 8 by spot scanning.

The SEM diagram of the 6Al4V alloy powder obtained after the first reduction of this example is shown in FIG. 8. As can be seen from FIG. 8, the 6Al4V alloy powder is spherical. As can be seen from FIG. 9, the mass fraction of A1 is 59.48 wt %, and the mass fraction of V is 40.52 wt %, which accords with the compositions of the 6Al4V alloy powder.

Example G2

This example provides a method of preparing a Ti6Al4V alloy powder. The preparation method includes the following steps.

(1) Third reduction was performed on titanium dioxide with a third reductant magnesium (granular) and a third adjuvant $MgCl_2$—NaCl eutectic salt at 900° C. under an argon atmosphere for 2 h to obtain a third reduced material, wherein the molar ratio of magnesium to titanium dioxide was 4:1, and the mass ratio of the $MgCl_2$—NaCl eutectic salt to titanium dioxide was 2.5:1.

Slurrying was performed on the third reduced material with a hydrochloric acid liquid whose pH was 1.0 to obtain a slurry; pH adjustment was performed on the pH of the slurry, wherein the pH of the slurry was controlled to be greater than or equal to 1.0 during the pH adjustment, and the pH of the slurry after the pH adjustment was stabilized to 1.5; the slurry was filtered to obtain a solid phase; and the solid phase was washed at 40° C. and dried at 60° C. under vacuum to obtain a third reduced powder $TiO_x$.

A vanadium oxide (where the molar ratio of vanadium trioxide to vanadium pentoxide was 1:3), a calcium oxide, an aluminum powder and anhydrous $CaCl_2$ were mixed, wherein the molar ratio of the aluminum powder to the vanadium oxide was 34.68:4, the molar ratio of the calcium oxide to the aluminum powder was 2:1, and the mass ratio of anhydrous $CaCl_2$ to the vanadium oxide was 0.05:1; and first reduction was performed on the resulting mixture at 1400° C. under an argon atmosphere for 0.25 h to obtain a first reduced material.

Slurrying was performed on the first reduced material with water to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 0° C. and dried at 40° C. under vacuum to obtain a 6Al4V alloy powder.

(2) The third reduced powder $TiO_x$ and the 6Al4V alloy powder were mixed, crushed by ball milling, spray-pelletized, and sintered at 900° C. under a helium atmosphere for 20 h to obtain an oxygen-containing Ti6Al4V alloy powder. Second deoxidization was performed on the oxygen-containing Ti6Al4V alloy powder with magnesium (fragmental) as a second deoxidizer at 650° C. under a pure hydrogen atmosphere for 48 h to obtain a second deoxidization product, wherein the mass ratio of the oxygen-containing Ti6Al4V alloy powder to the second deoxidizer was 1:0.1, a $MgCl_2$—KCl eutectic salt was added in the second deoxidization, and the mass ratio of the $MgCl_2$—KCl eutectic salt to the oxygen-containing Ti6Al4V alloy powder was 3:1.

Slurrying was performed on the second deoxidization product with a hydrochloric acid liquid whose pH was 1.8 to obtain a slurry; pH adjustment was performed on the pH of the slurry, wherein the pH of the slurry was controlled to be greater than or equal to 1.2 during the pH adjustment, and the pH of the slurry after the pH adjustment was stabilized to 3.0; the slurry was filtered to obtain a solid phase; and the solid phase was washed at 0° C. and dried at 40° C. under vacuum to obtain a Ti6Al4V alloy powder.

Example G3

This example provides a method of preparing a Ti6Al4V alloy powder. The preparation method includes the following steps.

(1) Third reduction was performed on titanium dioxide with a third reductant magnesium (granular) and a third adjuvant $MgCl_2$—$CaCl_2$ eutectic salt at 700° C. under a hydrogen atmosphere for 10 h to obtain a third reduced material, wherein the molar ratio of magnesium to titanium dioxide was 2.5:1, and the mass ratio of the $MgCl_2$—$CaCl_2$ eutectic salt to titanium dioxide was 0.1:1.

Slurrying was performed on the third reduced material with a hydrochloric acid liquid whose pH was 2.5 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 1.5; the slurry was filtered to obtain a solid phase; and the solid phase was washed at 30° C. and dried at 55° C. under vacuum to obtain a third reduced powder $TiO_x$.

A vanadium oxide (vanadium pentoxide), a calcium oxide, an aluminum powder and a $CaCl_2$—NaCl eutectic salt were mixed, wherein the molar ratio of the aluminum powder to the vanadium oxide was 9.0:1, the molar ratio of the calcium oxide to the aluminum powder was 0.6:1, and the mass ratio of the $CaCl_2$—NaCl eutectic salt to the vanadium oxide was 3.0:1; and first reduction was performed on the resulting mixture at 1400° C. under an argon atmosphere for 0.25 h to obtain a first reduced material.

Slurrying was performed on the first reduced material with water to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 3.0; the slurry was filtered to obtain a solid phase; and the solid phase was washed at 15° C. and dried at 40° C. under vacuum to obtain a 6Al4V alloy powder.

(2) The third reduced powder $TiO_x$ and the 6Al4V alloy powder were mixed, crushed by stirred milling, tumble-pelletized, and sintered at 900° C. under an argon atmosphere for 24 h to obtain an oxygen-containing Ti6Al4V alloy powder. Second deoxidization was performed on the oxygen-containing Ti6Al4V alloy powder with calcium (powdery) as a second deoxidizer at 900° C. under a helium atmosphere for 12 h to obtain a second deoxidization product, wherein the mass ratio of the oxygen-containing Ti6Al4V alloy powder to the second deoxidizer was 1:0.15, anhydrous $CaCl_2$ was added in the second deoxidization, and the mass ratio of anhydrous $CaCl_2$ to the oxygen-containing Ti6Al4V alloy powder was 3:1.

Slurrying was performed on the second deoxidization product with a hydrochloric acid liquid whose pH was 0.5 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at 25° C. and dried at 55° C. under vacuum to obtain a Ti6Al4V alloy powder.

Example G4

This example provides a method of preparing a Ti6Al4V alloy powder. The preparation method includes the following steps.

(1) Third reduction was performed on titanium dioxide with a third reductant aluminum (powdery), a third adjuvant $CaCl_2$—LiCl eutectic salt and a calcium oxide at 1400° C. under a helium atmosphere for 0.25 h to obtain a third reduced material, wherein the molar ratio of aluminum to titanium dioxide was 1.33:1, the molar ratio of the calcium oxide to aluminum was 0.6:1, and the mass ratio of the $CaCl_2$—LiCl eutectic salt to titanium dioxide was 3:1.

Slurrying was performed on the third reduced material with a hydrochloric acid liquid whose pH was 2.5 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 2.0; the slurry was filtered to obtain a solid phase; and the solid phase was washed at 25° C. and dried at 55° C. under vacuum to obtain a third reduced powder $TiO_x$.

A vanadium oxide (vanadium trioxide), a calcium oxide, aluminum (granular) and a $CaCl_2$—LiCl eutectic salt were mixed, wherein the molar ratio of aluminum to the vanadium oxide was 7.666:1, the molar ratio of the calcium oxide to aluminum was 1.2:1, and the mass ratio of the $CaCl_2$—LiCl eutectic salt to the vanadium oxide was 2.2:1; and first reduction was performed on the resulting mixture at 1000° C. under a helium atmosphere for 15 h to obtain a first reduced material.

Slurrying was performed on the first reduced material with a hydrochloric acid whose pH was 1.0 to obtain a slurry; pH adjustment was performed on the pH of the slurry, wherein the pH of the slurry was controlled to be greater than or equal to 0.8 during the pH adjustment, and the pH of the slurry after the pH adjustment was stabilized to 2.3; the slurry was filtered to obtain a solid phase; and the solid phase was washed at 10° C. and dried at 45° C. under vacuum to obtain a 6Al4V alloy powder.

(2) The third reduced powder $TiO_x$ and the 6Al4V alloy powder were mixed, crushed by tumble milling, compact-pelletized, and sintered at 1000° C. under a hydrogen atmosphere for 20 h to obtain an oxygen-containing Ti6Al4V alloy powder. Second deoxidization was performed on the oxygen-containing Ti6Al4V alloy powder with calcium (granular) as a second deoxidizer at 700° C. under a hydrogen atmosphere for 24 h to obtain a second deoxidization product, wherein the mass ratio of the oxygen-containing Ti6Al4V alloy powder to the second deoxidizer was 1:0.8, a $CaCl_2$—KCl eutectic salt was added in the second deoxidization, and the mass ratio of the $CaCl_2$—KCl to the oxygen-containing Ti6Al4V alloy powder was 1.3:1.

Slurrying was performed on the second deoxidization product with a hydrochloric acid liquid whose pH was 0.8 to obtain a slurry; pH adjustment was performed on the pH of the slurry, wherein the pH of the slurry was controlled to be greater than or equal to 0.9 during the pH adjustment, and the pH of the slurry after the pH adjustment was stabilized to 2.2; the slurry was filtered to obtain a solid phase; and the solid phase was washed at 20° C. and dried at 50° C. under vacuum to obtain a Ti6Al4V alloy powder.

Example G5

The preparation method of this example is the same as the preparation method of Example G1 except that the temperature of sintering in step (2) was 1600° C.

Example G6

The preparation method of this example is the same as the preparation method of Example G1 except that the temperature of sintering in step (2) was 700° C.

Comparative Example G1

The preparation method of this example is the same as the preparation method of Example G1 except that sintering was not performed in step (2).

Comparative Example G2

The preparation method of this example is the same as the preparation method of Example G1 except that the second deoxidization and fourth wet treatment were not performed in step (2).

The measurement results are shown in Table 21.

TABLE 21

| | x in third reduced powder $TiO_x$ | V/Al mass ratio in 6Al4V alloy powder | 6Al4V alloy powder | | | |
|---|---|---|---|---|---|---|
| | | | Purity | Oxygen content | Particle size range | Ti:Al:V mass ratio |
| Example G1 | approximately 0.5 | 3.98:6.02 | 99.88% | 0.09% | 20 to 106 μm | 90:6.02:3.98 |
| Example G2 | 0.077 | 3.98:6.04 | 99.90% | 0.07% | 20 to 106 μm | 89.98:6.04:3.98 |
| Example G3 | 0.036 | 4.01:5.98 | 99.92% | 0.05% | 45 to 300 to μm | 90.01:5.98:4.01 |
| Example G4 | 0.167 | 4.01:5.99 | 99.89% | 0.08% | 100 to 500 μm | 90.00:5.99:4.01 |
| Example G5 | approximately 0.5 | 3.98:6.02 | 99.88% | 0.09% | 20 to 106 μm | 90:6.02:3.98 |
| Example G6 | approximately 0.5 | 3.98:6.02 | 98.00% | 1.95% | 20 to 106 μm | 90:6.02:3.98 |
| Comparative Example G1 | approximately 0.5 | 3.98:6.02 | Fully alloyed Ti6Al4V cannot be obtained without sintering before the second deoxidization | | | |
| Comparative Example G2 | approximately 0.5 | 3.98:6.02 | 84.5% | 15.5% | 20 to 106 μm | 90:6.02:3.98 |

The following conclusions can be drawn from Table 20.

(1) As can be seen from Examples G1 to G4, the method of preparing a Ti6Al4V alloy powder provided by the present disclosure can prepare a Ti6Al4V alloy powder whose purity is 99.8 wt % and above, oxygen content is less than or equal to 0.1 wt % and particle size range can be effectively controlled, and the mass ratio of Ti:Al:V in the final product meets the requirements.

(2) As can be seen from Example G1, Example G5, Example G6 and Comparative Example G1, when the sintering temperature is too high, the oxygen content in the Ti6Al4V alloy powder is barely reduced, the energy consumption becomes too high, and the requirements for the equipment accordingly becomes stringent; in Example G6, since the sintering temperature is only 700° C., the purity of the product is only 98.00 wt %, and the oxygen content is as high as 1.95 wt %; in Comparative Example G1, since sintering is not performed, the fully alloyed Ti6Al4V cannot be obtained. Therefore, in the present disclosure, titanium, aluminum and vanadium can be fully alloyed by sintering, and the sintering temperature is preferably controlled within a specific range, thereby guaranteeing the purity of the Ti6Al4V alloy powder.

It is to be noted that the above are only the embodiments of the present disclosure and are not intended to limit the scope of the present disclosure. Those skilled in the art should understand that any modifications or substitutions easily conceivable by those skilled in the art within the scope of the present disclosure fall within the protection scope and the disclosed scope of the present disclosure.

What is claimed is:

1. A method of controllably reducing an oxygen content, comprising the following steps:

(1) mixing a raw material, a calcium source, a first reductant and a first adjuvant, and performing first reduction to obtain a reduced material; wherein the raw material is a vanadium oxide or a titanium source, and the first reductant comprises aluminum; and (2) performing a first wet treatment on the reduced material to obtain a first reduced powder;

wherein when the raw material is the titanium source, the first reduced powder is $TiO_x$, wherein a value range of x in $TiO_x$ is $0.167 \leq x \leq 1$;

or when the raw material is the vanadium oxide, the first reduced powder is a $VAl_y$ alloy, wherein a value range of y is $0.20 \leq y \leq 5.80$;

wherein when the raw material is the titanium source, the mixing in step (1) comprises:

performing first mixing on the titanium source and the calcium source to obtain a calcium-containing titanium source, and performing second mixing on the calcium-containing titanium source, the first reductant and the first adjuvant;

a molar ratio of calcium in the calcium-containing titanium source to the first reductant is 0.6:1 to 2:1;

a molar ratio of the first reductant to titanium in the calcium-containing titanium source is 0.67:1 to 1.33:1; and a mass ratio of the first adjuvant to titanium in the titanium source based on $TiO_2$ is 0.05:1 to 3:1.

2. The method according to claim 1, wherein a temperature of the first reduction is 700° C. to 1400° C.;

a time of the first reduction is 0.25 h to 24 h;

an atmosphere of the first reduction comprises vacuum or a protective atmosphere;

the protective atmosphere comprises any one or a combination of at least two of argon, hydrogen or helium;

the first adjuvant comprises any one or a combination of at least two of anhydrous $CaCl_2$), a $CaCl_2$)—KCl eutectic salt, a $CaCl_2$)—NaCl eutectic salt or a $CaCl_2$)—$AlCl_3$ eutectic salt.

3. The method according to claim 1, wherein the vanadium oxide in step (1) comprises $V_2O_3$ and/or $V_2O_5$;

when the raw material is the vanadium oxide, a molar ratio of the first reductant to the vanadium oxide is $(2a_y+2b_y+10b/3+2a):(a+b)$, wherein y is a value of y in the $VAl_y$ alloy, a/(a+b) is a molar ratio of $V_2O_3$ in the vanadium oxide, and b/(a+b) is a molar ratio of $V_2O_5$ in the vanadium oxide;

the calcium source is a calcium oxide;

a molar ratio of the calcium oxide to the first reductant is 0.6:1 to 2:1;

a mass ratio of the first adjuvant to the vanadium oxide is 0.05:1 to 3:1;

when the raw material is the vanadium oxide, the method further comprises: (3) performing first deoxidization on the $VAl_y$ alloy with a first deoxidizer to obtain a first deoxidized material, wherein the first deoxidizer comprises calcium; and (4) performing a wet treatment on the first deoxidized material to obtain a $VAl_y$ alloy with a low oxygen content.

4. The method according to claim 1, wherein the first wet treatment comprises:

performing first slurrying on the reduced material with water to obtain a first slurry;

performing first pH adjustment on a pH of the first slurry with a hydrochloric acid, and performing solid-liquid separation to obtain a first liquid phase solution and a first solid phase; performing second slurrying on the first solid phase with water and/or an acid liquid to obtain a second slurry; performing second pH adjustment on a pH of the second slurry with a hydrochloric acid, and performing solid-liquid separation to obtain a second liquid phase and a second solid phase; and washing and drying the second solid phase to obtain the first reduced powder; or the first wet treatment comprises: performing third slurrying on the reduced material with water and/or an acid liquid to obtain a third slurry, performing third pH adjustment on a pH of the third slurry, performing solid-liquid separation to obtain a third solid phase, and washing and drying the third solid phase to obtain the first reduced powder;

$(NH_4)_2CO_3$ and the first liquid phase solution are mixed and react, or $NH_4HCO_3$, ammonia and the first liquid phase solution are mixed and react, and solid-liquid separation is performed after reacting to obtain a $CaCO_3$ solid and a $NH_4Cl$ solution;

$CaCO_3$ is returned and used in step (1) as the calcium source for the first reduction;

a liquid-to-solid ratio of the first slurrying is 2:1 mL/g to 20:1 mL/g;

the first pH adjustment is performed with the hydrochloric acid to adjust the pH to 5.0 to 6.0;

the second pH adjustment is performed with the hydrochloric acid to adjust the pH to 1.0 to 3.0;

a temperature of the washing is 0° C. to 60° C.;

a temperature of the drying is less than or equal to 60° C.;

the second liquid phase is a mixed solution of $AlCl_3$μ-$CaCl_2$);

the mixed solution of $AlCl_3$—$CaCl_2$) is used for preparing a polyaluminium chloride product;

the pH of the third slurry is controlled to be greater than or equal to 0.8 during the third pH adjustment;

the pH of the third slurry after the third pH adjustment is 1.5 to 3.0.

5. A method of preparing a titanium metal powder by reduction, wherein a first reduced powder used in the method of preparing the titanium metal powder by reduction is prepared by the method of controllably reducing an oxygen content according to claim 1.

6. The method of preparing a titanium metal powder by reduction according to claim 5, wherein the method comprises four independent schemes, and a method in a first scheme comprises: performing deep deoxidization and a deep deoxidization wet treatment on the first reduced powder with a deep deoxidizer to obtain a titanium metal powder, wherein the deep deoxidizer comprises magnesium and/or calcium, the first reduced powder is $TiO_x$, wherein, x is $0.167 \leq x \leq 0.5$;

or, a method in a second scheme comprises: performing second reduction on the first reduced powder with a second reductant, and performing a second wet treatment to obtain a second reduced powder having an oxygen content less than or equal to 2 wt %, wherein the second reductant comprises magnesium; and performing deep deoxidization and a deep deoxidization wet treatment on the second reduced powder with a deep deoxidizer to obtain a titanium metal powder, wherein the deep deoxidizer comprises magnesium and/or calcium, the first reduced powder is $TiO_x$, wherein, x is $0.167 < x \leq 1$;

or, a method in a third scheme comprises: mixing the first reduced powder and a titanium metal powder partially returned to obtain a mixed material, performing first sintering on the mixed material to obtain a titanium-oxygen solid solution having an oxygen content less than or equal to 8 wt %, and performing deep deoxidization and a deep deoxidization wet treatment on the titanium-oxygen solid solution with a deep deoxidizer to obtain a titanium metal powder, wherein the deep deoxidizer comprises magnesium and/or calcium, the first reduced powder is $TiO_x$, wherein, x is $0.333 \leq x \leq 0.5$;

or, a method in a fourth scheme comprises: performing second reduction on titanium dioxide with a second reductant, and performing a second wet treatment to obtain a second reduced powder having an oxygen content less than or equal to 3 wt %; mixing the second reduced powder and & the first reduced powder, and performing second sintering to obtain a titanium-oxygen solid solution having an oxygen content less than or equal to 8 wt %; and performing deep deoxidization and a deep deoxidization wet treatment on the titanium-oxygen solid solution with a deep deoxidizer to obtain a titanium metal powder, wherein the deep deoxidizer comprises magnesium and/or calcium, the first reduced powder is $TiO_x$, wherein, x is $0.333 \leq x \leq 0.5$.

7. The method of preparing a titanium metal powder by reduction according to claim 6, further comprising: performing third sintering or a melting solidification treatment on the first reduced powder between the first wet treatment and the deep deoxidization in the first scheme;

a temperature of the third sintering is 1000° C. to 1500° C.;

a time of the third sintering is 0.25 h to 24 h;

a manner of the melting solidification treatment comprises electromagnetic induction smelting.

8. The method of preparing a titanium metal powder by reduction according to claim 6, wherein the second wet treatment and the deep deoxidization wet treatment each independently comprise: performing fourth slurrying on a product obtained after the second reduction or the deep deoxidization with water and/or an acid liquid to obtain a fourth slurry; performing fourth pH adjustment on a pH of the fourth slurry, and performing solid-liquid separation to obtain a fourth solid phase; and washing and drying the fourth solid phase to obtain a product;

a pH of the acid liquid in the second wet treatment and the deep deoxidization wet treatment is each independently greater than or equal to 0.5;

preferably, an acid used in the fourth pH adjustment in the second wet treatment and the deep deoxidization wet treatment is a hydrochloric acid;

a pH of a slurry in the fourth pH adjustment in the second wet treatment and the deep deoxidization wet treatment is controlled to be greater than or equal to 0.8;

preferably, the pH of the fourth slurry after the fourth pH adjustment in the second wet treatment and the deep deoxidization wet treatment is 1.5 to 3.0;

a temperature of the washing in the second wet treatment and the deep deoxidization wet treatment is 0° C. to 60° C.; and a temperature of the drying in the second wet treatment and the deep deoxidization wet treatment is less than or equal to 60° C.

9. The method of preparing a titanium metal powder by reduction according to claim 6, wherein a mass ratio of the second reductant to the first reduced powder in the second scheme is 0.09:1 to 0.56:1; or a molar ratio of the second reductant to titanium dioxide in the fourth scheme is 2:1 to 4:1;

a second adjuvant is added in the second reduction;

the second adjuvant comprises any one or a combination of at least two of anhydrous $MgCl_2$, a $MgCl_2$—$CaCl_2$) eutectic salt, a $MgCl_2$—NaCl eutectic salt or a $MgCl_2$—KCl eutectic salt;

a mass ratio of the second adjuvant to the first reduced powder or titanium dioxide is 0.05:1 to 3:1.

10. The method of preparing a titanium metal powder by reduction according to claim 6, wherein a temperature of the second reduction in the second scheme is 650° C. to 900° C.; or a temperature of the second reduction in the fourth scheme is 600° C. to 900° C.;

a time of the second reduction and the deep deoxidization is each independently 0.25 h to 48 h;

a protective atmosphere of the second reduction comprises any one or a combination of at least two of argon, hydrogen or helium.

11. The method of preparing a titanium metal powder by reduction according to claim 6, wherein a deep deoxidization adjuvant is added in the deep deoxidization;

a mass ratio of the deep deoxidization adjuvant to the titanium-oxygen solid solution, the first reduced powder or the second reduced powder is 0.05:1 to 3:1.

12. The method of preparing a titanium metal powder by reduction according to claim 11, wherein when the deep deoxidizer contains magnesium, a mass ratio of magnesium to the first reduced powder in the first scheme is 0.08:1 to 0.64:1, a mass ratio of magnesium to the second reduced powder in the second scheme is 0.03:1 to 0.2:1, a mass ratio of magnesium to the titanium-oxygen solid solution in the third scheme is 0.05:1 to 3:1, or a mass ratio of magnesium to the titanium-oxygen solid solution in the fourth scheme is 0.033:1 to 0.6:1;

when the deep deoxidizer contains magnesium, the deep deoxidization adjuvant comprises any one or a combination of at least two of anhydrous $MgCl_2$, a $MgCl_2$—$CaCl_2$) eutectic salt, a $MgCl_2$—NaCl eutectic salt or a $MgCl_2$—KCl eutectic salt;

when the deep deoxidizer contains magnesium, a temperature of the deep deoxidization is 650° C. to 900° C.;

when the deep deoxidizer contains magnesium, an atmosphere of the deep deoxidization comprises a hydrogen-argon mixed atmosphere or a pure hydrogen atmosphere;

a volume fraction of hydrogen in the hydrogen-argon mixed atmosphere is 5% to 100%.

13. The method of preparing a titanium metal powder by reduction according to claim 11, wherein when the deep deoxidizer contains calcium, a mass ratio of calcium to the first reduced powder in the first scheme is 0.13:1 to 1:1, a mass ratio of calcium to the second reduced powder in the second scheme is 0.05:1 to 0.4:1, a mass ratio of calcium to the titanium-oxygen solid solution in the third scheme is 0.05:1 to 3:1, or a mass ratio of calcium to the titanium-oxygen solid solution in the fourth scheme is 0.033:1 to 0.8:1;

when the deep deoxidizer contains calcium, the deep deoxidization adjuvant comprises any one or a combination of at least two of anhydrous $CaCl_2$), a $CaCl_2$)—$MgCl_2$ eutectic salt, a $CaCl_2$)—NaCl eutectic salt or a $CaCl_2$)—KCl eutectic salt;

when the deep deoxidizer contains calcium, a temperature of the deep deoxidization is 700° C. to 1100° C.;

when the deep deoxidizer contains calcium, an atmosphere of the deep deoxidization comprises vacuum or a protective atmosphere.

14. The method of preparing a titanium metal powder by reduction according to claim 6, wherein the method in the second scheme further comprises: performing a heat treatment on the second reduced powder between the second wet treatment and the deep deoxidization;

a temperature of the heat treatment is 750° C. to 1100° C.;

a time of the heat treatment is 0.167 h to 24 h.

15. The method of preparing a titanium metal powder by reduction according to claim 6, wherein a mass ratio of the first reduced powder to the titanium metal powder mixed in the third scheme is 1:0.25 to 1:10;

a mass ratio of the first reduced powder to the second reduced powder mixed in the fourth scheme is 1:0.267 to 1:10;

temperatures of the first sintering and the second sintering are each independently 800° C. to 1200° C.;

times of the first sintering and the second sintering are each independently 0.25 h to 24 h;

atmospheres of the first sintering, the second sintering, the third sintering and the heat treatment are each independently vacuum or a protective atmosphere;

protective atmospheres of the first sintering, the second sintering, the third sintering and the heat treatment each independently comprise any one or a combination of at least two of argon, hydrogen or helium.

16. A method of preparing a Ti6Al4V alloy powder, comprising the method of controllably reducing an oxygen content according to claim 1.

17. The method of preparing a Ti6Al4V alloy powder according to claim 16, comprising the following steps:

(1) performing the method of controllably reducing an oxygen content to obtain the first reduced powder; wherein the raw material is the vanadium oxide, the calcium source is a calcium oxide, and the first reduced powder is a 6Al4V alloy powder; wherein a mass ratio of vanadium to aluminum in the 6Al4V alloy powder is (3.5 to 4.5):(5.5 to 6.75), and the first reductant comprises aluminum; and performing third reduction on titanium dioxide with a third reductant to obtain a third reduced material, and performing a third wet treatment on the third reduced material to obtain a third reduced powder, wherein the third reduced powder is $TiO_x$, and x is less than or equal to 0.5; and (2) mixing the 6A14V alloy powder and the third reduced powder, performing fourth sintering to obtain an oxygen-containing Ti6Al4V alloy powder, and performing second deoxidization and a fourth wet treatment on the oxygen-containing Ti6Al4V alloy powder to obtain a Ti6Al4V alloy powder.

18. The method of preparing a Ti6Al4V alloy powder according to claim 17, wherein a third adjuvant is added in the third reduction;

a mass ratio of the third adjuvant to titanium dioxide is 0.05:1 to 3:1;

a time of the third reduction is 0.25 h to 24 h;

an atmosphere of the third reduction is vacuum or a protective atmosphere;

when the third reductant is aluminum, a molar ratio of the third reductant to titanium dioxide is 1:1 to 1.33:1;

when the third reductant is aluminum, a calcium oxide is added in the third reduction;

when the third reductant is aluminum, a molar ratio of the calcium oxide to the third reductant is 0.6:1 to 2:1;

when the third reductant is aluminum, the third adjuvant comprises any one or a combination of at least two of anhydrous $CaCl_2$), a $CaCl_2$)—KCl eutectic salt, a $CaCl_2$—NaCl eutectic salt or a $CaCl_2$—$AlCl_3$ eutectic salt;

when the third reductant is aluminum, a temperature of the third reduction is 700° C. to 1400° C.;

when the third reductant is magnesium, a molar ratio of the third reductant to titanium dioxide is 2:1 to 4:1;

when the third reductant is magnesium, the third adjuvant comprises any one or a combination of at least two of anhydrous $MgCl_2$, a $MgCl_2$—KCl eutectic salt, a $MgCl_2$—NaCl eutectic salt or a $MgCl_2$—$CaCl_2$) eutectic salt;

when the third reductant is magnesium, a temperature of the third reduction is 600° C. to 900° C.

19. The method of preparing a Ti6Al4V alloy powder according to claim 17, wherein a temperature of the fourth sintering is 900° C. to 1400° C.;

a time of the fourth sintering is 0.25 h to 24 h;

an atmosphere of the fourth sintering is vacuum or a protective atmosphere;

a fourth adjuvant is added in the second deoxidization;

when a second deoxidizer contains magnesium, a mass ratio of the oxygen-containing Ti6Al4V alloy powder to the second deoxidizer is 1:0.05 to 1:0.6;

when the second deoxidizer contains calcium, a mass ratio of the oxygen-containing Ti6Al4V alloy powder to the second deoxidizer is 1:0.1 to 1:1.

* * * * *